US008626037B2

(12) United States Patent
Yamaguchi et al.

(10) Patent No.: US 8,626,037 B2
(45) Date of Patent: Jan. 7, 2014

(54) POWDER CONTAINER HAVING AN OPENING ON AN END OF THE CONTAINER BODY, THE OPENING FACING THE LONGITUDINAL DIRECTION OF THE CONTAINER

(75) Inventors: Daichi Yamaguchi, Kanagawa (JP); Makoto Komatsu, Kanagawa (JP); Tadashi Hayakawa, Kanagawa (JP); Tsukuru Kai, Kanagawa (JP); Hiroshi Hosokawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/618,535

(22) Filed: Sep. 14, 2012

(65) Prior Publication Data

US 2013/0011166 A1 Jan. 10, 2013

Related U.S. Application Data

(63) Continuation of application No. 12/614,868, filed on Nov. 9, 2009, now Pat. No. 8,295,742.

(30) Foreign Application Priority Data

| | | |
|---|---|---|
| Nov. 10, 2008 | (JP) | 2008-288154 |
| Jun. 3, 2009 | (JP) | 2009-133982 |
| Jun. 26, 2009 | (JP) | 2009-152815 |

(51) Int. Cl.
*G03G 15/08* (2006.01)
*G03G 15/00* (2006.01)

(52) U.S. Cl.
USPC ..... 399/262; 399/12

(58) Field of Classification Search
USPC ..... 399/262, 12, 13, 258
See application file for complete search history.

(56) References Cited

U.S. PATENT DOCUMENTS

| | | | | |
|---|---|---|---|---|
| 4,112,471 | A | * | 9/1978 | Pollard et al. |
| 5,049,930 | A | | 9/1991 | Okano et al. |
| 5,455,662 | A | | 10/1995 | Ichikawa et al. |
| 5,598,254 | A | | 1/1997 | Ikesue et al. |
| 5,774,772 | A | | 6/1998 | Kai et al. |

(Continued)

FOREIGN PATENT DOCUMENTS

| | | | |
|---|---|---|---|
| CN | 1545681 | A | 11/2004 |
| EP | 0 560 687 | A1 | 9/1993 |

(Continued)

OTHER PUBLICATIONS

Chinese Office Action issued Nov. 22, 2012, in China Patent Application No. 200910212118.X (with English translation).

(Continued)

*Primary Examiner* — Susan Lee
(74) *Attorney, Agent, or Firm* — Oblon, Spivak, McClelland, Maier & Neustadt, L.L.P.

(57) ABSTRACT

A powder container that includes a container body, a drive transmitting unit which engages with an image forming apparatus, and an opening at an end of the container body. There is a conveying unit that conveys powder in the container body to the opening, and an information storage unit on the outer peripheral surface of the container body. The outer peripheral surface of the container body near the opening on which the information storage unit is to be mounted includes resin and is formed by injection molding.

22 Claims, 29 Drawing Sheets

(56) References Cited

U.S. PATENT DOCUMENTS

| | | | | |
|---|---|---|---|---|
| 5,915,155 | A | 6/1999 | Shoji et al. | |
| 5,966,574 | A | 10/1999 | Ui et al. | |
| 6,032,010 | A | 2/2000 | Kim et al. | |
| 6,104,900 | A | 8/2000 | Ishikawa et al. | |
| 6,240,262 | B1 * | 5/2001 | Taniyama et al. | 399/12 |
| 6,546,211 | B1 | 4/2003 | Shishikura | |
| 6,560,431 | B2 | 5/2003 | Hosokawa et al. | |
| 6,588,871 | B2 | 7/2003 | Studholme et al. | |
| 6,778,786 | B2 | 8/2004 | Aritomo et al. | |
| 7,321,744 | B2 | 1/2008 | Hosokawa et al. | |
| 8,238,796 | B2 | 8/2012 | Yoshida et al. | |
| 2002/0188259 | A1 | 12/2002 | Hickle et al. | |
| 2007/0209761 | A1 * | 9/2007 | Hitosugi et al. | |
| 2008/0124133 | A1 | 5/2008 | Yoshizawa | |
| 2008/0260432 | A1 | 10/2008 | Ohyama et al. | |
| 2009/0047044 | A1 * | 2/2009 | Sakita et al. | 399/258 |
| 2009/0169780 | A1 | 7/2009 | Kimura et al. | |
| 2009/0232526 | A1 * | 9/2009 | Yoneda et al. | |
| 2011/0064478 | A1 | 3/2011 | Yamaguchi et al. | |

FOREIGN PATENT DOCUMENTS

| | | | | |
|---|---|---|---|---|
| JP | 3492856 | | | 11/2003 |
| JP | 2004001403 | A | * | 1/2004 |
| JP | 2004-101853 | A | | 4/2004 |
| JP | 3600391 | | | 9/2004 |
| JP | 2005-227712 | A | | 8/2005 |
| JP | 2006-3374 | A | | 1/2006 |
| JP | 2007-178969 | | | 7/2007 |
| JP | 2008-77058 | A | | 4/2008 |
| JP | 2008-81165 | | | 4/2008 |
| JP | 2008-84988 | A | | 4/2008 |
| JP | 2008-197842 | | | 8/2008 |
| WO | WO 2007/074865 | | | 7/2007 |

OTHER PUBLICATIONS

Office Action issued May 24, 2013 in Japanese Patent Application No. 2009-152815.

* cited by examiner

POWDER CONTAINER HAVING AN OPENING ON AN END OF THE CONTAINER BODY, THE OPENING FACING THE LONGITUDINAL DIRECTION OF THE CONTAINER

CROSS-REFERENCE TO RELATED APPLICATIONS

The present application is a continuation of U.S. application Ser. No. 12/614,868 filed Nov. 9, 2009 now U.S. Pat No. 8,295,742, which claims priority to Japanese Patent Application No. 2008-288,154 filed in Japan on Nov. 10, 2008, Japanese Patent Application No. 2009-133982 filed in Japan on Jun. 3, 2009 Japanese Patent Application No. 2009-152815 filed in Japan on Jun. 26, 2009, the entire contents of each of which are incorporated herein by reference.

BACKGROUND OF THE INVENTION

1. Field of the Invention

The present invention relates to a powder container that contains powder used in an image forming apparatus, such as a printer, a facsimile, and a copier, a powder supplying device equipped with the powder container, and an image forming apparatus.

2. Description of the Related Art

In an image forming apparatus that causes a developing device to develop an electrostatic latent image formed on a latent-image carrier, toner in the developing device is consumed according to image formation. To cope with this situation, there has been proposed a conventional image forming apparatus that includes a toner supplying device equipped with a toner container that contains toner so that the toner supplying device can supply the toner contained in the toner container to a developing device.

An image forming apparatus disclosed in Japanese Patent No. 3492856 includes a toner supplying device that is equipped with a removable toner container that contains toner in a container body thereof, so that the toner supplying device supplies the toner contained in the toner container to a developing device. The image forming apparatus is configured such that a user can replace a toner container that has become empty because of use over time with a new toner container by pulling out the toner supplying device that is mounted on a predetermined mounting position within a body of the image forming apparatus from the body of the image forming apparatus.

In recent years, in view of environmental preservation, the toner container that has become empty because of use over time is collected from a user, and then subjected to predetermined recycling processing, such as cleaning or supplying of toner, so that the toner container can be reused as a recycled product.

There has been proposed another conventional image forming apparatus that is equipped with an information storage unit, such as an integrated circuit (IC) chip, for storing use history information on a toner container, so that the use history information can be written in the information storage unit of the toner container. The image forming apparatus transmits a radio signal of use log information (i.e., a toner container lot, a manufacturing date, an amount of remained toner, an amount of supplied toner, supplied time, a type, a storage period, recycling frequency, an upper limit of recycling frequency) to the information storage unit mounted on the toner container by using a communicating unit of the image forming apparatus. The information storage unit receives the radio signal transmitted from the communicating unit of the image forming apparatus, and stores the use log information in a nonvolatile memory thereof. Thus, when performing recycling processing on the toner container, it is possible to determine whether recycling is feasible by reading the use log information from the nonvolatile memory of the information storage unit.

Regarding the container body of the toner container, the container body made of resin such as polyethylene or polypropylene has been mainly used. When the information storage unit is attached to such a container body with an adhesive, it is difficult to bond the information storage unit to the container body because polyethylene and polypropylene are so-called adhesive-resistant material, so that the information storage unit may easily be removed from the container body. Therefore, the information storage unit may be removed from the container body during the above-mentioned recycling processing. If the information storage unit is removed from the container body as mentioned above, accumulated use history information of the toner container is lost, so that quality control of the recycled toner container may not be performed as desired (first problem).

Furthermore, when communication is performed between the communicating unit of the image forming apparatus and the information storage unit of the toner container, a noise may be applied to a radio signal used for the communication between the information storage unit and the communicating unit because of an electromagnetic wave emitted from a motor that drives the toner container to rotate. When a frequency band of the electromagnetic wave from the motor is close to a frequency band of the radio signal, the above-mentioned situation is more likely to occur (second problem).

SUMMARY OF THE INVENTION

It is an object of the present invention to at least partially solve the problems in the conventional technology.

According to an aspect of the present invention there is provided a powder container that has a hollow interior for containing powder, the powder container including a tubular member that is equipped with an information storage unit that stores therein at least information related to a container body, and attached to the container body such that the container body is located within an inner hole of the tubular member; and a movement restricting unit that restricts movement of the tubular member in an axial direction of the tubular member.

According to another aspect of the present invention there is provided a powder supplying device configured to supply powder contained in a powder container to a powder receiving unit, the powder container being attachable to and detachable from a device body of the powder supplying device, wherein the powder container has a hollow interior for containing powder and includes a tubular member that is equipped with an information storage unit that stores therein at least information related to a container body, and attached to the container body such that the container body is located within an inner hole of the tubular member; and a movement restricting unit that restricts movement of the tubular member in an axial direction of the tubular member.

According to still another aspect of the present invention there is provided an image forming apparatus including an image carrier that carries a latent image; a developing unit that develops the latent image carried on the image carrier with powder developer; a powder supplying unit that is equipped with a powder container in a removable manner, the powder container containing the developer, and supplies the developer contained in a container body of the powder container to the developing unit; an information storage unit that is attached to the container body and stores therein information related to the container body; and a communicating unit that is attached to a body of the image forming apparatus and reads information stored in the information storage unit, wherein the powder container has a hollow interior for containing the developer and includes a tubular member that is equipped with an information storage unit that stores therein at least information related to a container body, and attached to the container body such that the container body is located within an inner hole of the tubular member; and a movement restricting unit that restricts movement of the tubular member in an axial direction of the tubular member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. In a first embodiment, an example is described in which the present invention is applied to an electrophotographic copier (hereinafter, referred to as "copier") that functions as an image forming apparatus.

Figure 2:
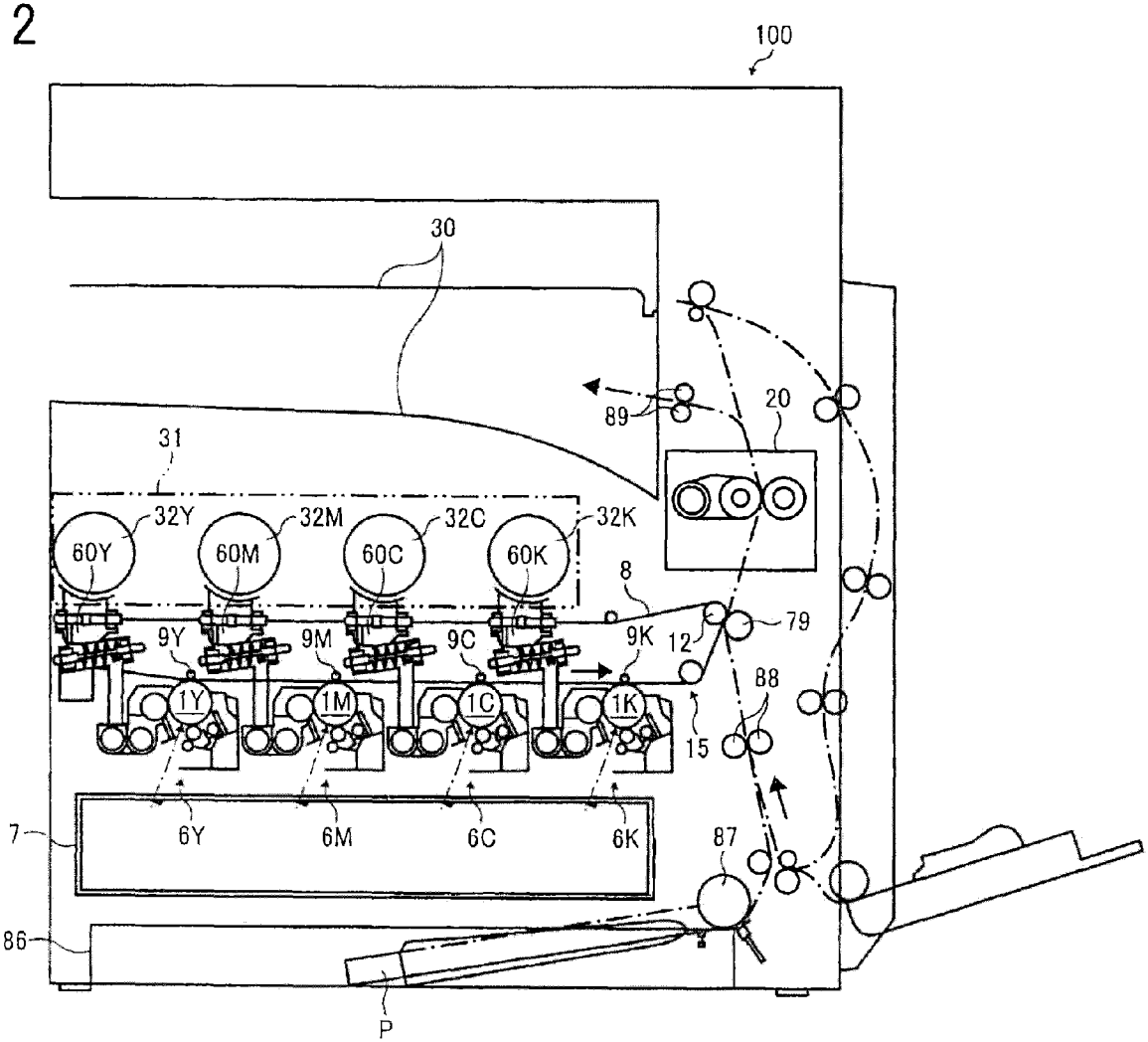
FIG. 2 is a schematic configuration diagram of a copier according to an embodiment of the present invention.

An entire configuration and general operation of an image forming apparatus is described below. As shown in FIG. 2, four toner containers 32Y, 32M, 32C, and 32K for respective colors (i.e., yellow, magenta, cyan, and black) are removably (exchangeably) mounted on a toner-container housing unit 31 that is located at a top portion of an image forming apparatus body 100. An intermediate transfer unit 15 is arranged below the toner-container housing unit 31. Image forming units 6Y, 6M, 6C, and 6K for respective colors (i.e., yellow, magenta, cyan, and black) are arranged parallel to each other such that they face an intermediate transfer belt 8 of the intermediate transfer unit 15.

The toner containers 32Y, 32M, 32C, and 32K housed in the toner-container housing unit 31 are supported by toner supplying devices 60Y, 60M, 60C, and 60K, respectively. Each of the toner supplying devices 60Y, 60M, 60C, and 60K supplies (feeds) toner contained in corresponding one of the toner containers 32Y, 32M, 32C, and 32K to a developing device of corresponding one of the image forming units 6Y, 6M, 6C, and 6K.

Figure 3:
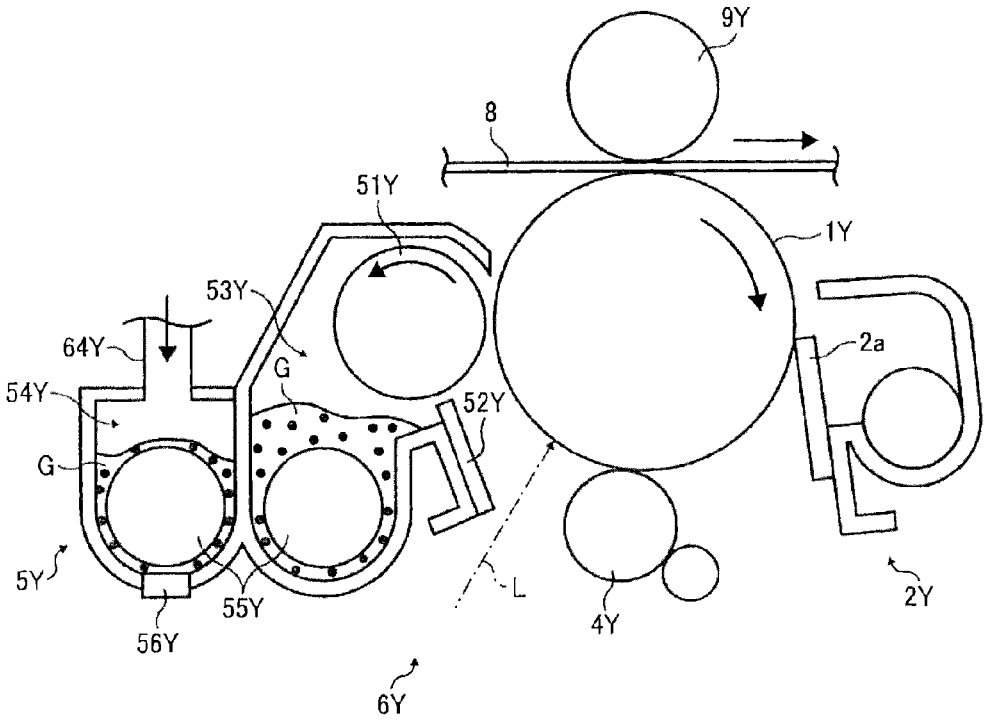
FIG. 3 is a schematic configuration diagram of an image forming unit.

As shown in FIG. 3, the image forming unit 6Y for yellow includes a photosensitive drum 1Y, a charging unit 4Y that is located at a periphery of the photosensitive drum 1Y, a developing device 5Y (i.e., a developing unit), a cleaning unit 2Y, a neutralizing unit (not shown), and the like. A series of processes for image formation (i.e., a charging process, an exposing process, a developing process, a transferring process, and a cleaning process) is performed on the photosensitive drum 1Y to form a yellow image on the photosensitive drum 1Y.

Each of the other three image forming units 6M, 6C, and 6K has substantially the same structure as the image forming unit 6Y for yellow except for color of toner to be used, so that each forms an image of a corresponding toner color. In the following description, only the image forming unit 6Y for yellow will be described in detail and explanation about the other three image forming units 6M, 6C, and 6K will be omitted as appropriate.

As shown in FIG. 3, the photosensitive drum 1Y is driven to rotate clockwise in FIG. 3 by a drive motor (not shown). At a position facing the charging unit 4Y, a surface of the photosensitive drum 1Y is uniformly charged (the charging process).

The surface of the photosensitive drum 1Y is conveyed to a position where laser light L emitted from an exposing device 7 (see FIG. 2) is applied. At this position, an electrostatic latent image of yellow is formed through exposure scanning (the exposing process).

The surface of the photosensitive drum 1Y is further conveyed to a position facing the developing device 5Y. At this position, the electrostatic latent image is developed, so that a toner image of yellow is formed (the developing process).

The surface of the photosensitive drum 1Y is further conveyed to a position facing both the intermediate transfer belt 8 and a primary-transfer bias roller 9Y. At this position, the toner image on the photosensitive drum 1Y is transferred onto the intermediate transfer belt 8 (a primary transferring process). At this time, a small amount of untransferred toner remains on the photosensitive drum 1Y.

The surface of the photosensitive drum 1Y is further conveyed to a position facing the cleaning unit 2Y. At this position, a cleaning blade 2*a* mechanically collects the untransferred toner that has been remained on the photosensitive drum 1Y (the cleaning process).

The surface of the photosensitive drum 1Y is further conveyed to a position facing the neutralizing unit (not shown). At this position, residual potential on the photosensitive drum 1Y is removed.

In this manner, a series of the processes for image formation performed on the photosensitive drum 1Y is completed.

The above-mentioned image forming processes are also performed on each of the other image forming units 6M, 6C, and 6K in the same manner as the image forming unit 6Y for yellow. Specifically, the exposing device 7 arranged below the image forming units emits laser light L corresponding to image information toward each of the photosensitive drums of the image forming units 6M, 6C, and 6K. More particularly, the exposing device 7 emits the laser light L from a light source and causes a polygon mirror to rotate to scan each of photosensitive drums 1 with the laser light L, so that each of the photosensitive drums 1 is irradiated with the laser light L. Then, toner images of respective colors that have been formed on the photosensitive drums 1 through the developing process are superimposed one on top of the other on the intermediate transfer belt 8. As a result, a color image is formed on the intermediate transfer belt 8.

As shown in FIG. 2, the intermediate transfer unit 15 includes the intermediate transfer belt 8, four primary-transfer bias rollers 9Y, 9M, 9C, and 9K, a secondary-transfer backup roller 12, a plurality of tension rollers, an intermediate transfer cleaning unit, and the like. The intermediate transfer belt 8 is extended around and supported by a plurality of roller members, and driven to rotate endlessly in a direction indicated by an arrow in FIG. 2 along with rotation of the secondary-transfer backup roller 12.

Each of the four primary-transfer bias rollers 9Y, 9M, 9C, and 9K and corresponding one of the photosensitive drums 1Y, 1M, 1C, and 1K sandwich the intermediate transfer belt 8 to form a primary transfer nip. A transfer bias voltage of opposite polarity of that of toner is applied to each of the primary-transfer bias rollers 9Y, 9M, 9C, and 9K.

The intermediate transfer belt 8 moves in the direction of the arrow and sequentially passes through the primary transfer nip of each of the primary-transfer bias rollers 9Y, 9M, 9C, and 9K. Accordingly, the toner image of each color on each of the photosensitive drums 1Y, 1M, 1C, and 1K is primarily transferred onto the intermediate transfer belt 8 one on top of the other.

The intermediate transfer belt 8 bearing the superimposed toner images of respective colors moves to a position facing a secondary transfer roller 79. At this position, the secondary-transfer backup roller 12 and the secondary transfer roller 79 sandwich the intermediate transfer belt 8 to form a secondary transfer nip. The four-color toner image formed on the intermediate transfer belt 8 is transferred onto a recording medium P, such as a transfer sheet, that has been conveyed to a position of the secondary transfer nip. At this time, untransferred toner that has not been transferred onto the recording medium P remains on the intermediate transfer belt 8.

The intermediate transfer belt 8 then moves to a position of the intermediate transfer cleaning unit (not shown). At this position, the untransferred toner remained on the intermediate transfer belt 8 is collected.

In this manner, a series of transferring processes performed on the intermediate transfer belt 8 is completed.

The recording medium P conveyed to a position of the secondary transfer nip has been conveyed from a sheet feed unit 86 that is located at a bottom portion of the image forming apparatus body 100 via a sheet feed roller 87, a registration roller pair 88, and the like. More specifically, a plurality of the recording media P, such as transfer sheets, is stacked on top of each other in the sheet feed unit 86. When the sheet feed roller 87 is driven to rotate counterclockwise in FIG. 2, a topmost recording medium P is fed toward a space between rollers of the registration roller pair 88.

The recording medium P conveyed to the registration roller pair 88 is temporarily stopped at a roller nip between the registration roller pair 88 whose rotation has been stopped. Subsequently, the registration roller pair 88 is driven to rotate to convey the recording medium P toward the secondary transfer nip at a timing corresponding to conveyance of the color image on the intermediate transfer belt 8. Accordingly, a desired color image is transferred onto the recording medium P.

The recording medium P onto which the color image is transferred at the secondary transfer nip is further conveyed to a position of a fixing unit 20. At this position, the color image that has been transferred onto the surface of the recording medium P is fixed to the recording medium P because of heat and pressure of a fixing belt and a pressurizing roller.

The recording medium P is then discharged out of the image forming apparatus via a space between rollers of a discharge roller pair 89. The recording medium P discharged out of the image forming apparatus via the discharge roller pair 89 is stacked on a stacking unit 30 one on top of the other as an output image. In this manner, a series of image forming processes performed by the image forming apparatus is completed.

A configuration and operation of the developing device of the image forming unit is described in detail below with reference to FIG. 3. The developing device 5Y includes a developing roller 51Y that faces the photosensitive drum 1Y, a doctor blade 52Y that faces the developing roller 51Y, two conveying screws 55Y respectively arranged in developer containers 53Y and 54Y, a density detection sensor 56Y that detects toner density in a developer, and the like. The developing roller 51Y includes a magnet that is fixedly mounted inside thereof, a sleeve that rotates about the magnet, and the like. Two-component developer G formed of carrier and toner is contained in each of the developer containers 53Y and 54Y. The developer container 54Y is communicated with a toner fall path 64Y via an opening formed at a top portion thereof.

The developing device 5Y having the above-mentioned configuration operates in the following manner. That is, the sleeve of the developing roller 51Y rotates in a direction indicated by an arrow in FIG. 3. The developer G that is carried on a surface of the developing roller 51Y because of a magnetic field generated by the magnet moves on the surface of the developing roller 51Y along with the rotation of the sleeve.

The developer G contained in the developing device 5Y is controlled such that a ratio of toner to the developer (i.e., toner density) can be within a predetermined range. More specifically, the toner contained in the toner container 32Y is supplied to the developer container 54Y via the toner supplying device 60Y according to an amount of consumption of toner in the developing device 5Y.

The toner supplied to the developer container 54Y is mixed and stirred with the developer G by the two conveying screws 55Y, so that the toner is allowed to circulate in the developer containers 53Y and 54Y (i.e., movement in a direction normal to a plane of FIG. 3). The toner in the developer G sticks to the carrier because of triboelectric charging of the toner and the carrier, so that the toner is carried on the developing roller 51Y together with the carrier due to the magnetic force generated on the developing roller 51Y.

The developer G carried on the developing roller 51Y is conveyed in the direction of the arrow in FIG. 3 to a position facing the doctor blade 52Y. At this position, an amount of the developer G on the developing roller 51Y is adjusted to an appropriate amount, and then, the developer G is conveyed to a position facing the photosensitive drum 1Y (i.e., to a development area). Subsequently, toner sticks to a latent image formed on the photosensitive drum 1Y because of an electric field generated in the development area. The developer G remained on the developing roller 51Y is conveyed to a position above the developer container 53Y along with the rotation of the sleeve, and removed from the developing roller 51Y at this position.

Figure 4A:
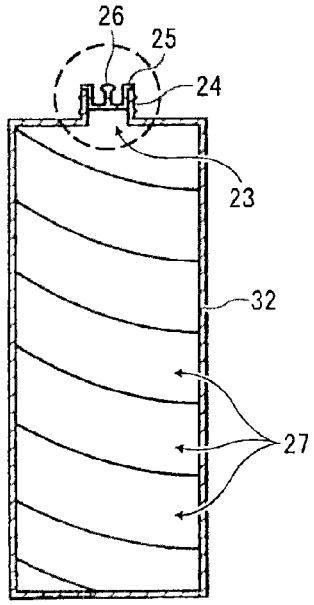
FIG. 4A is a longitudinal sectional view of the toner container.
Figure 4B:
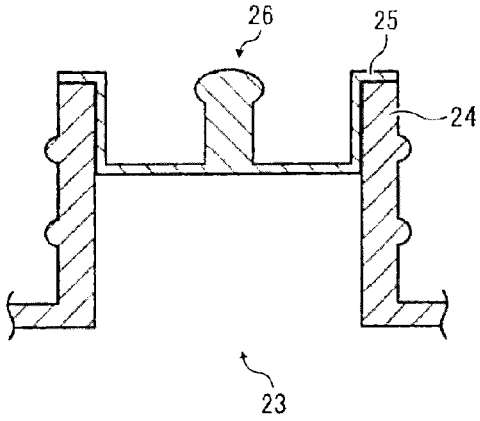
FIG. 4B is an enlarged view of an opening of the toner container.

FIG. 4A is a longitudinal sectional view of an example of a toner container 32 that is made of synthetic resin such as polyethylene, polypropylene, or polyethylene-polycarbonate blend. FIG. 4B is an enlarged view of an opening 23.

The toner container 32 has a substantially cylindrical shape, and includes the opening 23 having a diameter smaller than that of a cylindrical portion of the toner container 32 in the center of one end surface thereof. The opening 23 is formed on an end portion of a collar 24 that is protruded outward from the toner container 32. A plug 25 is put on to seal the opening 23. A knob portion 26 is formed in the center of the plug 25. On an inner peripheral surface of the cylindrical portion is formed a guide groove 27 in a spiral manner so that toner contained in the toner container 32 can be guided toward the opening 23 when a container rotation driving device (not shown) rotates the toner container 32 that is mounted on a toner supplying device 60.

Figure 5:
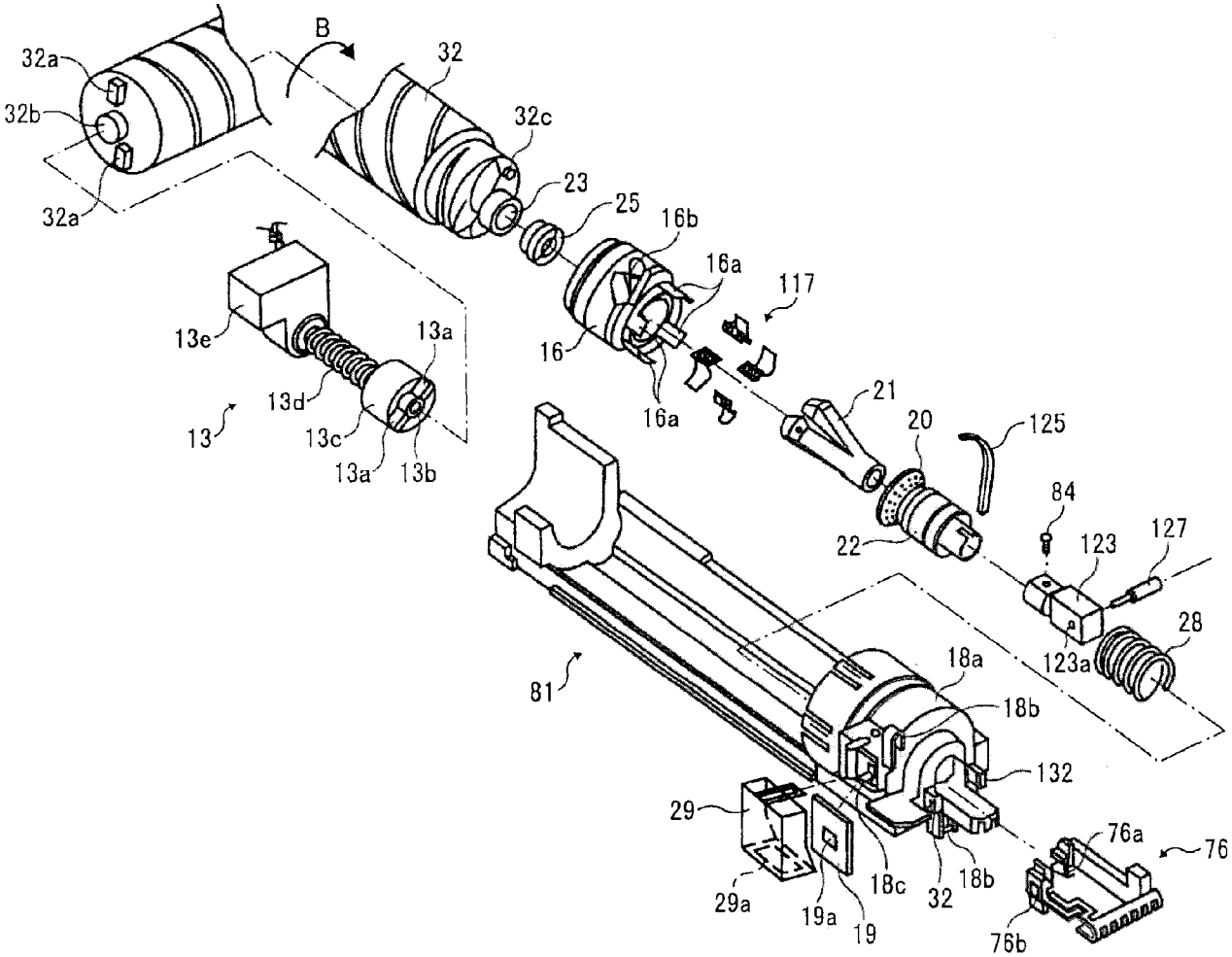
FIG. 5 is an exploded perspective view of components of a toner supplying device.

The toner supplying device 60 is described in detail below. As shown in FIG. 5, a reference numeral 13 denotes a driving unit that functions as a rotation driving unit to rotate the toner container 32 mounted on the toner supplying device 60. The driving unit 13 includes a joint 13*c* that functions as an engaging member, a spring 13*d*, a motor 13*e*, and a case that houses a shaft. The driving unit 13 is fixed to a body rear plate (not shown). Protrusions 32*a* and 32*b* (in convex shapes) are formed on a rear portion of the toner container 32. The protrusion 32*b* is inserted into a concave portion 13*b* of the joint 13*c* to hold the rear portion of the toner container 32. The protrusions 32*a* are respectively engaged with convex side surfaces 13*a* of the joint 13*c* to rotate the toner container 32.

A height H of the protrusion 32*b* is set to be higher than a height h of each of the protrusions 32*a* (H>h). A reference numeral 16 denotes a container holding member that holds a head portion of the toner container 32. A reference numeral 117 denotes toner supply wings that are made of elastic material such as mylar or rubber and respectively attached, with a double-sided tape, to ribs 16*a* that are integrated with the container holding member 16 and function as a kind of agitators. In the present embodiment, four toner supply wings 117 are provided.

Figure 6:
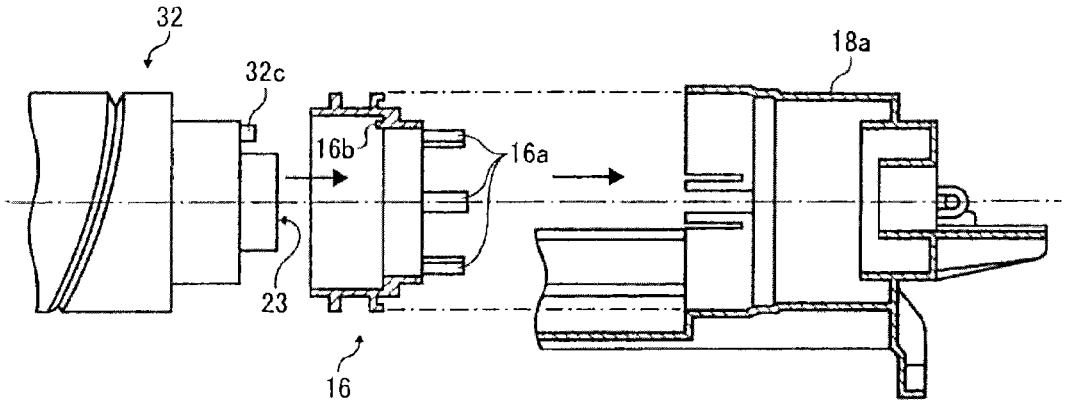
FIG. 6 is an exploded cross-sectional view of components located near a container holding member.

As shown in FIG. 6, a drive rib 16*b* formed on an inner peripheral surface of the container holding member 16 is engaged with a driving-force transmitting protrusion 32*c* that is formed on the head portion of the toner container 32, so that the container holding member 16 and the toner container 32 rotate in a normal rotation direction in an integrated manner.

As shown in FIG. 5, a reference numeral 20 denotes a seal member. A reference numeral 21 denotes a collet chuck that pinches or releases the knob portion 26 of the plug 25. The collet chuck 21 is housed in a cylindrical case 22 and integrated with a shaft member 123 via a screw 84. A reference numeral 125 denotes a seal member. A reference numeral 28 denotes a coil spring that always applies pressure to bias components such as the collet chuck 21, the cylindrical case 22, and the shaft member 123 toward the toner container 32. The components are housed in a case 18*a* that functions as a container holding unit and is integrated with a container holder 81 of the toner supplying device 60. A reference numeral 76 denotes a handle for putting on or removing the plug 25. The handle 76 is rotatable in a state where a shaft member 76*b* is inserted into a shaft bearing portion 132 of the case 18*a*.

A reference numeral 127 denotes a slide shaft that is inserted into a hole 123*a* formed on the shaft member 123. The slide shaft 127 is brought into contact with a cam member 76*a* that is formed on the handle 76, so that the components such as the collet chuck 21, the cylindrical case 22, and the shaft member 123 can be slid in a direction away from the toner container 32 by rotating the handle 76.

An elastic member 19, which is made of elastic material such as mylar or rubber and provided with a slit hole 19*a* that is a long and thin hole elongated in a direction perpendicular to a movement direction of the toner supply wings 117 (i.e., elongated in a horizontal direction), is attached to an opening 18*c*, which is formed on the case 18*a* and communicated with the opening 23 of the toner container 32 that is supported by the container holder 81, with a double-sided tape. By controlling setting of an opening area of the slit hole 19*a*, that is, by appropriately setting a length (in the horizontal direction) and a width (in the movement direction of the toner supply wings 117) of the slit hole 19*a*, an amount of supply of toner can be adjusted appropriately. In the present embodiment, the toner supply wings 117 are respectively attached to the ribs 16*a* such that an amount of protrusion of each of the toner supply wings 117 from the slit hole 19*a* becomes about 1 millimeter.

Figure 7:
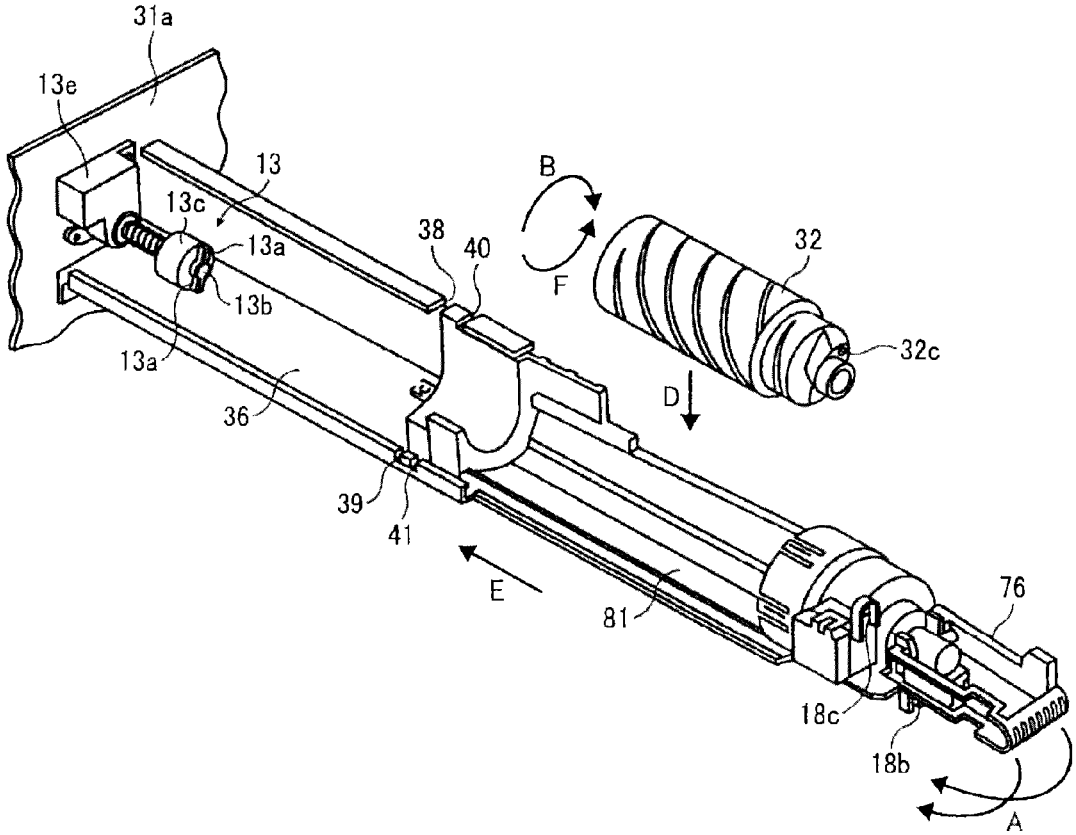
FIG. 7 is a perspective view of a container holder that is pulled out from a guide plate.

A reference numeral 29 is a cover that guides toner discharged from the slit hole 19*a* to a toner fall path 64. An opening 29*a* is formed on a bottom side of the cover 29 so as to correspond to a position of the toner fall path 64. As shown in FIG. 7, the toner supplying device 60 having the above-mentioned configuration is supported by a guide plate 36 mounted on a body rear plate 31*a* and a body front plate (not shown). A reference numeral 18*b* denotes a hole that is integrated with the container holder 81 and engaged with a positioning pin that is formed on the body front plate (not shown). A stopper (not shown) that prevents misalignment of the toner supplying device 60 is mounted on the guide plate 36. Thus, the toner supplying device 60 of the present embodiment includes a mechanical section formed of the case 18*a* and movable components such as the container holding member 16 housed in the case 18*a*, the toner container 32 that is removable from the mechanical unit, and the driving unit 13.

Operation for setting the toner supplying device 60 in the above configuration is described below. As shown in FIG. 7, when the container holder 81 is pulled out from the guide plate 36 and stepped portions 40 and 41 of the container holder 81 are respectively hooked on notch portions 38 and 39 of the guide plate 36, the toner container 32 filled with toner can be placed to be mounted on the container holder 81 in a direction indicated by an arrow D in FIG. 7. Then, the toner supplying device 60 on which the toner container 32 is mounted is slid on the guide plate 36 in a direction indicated by an arrow E in FIG. 7 so as to be set at a designated position. Accordingly, the protrusion 32*b* on the rear portion of the toner container 32 is inserted into the concave portion 13*b* (positioning concave portion) of the joint 13*c* to thereby fix the position of the toner container 32, and the head portion of the toner container 32 is engaged with the container holding member 16. At this time, the stopper presses a front surface of the container holder 81 to complete setting of the toner supplying device 60.

Figure 8:
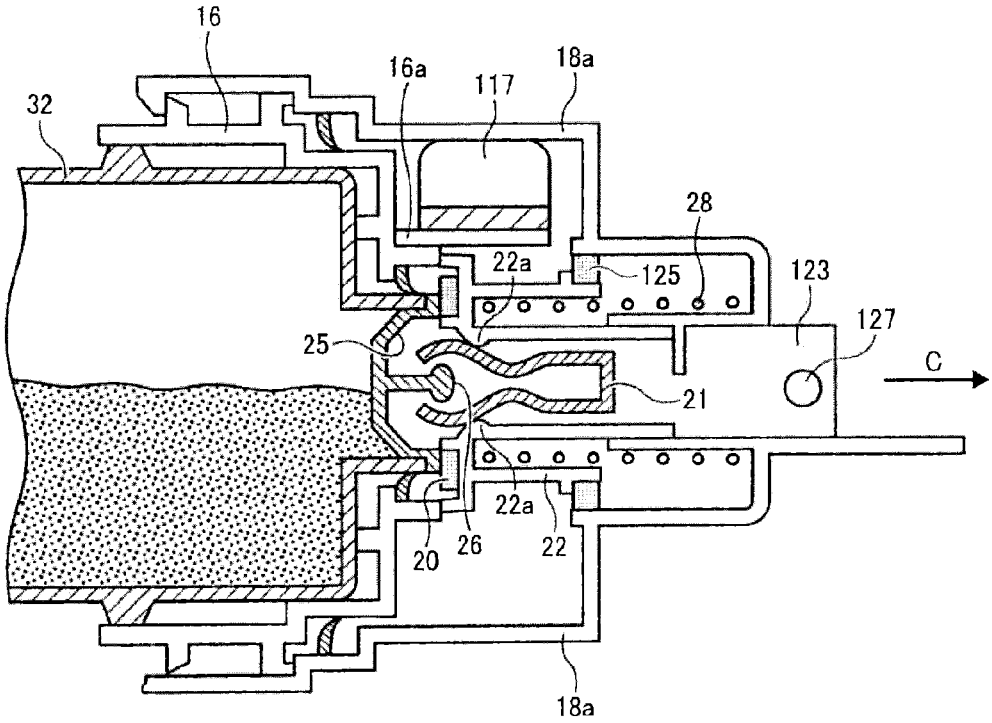
FIG. 8 is a cross-sectional view of the toner container mounted on the toner supplying device.
Figure 9:
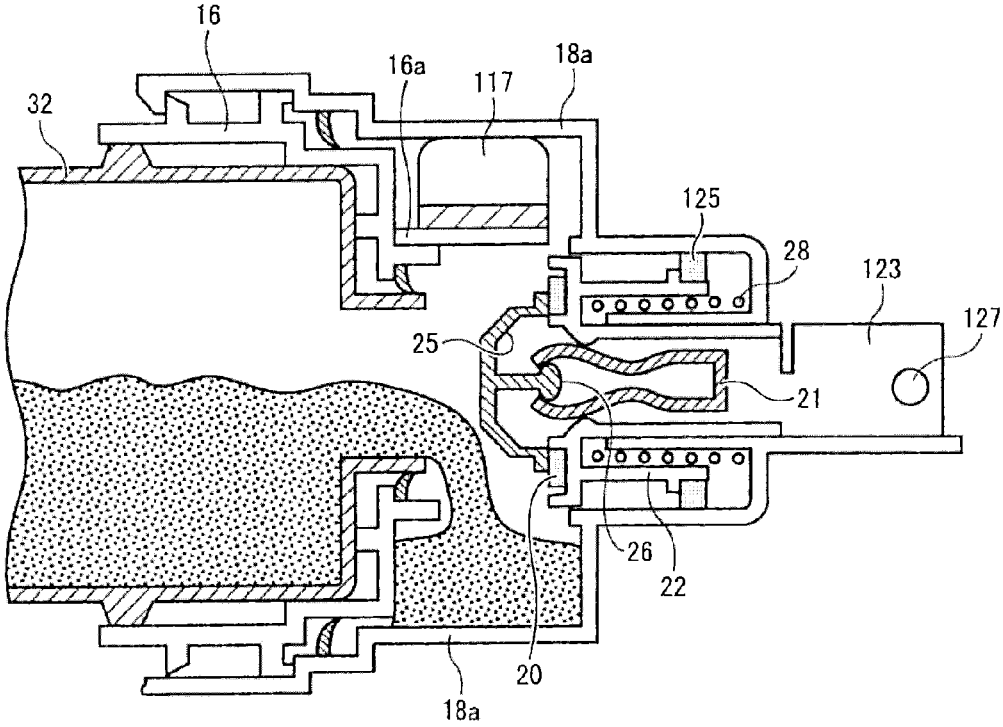
FIG. 9 is a cross-sectional view of the toner container from which toner is being discharged to a container holding unit.

When the handle 76 is rotated in a direction indicated by an arrow A (in a downward direction) as shown in FIG. 7, the cam member 76*a* (see FIG. 5) pulls the slide shaft 127 in a direction indicated by an arrow C as shown in FIG. 8, so that the shaft member 123 starts to move in the direction of the arrow C, resulting in causing the collet chuck 21 to come into contact with protrusion 22*a* of the cylindrical case 22. Accordingly, the collet chuck 21 starts closing to pinch the knob portion 26 of the plug 25. In this situation, when movement in the direction of the arrow C is continued, the collet chuck 21 removes the plug 25 from the toner container 32 as shown in FIG. 9, so that the toner contained in the toner container 32 flows out to the case 18*a* (if an amount of the toner contained in the toner container 32 is small, the toner does not flow out at this time). This state means that the setting of the toner supplying device 60 is completed.

Operation for supplying toner is described below. Regarding toner supply, when a density detection sensor 56 located inside a developing device 5 detects absence of toner, the driving unit 13 shown in FIGS. 5 and 7 operates to drive the joint 13*c* to rotate in a direction indicated by an arrow B. Accordingly, the joint 13*c* is engaged with the protrusion 32*a* formed on the rear portion of the toner container 32, so that the toner container 32 rotates. With rotation of the toner container 32, the toner is discharged from the opening 23 and collected in the case 18*a*. At the same time, the rotation of the toner container 32 is transmitted to the container holding member 16 via the drive rib 16*b* that is integrated with the container holding member 16, so that the toner supply wings 117 rotate while sliding on an inner wall surface of the case 18*a*. As a result, the toner collected in the case 18*a* is stirred. When each of the toner supply wings 117 passes through the slit hole 19*a* of the elastic member 19, the toner is pushed out of the slit hole 19*a*. More specifically, when each of the toner supply wings 117 is pushed out of the slit hole 19*a*, the toner collected around an edge portion of the slit hole 19*a* or an edge portion of the opening 18*c* is pushed out. The toner that has been pushed out falls within the cover 29 so that the toner is supplied from the toner fall path 64 to the developing device 5 via the opening 29*a* that is formed on the bottom side of the cover 29.

In other words, only while the toner container 32 is rotating, the toner is pushed out from the elastic member 19 to the toner fall path 64 so that the toner can be supplied to the developing device 5. Accordingly, the toner density in the developing device 5 is maintained constant.

By mounting a removing mechanism that removes the plug 25 on the toner supplying device 60, the toner container 32 can be mounted on the container holder 81 while the opening 23 is sealed by the plug 25. Therefore, even when the toner container 32 is mounted on the container holder 81 in a substantially horizontal position, it is possible to prevent leakage of toner from the opening 23.

When the plug 25 is put on the opening 23 of the toner container 32, the above-mentioned operation for removing the plug 25 from the opening 23 is performed in a reverse order. In this manner, when the plug 25 is put on the opening 23 of the toner container 32 to seal the opening 23 by the plug 25 at the time of removal of the toner container 32 from the container holder 81, it is possible to prevent a situation in which the toner that is adhered to a wall surface of the toner container 32 near the opening 23 of the toner container 32 is leaked and dispersed from the opening 23 to the inside of the image forming apparatus.

As described above, the toner supplying device 60 of the present embodiment enables replacement of the toner container 32 without causing leakage of toner from the opening 23 of the toner container 32.

Figure 10:
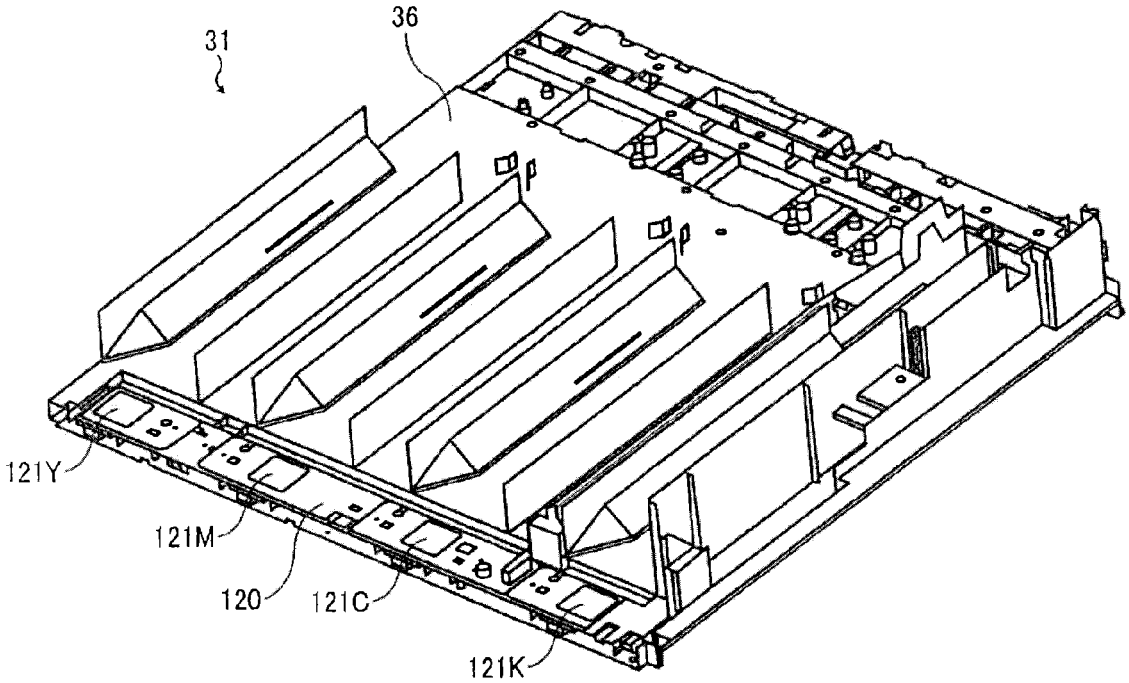
FIG. 10 is a perspective view of a holding unit of a toner-container housing unit.

In the present embodiment, as shown in FIG. 10, a single antenna substrate 120 is mounted on the guide plate 36 of the toner-container housing unit 31 (i.e., the toner supplying devices 60Y, 60M, 60C, and 60K) on which the toner containers 32 are removably mounted in parallel to each other. More specifically, four antennas 121Y, 121M, 121C, and 121K, which perform wireless communication with respective RFID tags that are attached to respective peripheral surfaces of the four toner containers 32Y, 32M, 32C, and 32K that are arranged in parallel to each other on the guide plate 36 (the RFID tags will be described in detail later), are formed on the same plane of the antenna substrate 120 so as to face the respective RFID tags. More particularly, the antenna substrate 120 is placed below the toner containers 32Y, 32M, 32C, and 32K that are arranged in parallel to each other on the guide plate 36.

In FIG. 10, the antenna substrate 120 is mounted on the guide plate 36 such that each of the RFID tags of the toner containers 32Y, 32M, 32C, and 32K faces a corresponding one of the antennas 121Y, 121M, 121C, and 121K on a front side of the image forming apparatus body. However, a mounting position of the antenna substrate 120 on the guide plate 36 is not limited to this example. The antenna substrate 120 can be mounted on arbitrary positions on the guide plate 36 such that each of the RFID tags of the toner containers 32Y, 32M, 32C, and 32K can face a corresponding one of the antennas 121Y, 121M, 121C, and 121K. In an extreme case, any positions can be employed to mount the antenna substrate 120 as long as each of the RFID tags of the toner containers 32Y, 32M, 32C, and 32K can perform good communication with a corresponding one of the antennas 121Y, 121M, 121C, and 121K.

In a state where the toner container 32 is mounted on the toner-container housing unit 31, the RFID tag on the toner container 32 and the image forming apparatus body 100 equipped with an antenna 121 (i.e., the antenna substrate 120) exchange necessary information with each other. In other words, information stored in the RFID tag is transmitted to a control unit (not shown) of the image forming apparatus body 100 via the antenna 121 (i.e., the antenna substrate 120), and information about the image forming apparatus body 100, which is acquired by the control unit, is transmitted to and stored in the RFID tag via the antenna 121 (i.e., the antenna substrate 120). The image forming apparatus body 100 is optimally controlled based on the above information. For example, when it is detected from the above information that the toner container 32 filled with toner of color different from designated color is mounted on the toner-container housing unit 31, the control unit stops operation of the toner supplying device 60.

Salient features of the present embodiment will be described in detail below.

Figure 1:
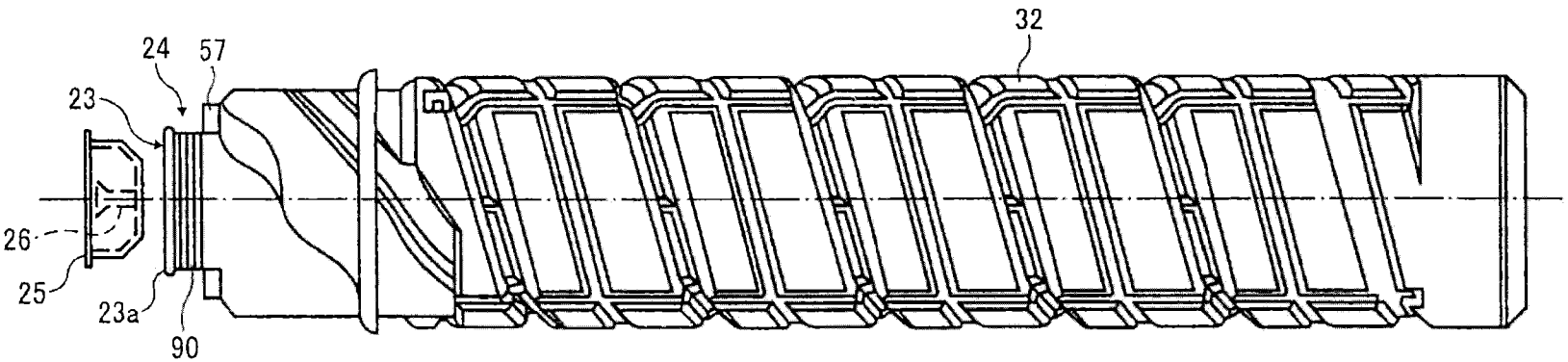
FIG. 1 is a schematic diagram of a toner container equipped with a radio-frequency identification (RFID) tag.

In a first configuration embodiment, as shown in FIG. 1, an RFID tag 90 in a tubular shape and formed of a flexible electronic substrate is attached so as to surround an outer peripheral surface of the collar 24 of the toner container 32. In other words, the RFID tag 90 is attached to the toner container 32 such that the collar 24 of the toner container 32 is located within an inner hole of the RFID tag 90 in the tubular shape. The RFID tag 90 stores therein information related to toner, such as color of the toner, an amount of the toner, a manufacturing number of the toner (i.e., a manufacturing lot), and a manufacturing date of the toner, and information related to recycling of the toner container 32, such as recycling frequency, date of recycling, and recycling manufacturer.

Figure 11:
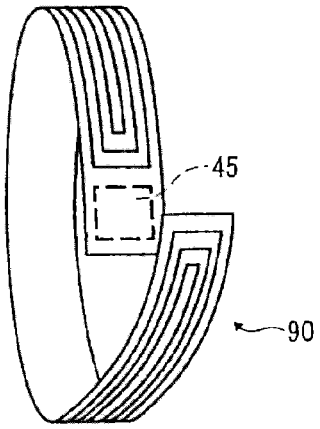
FIG. 11 is a schematic diagram for explaining how an RFID tag in a rectangular shape is formed into a tubular shape.

In the present configuration example, as shown in FIG. 11, a front surface of one end portion of the RFID tag 90 (i.e., the electronic substrate) in a rectangular shape and a back surface of the other end portion of the RFID tag 90 are stuck to each other with an adhesive member 45 such as a double-sided tape, so that the RFID tag 90 is eventually formed into a tubular shape. When the RFID tag 90 is to be attached to the toner container 32, the RFID tag 90 (i.e., the electronic substrate) in the rectangular shape is wound around the outer peripheral surface of the collar 24, and then the front surface of one end portion of the RFID tag 90 and the back surface of the other end portion of the RFID tag 90 are stuck to each other with the adhesive member 45, so that eventually the RFID tag 90 in the tubular shape is attached to the toner container 32.

Figure 12A:
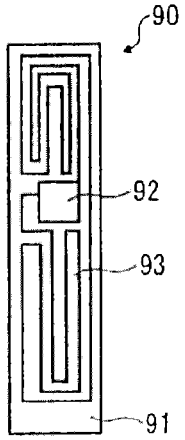
FIG. 12A is a schematic view for illustrating an example of an RFID tag.

As shown in FIG. 12A, the RFID tag 90 of the present configuration example includes a flexible electronic substrate 91, an integrated circuit (IC) chip 92 that is mounted on the electronic substrate 91 and stores therein the above-mentioned information, an antenna unit 93 that is electrically connected to the IC chip 92 and arranged on the entire circumference of the electronic substrate 91, and the like.

Figure 12B:
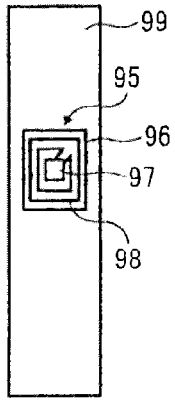
FIG. 12B is a schematic view for illustrating another example of an RFID tag.

An RFID tag configured as shown in FIG. 12B can also be used. That is, the RFID tag includes an RFID tag 95, which is formed of an electronic substrate 96 on which an IC chip 97 that stores therein information and an antenna unit 98 that is electrically connected to the IC chip 97 are mounted, and a flexible tubular-shape holding member 99 that holds the electronic substrate 96 of the RFID tag 95. With use of this RFID tag, a commonly-available IC chip can be used, resulting in reduction in costs for the RFID tag.

However, when the RFID tag as shown in FIG. 12B is used, a communication distance between the RFID tag 95 and the antenna 121 (i.e., the antenna substrate 120) of the image forming apparatus may become long when rotation of the toner container 32 for the toner supply operation is stopped, depending on an attachment position of the RFID tag to the toner container 32. If the communication distance becomes long, the RFID tag 95 and the antenna 121 (i.e., the antenna substrate 120) may not perform good communication.

In contrast, with use of the RFID tag 90 equipped with the antenna unit 93 that is arranged on the entire circumference of the electronic substrate 91, a distance between the antenna unit 93 of the RFID tag 90 that is attached to the toner container 32 and the antenna 121 (i.e., the antenna substrate 120) that is mounted on the image forming apparatus body 100 can always be maintained at a desired distance when the rotation of the toner container 32 for the toner supply operation performed by the toner supplying device 60 is stopped. Therefore, the above-mentioned problem can be prevented.

As shown in FIG. 1, the RFID tag 90 attached to the outer peripheral surface of the collar 24 is controlled not to move in a longitudinal direction of the toner container (i.e., an axial direction of the RFID tag 90 in the tubular shape) by a flange portion 23*a* that forms an edge of the opening 23 and a rib 57 that is arranged at a position where the flange portion 23*a* and the rib 57 can sandwich the RFID tag 90 in the longitudinal direction of the toner container (i.e., a position separated from the flange portion 23*a* at an interval substantially the same as a width of the RFID tag 90 in the longitudinal direction of the toner container). In other words, both edges of the RFID tag 90 in the longitudinal direction of the toner container are brought into contact with respective end walls of the flange portion 23*a* and the rib 57, so that movement of the RFID tag 90 in the longitudinal direction of the toner container can be restricted. Accordingly, a relative position of the RFID tag 90 with respect to the toner container 32 in the longitudinal direction of the toner container is fixed.

Regarding a relation between a size of each of the flange portion 23*a* and the rib 57 in a height direction (i.e., an outward direction from the outer peripheral surface of the collar 24 of the toner container 32) and a thickness of the RFID tag 90, the size of each of the flange portion 23*a* and the rib 57 in the height direction can be either larger or smaller than the thickness of the RFID tag 90 as long as the flange portion 23*a* and the rib 57 can restrict the movement of the RFID tag 90 in the longitudinal direction of the toner container. However, it is preferable to set the size of each of the flange portion 23*a* and the rib 57 in the height direction to be larger than the thickness of the RFID tag 90 because the flange portion 23*a* and the rib 57 in such sizes can more effectively prevent a situation in which the RFID tag 90 moves in the longitudinal direction of the toner container over the flange portion 23*a* and the rib 57.

Furthermore, the RFID tag in the tubular shape is attached to the outer peripheral surface of the cylindrical collar 24, so that the inner surface of the RFID tag 90 and the outer peripheral surface of the collar 24 are brought into contact with each other. Therefore, movement of the RFID tag 90 in a direction perpendicular to the longitudinal direction of the toner container (i.e., a direction perpendicular to the axial direction of the RFID tag 90 in the tubular shape) can be restricted over the entire circumference of the collar 24. Accordingly, a relative position of the RFID tag 90 with respect to the toner container 32 in the direction perpendicular to the longitudinal direction of the toner container is fixed.

In this manner, the RFID tag 90 can be attached to the toner container 32 at a fixed position without being attached to the outer peripheral surface of the toner container 32 with an adhesive or the like. Furthermore, it is possible to prevent removal of the RFID tag 90 from the toner container 32.

Figure 13:
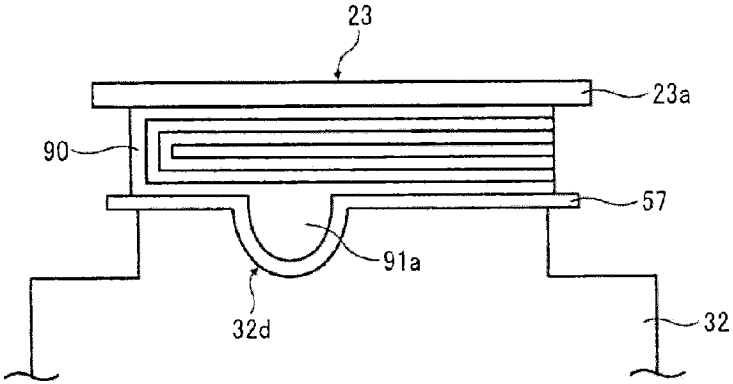
FIG. 13 is a schematic diagram for explaining a configuration to restrict rotational movement of the RFID tag in a circumferential direction with respect to the toner container.

In a second configuration example, as shown in FIG. 13, a convex portion 91*a* that is formed on one side end portion of the electronic substrate 91 of the RFID tag 90 and a concave portion 32*d* that is formed on the outer peripheral surface of the toner container 32 and configured to be engaged with the convex portion 91*a* are engaged with each other when the RFID tag 90 is attached to the outer peripheral surface of the toner container 32, so that rotational movement of the RFID tag 90 in a circumferential direction with respect to the toner container 32 can be restricted.

For example, if the RFID tag 90 is rotated in the circumferential direction with respect to the toner container 32 along with rotation of the toner container 32 while the toner supplying device supplies toner contained in the toner container 32 to the developing device, the inner surface of the RFID tag 90 and the outer peripheral surface of the toner container 32 may rub against each other along with the rotation of the RFID tag 90 in the circumferential direction with respect to the toner container 32. As a result, the inner surface of the RFID tag 90 may be damaged. If the inner surface of the RFID tag 90 is damaged, the degradation of the RFID tag 90 may be accelerated, resulting in disabling the RFID tag 90 before the end of lifetime of the toner container 32.

In the present configuration example, the convex portion 91*a* of the RFID tag 90 and the concave portion 32*d* of the toner container 32 are engaged with each other to restrict the rotation of the RFID tag 90 in the circumferential direction with respect to the toner container 32. Therefore, it is possible to prevent a situation in which the inner surface of the RFID tag 90 is damaged by rubbing of the inner surface of the RFID tag 90 and the outer peripheral surface of the toner container 32 along with the rotation of the RFID tag 90 in the circumferential direction with respect to the toner container 32.

Accordingly, when the toner container 32 is repeatedly recycled, acceleration of degradation of the RFID tag 90 can be prevented to the extent that the damage of the inner surface of the RFID tag 90 can be prevented. Therefore, it is possible to prevent a situation in which the RFID tag 90 is disabled before the end of lifetime of the toner container 32.

There can be another configuration for restricting the rotation of the RFID tag 90 in the circumferential direction with respect to the toner container 32 as described below. That is, a hole portion that is concaved from an outer side of the side wall (i.e., an outer side of the toner container 32) to an inner side of the side wall (i.e., an inner side of the toner container 32) is formed on a side wall mounted with the collar 24, and a protruded portion that is to be fitted in the hole portion is formed on an inner wall of the RFID tag 90 in the tubular shape, so that when the RFID tag 90 is attached to the collar 24 of the toner container 32, the hole portion and the protruded portion are engaged with each other to thereby restrict the rotation of the RFID tag 90 in the circumferential direction with respect to the toner container 32. With this configuration, the movement of the RFID tag 90 in the longitudinal direction of the toner container can also be restricted due to the engagement of the hole portion and the protruded portion without formation of the flange portion 23*a* and the rib 57 on the toner container 32.

Figure 14:
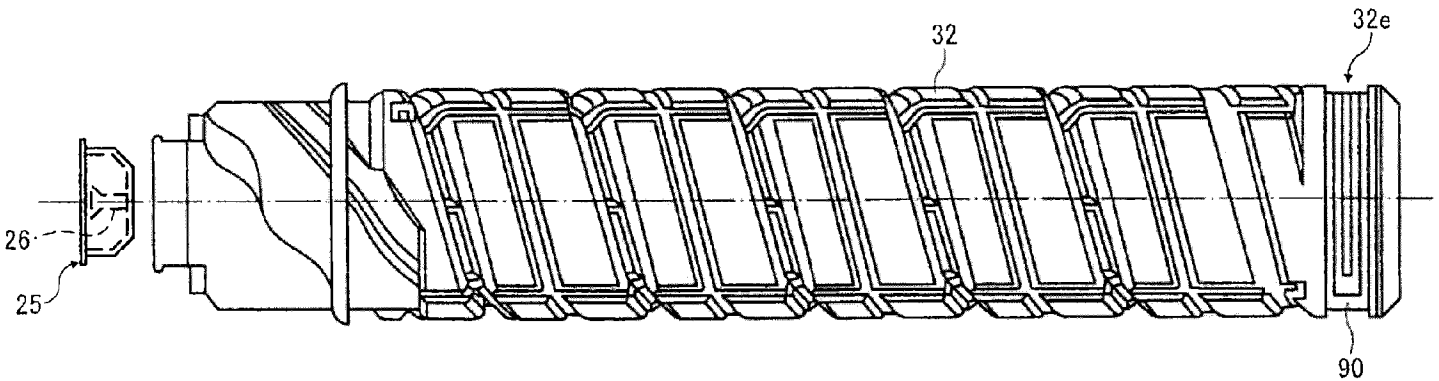
FIG. 14 is a schematic diagram of the toner container equipped with an RFID tag on a rear portion thereof.

In a third configuration example, as shown in FIG. 14, the RFID tag 90 in the tubular shape is attached to a circumferential surface of the toner container 32 near the rear portion of the toner container 32.

A groove 32*e* for mounting the RFID tag 90 in the tubular shape is formed on the entire circumference of a side wall of the toner container 32 near the rear portion of the toner container 32 in the circumferential direction and in a width substantially the same as the width of the RFID tag 90. Similarly to the first configuration example, the RFID tag 90 in the rectangular shape is wound around a bottom surface of the groove 32*e* and then a front surface of one end portion of the RFID tag 90 and a back surface of the other end portion of the RFID tag 90 are stuck to each other with an adhesive member such as a double-sided tape, so that eventually the RFID tag 90 in the tubular shape is attached to the toner container 32.

Both edges of the RFID tag 90, which is in the tubular shape and attached to the groove 32*e*, in the longitudinal direction of the toner container are respectively brought into contact with inner walls of the groove 32*e*, which face each other in the longitudinal direction of the toner container across the RFID tag 90, so that movement of the RFID tag 90 in the longitudinal direction of the toner container can be restricted. As a result, a relative position of the RFID tag 90 with respect to the toner container 32 in the longitudinal direction of the toner container is fixed. Furthermore, because the RFID tag in the tubular shape is attached to the bottom surface of the groove 32*e* that is formed on the entire circumference of the side wall of the toner container 32 in the circumferential direction, the inner surface of the RFID tag 90 and the bottom surface of the groove 32*e* are brought into contact with each other. Therefore, movement of the RFID tag 90 in a direction perpendicular to the longitudinal direction of the toner container can be restricted over the entire circumference of the groove 32*e*. Accordingly, a relative position of the RFID tag 90 with respect to the toner container 32 in the direction perpendicular to the longitudinal direction of the toner container is fixed.

In this manner, by attaching the RFID tag 90 in the tubular shape to the groove 32*e* that is formed on the side wall of the toner container 32 near the rear portion of the toner container 32, the RFID tag 90 can be attached to the toner container 32 at a fixed position without being attached to the outer peripheral surface of the toner container 32 with an adhesive or the like. Furthermore, it is possible to prevent removal of the RFID tag 90 from the toner container 32.

Figure 15A:
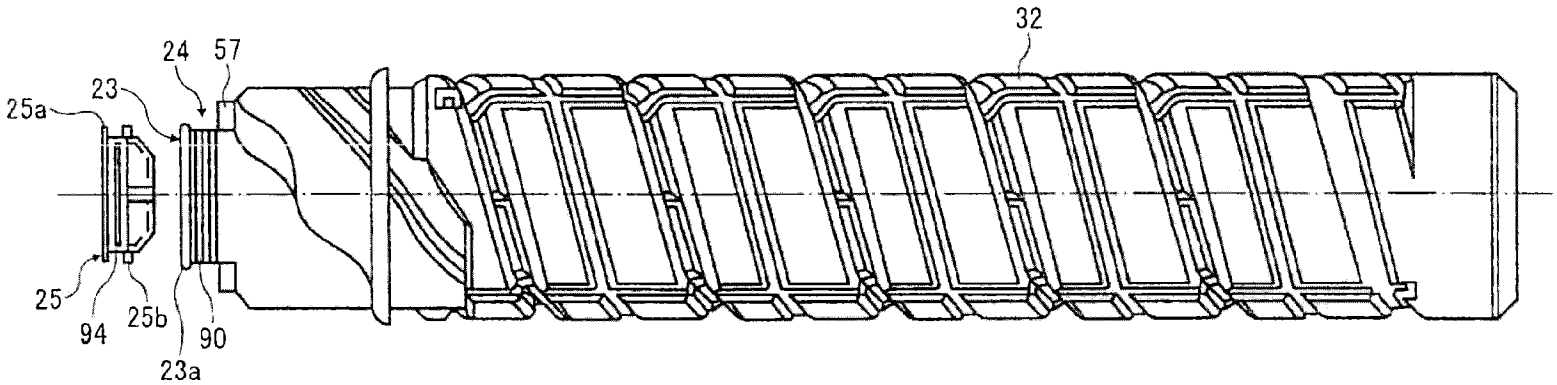
FIG. 15A is an external view of the toner container and a plug of the toner container, each being equipped with an RFID tag.
Figure 15B:
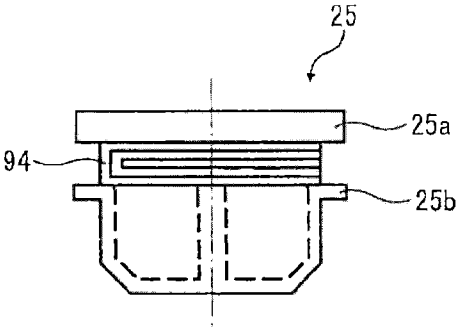
FIG. 15B is a schematic diagram of the plug equipped with the RFID tag.

In a fourth configuration example, as shown in FIGS. 15A and 15B, an RFID tag 94 that prestores therein various information related to the plug 25, such as recycling frequency of the plug 25 and information related to the toner container 32 paired with the plug 25, is attached to the plug 25 that is to be put on the opening 23 of the toner container 32. A configuration of the RFID tag 94 can be the same as the RFID tag 90 attached to the toner container 32 in the first configuration example, and therefore, explanation thereof will be omitted.

The plug 25 is recycled along with recycling of the toner container 32. However, if the repeatedly-recycled plug 25 is continuously used over time, the plug 25 may be deformed or damaged. Therefore, it is preferable to perform quality control of a recycled product of the plug 25 by, for example, checking whether the plug 25 has been recycled a preset predetermined maximum number of times in a recycling factory or the like for the plug 25 that has been collected together with the used toner container 32 from a user. However, if the RFID tag 94 is attached to the plug 25 with an adhesive or the like, the RFID tag 94 may be removed from the plug 25 during various processing in the recycling factory, such as cleaning of the plug 25 for recycling, so that the various information related to the plug 25, such as recycling frequency of the plug 25, may be lost.

In the present configuration example, as shown in FIG. 15B, the RFID tag 94 in a tubular shape and formed of a flexible electronic substrate is attached so as to surround an outer peripheral surface of the plug 25. The RFID tag 94 is controlled not to move in an axial direction of the plug 25 (i.e., the same direction as the longitudinal direction of the toner container when the plug 25 is put on the opening 23 of the toner container 32) by a flange portion 25*a* of the plug 25 and a rib 25*b* that is arranged at a position where the flange portion 25*a* and the rib 25*b* can sandwich the RFID tag 94 in the axial direction of the plug 25. In other words, both edges of the RFID tag 94 in the axial direction of the plug are brought into contact with respective end walls of the flange portion 25*a* and the rib 25*b*, so that movement of the RFID tag 94 in the axial direction of the plug can be restricted. Accordingly, a relative position of the RFID tag 94 with respect to the plug 25 in the axial direction of the plug is fixed.

Furthermore, the RFID tag 94 in the tubular shape is attached to the entire circumference of the outer peripheral surface of the plug 25 in the circumferential direction, so that the inner surface of the RFID tag 94 and the outer peripheral surface of the plug 25 are brought into contact with each other. Therefore, movement of the RFID tag 94 in a direction perpendicular to the axial direction of the plug can be restricted over the entire circumference of the outer peripheral surface of the plug 25 in the circumferential direction. Accordingly, a relative position of the RFID tag 94 with respect to the plug 25 in the direction perpendicular to the axial direction of the plug is fixed.

In the present configuration example, a front surface of one end portion of the rectangular RFID tag 94 and a back surface of the other end portion of the RFID tag 94 are stuck to each other with an adhesive member such as a double-sided tape, so that the RFID tag 94 is eventually formed into a tubular shape. When the RFID tag 94 is to be attached to the plug 25, the RFID tag 94 in the rectangular shape is wound around the outer peripheral surface of the plug 25, and then the front surface of one end portion of the RFID tag 94 and the back surface of the other end portion of the RFID tag 94 are stuck to each other with the adhesive member, so that eventually the RFID tag 94 in the tubular shape is attached to the plug 25.

In this manner, the RFID tag 94 can be attached to the plug 25 at a fixed position without being attached to the outer peripheral surface of the plug 25 with an adhesive or the like. Furthermore, it is possible to prevent removal of the RFID tag 94 from the plug 25.

The RFID tag 94 can be attached to the following positions on the outer peripheral surface of the plug 25: a position to be located within the toner container 32 and to be opposite an inner peripheral surface of the collar 24 of the toner container 32 when the plug 25 is put on the opening 23 of the toner container 32 to seal the opening 23; and a position to be located out of the toner container 32 when the plug 25 is put on the opening 23 of the toner container 32 to seal the opening 23. In other words, the RFID tag 94 can be attached to arbitrary positions depending on the shape of the toner container 32, the configuration of the toner supplying device, and the like as long as the RFID tag 94 does not disturb putting on and removal of the plug 25 with respect to the opening 23 and leakage of toner contained in the toner container 32 from the opening 23 can be prevented when the opening 23 is sealed by the plug 25.

For example, in a configuration where the RFID tag 94 is attached to the outer peripheral surface of the plug 25 at a position that is to be located within the toner container 32 and to be opposite the inner peripheral surface of the collar 24 of the toner container 32 when the plug 25 is put on the opening 23 of the toner container 32 to seal the opening 23, it is preferable to bring an edge portion of the rib 25*b*, which is formed on the plug 25 for restricting the movement of the RFID tag 94 in the axial direction of the plug, with the inner peripheral surface of the collar 24 so that a relative position of the plug 25 with respect to the toner container 32 can be maintained so that the opening 23 can be sealed by a frictional force generated by the contact. It is also preferable to use the RFID tag 94 having a thickness smaller than a size of the rib 25*b* in a height direction. With this configuration, it is possible to prevent damage of the RFID tag 94 caused by a rub between the surface of the RFID tag 94 attached to the outer peripheral surface of the plug 25 and the inner peripheral surface of the collar 24 of the toner container 32 when the plug 25 is put on or removed from the opening 23. It is also possible to prevent disturbance of operation for putting or removing the plug 25 on or from the opening 23 and leakage of toner from the opening 23.

According to the present configuration example, it is possible to prevent removal of the RFID tag 94 from the plug 25, so that removal of the RFID tag 94 from the plug 25 during various processing such as cleaning of the plug 25 for recycling can be prevented, resulting in preventing missing of the various information related to the plug 25, such as recycling frequency of the plug 25. Thus, the quality control of the recycled product of the plug 25 can be performed in a preferable manner.

A second embodiment of a copier as the image forming apparatus according to the present invention is described below. A configuration of the copier of the present embodiment is basically the same as the copier of the first embodiment except for the toner supplying device 60 and the toner container 32 of the first embodiment (in the second embodiment, a toner supplying device 260 and a toner container 232 are employed as will be described later), and therefore, explanation about the same configuration as the copier of the first embodiment will be omitted.

Toner supplying devices 260Y, 260M, 260C, and 260K according to the present embodiment are described below. Configurations of the four toner supplying devices 260Y, 260M, 260C, and 260K are substantially the same with each other except for color of toner to be used in an image forming process. Similarly, configurations of four toner containers 232Y, 232M, 232C, and 232K are substantially the same with each other except for color of toner to be used in the image forming process. Therefore, only the toner supplying device 260Y and the toner container 232Y for yellow will be described in detail below and the explanation of the other toner supplying devices 260M, 260C, and 260K and the toner containers 232M, 232C, and 232K for the other three colors will be omitted as appropriate.

Figure 16:
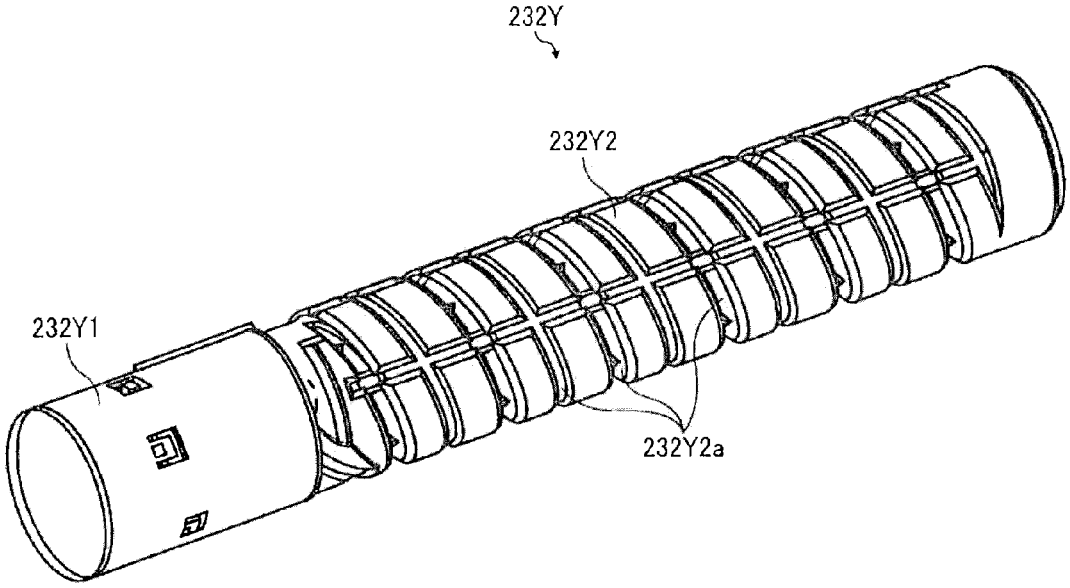
FIG. 16 is a perspective view of a toner container according to a second embodiment of the present invention.
Figure 17:
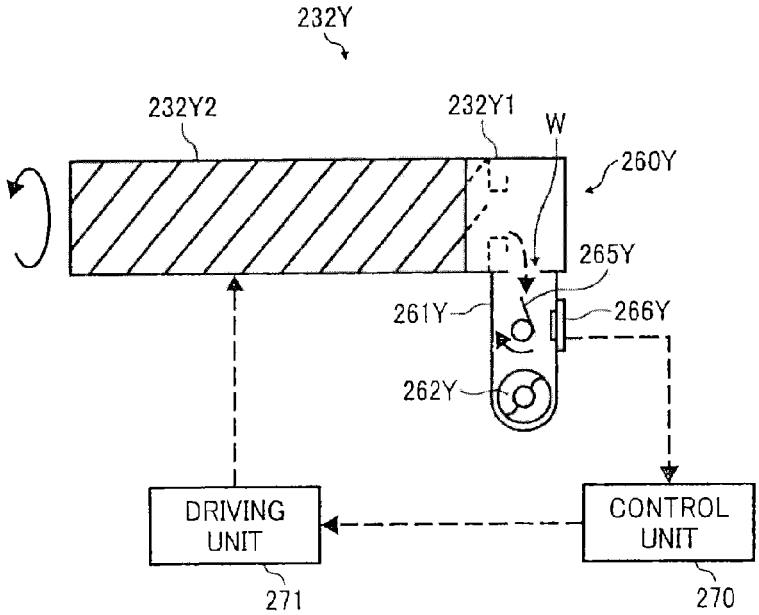
FIG. 17 is a schematic diagram of the toner container mounted on a toner supplying device.

When the toner container 232Y that includes a container body 232Y2 and a cap portion 232Y1 as shown in FIG. 16 is housed in the toner-container housing unit 31 of the image forming apparatus body 100 and then mounted on the toner supplying device 260Y, a shutter member (not shown) of the toner container 232Y moves along with the above-mentioned mounting operation, so that a toner outlet W is opened as shown in FIG. 17. Accordingly, toner contained in the toner container 232Y is discharged from the toner outlet W and collected in a toner tank unit 261Y of the toner supplying device 260Y.

Figure 18:
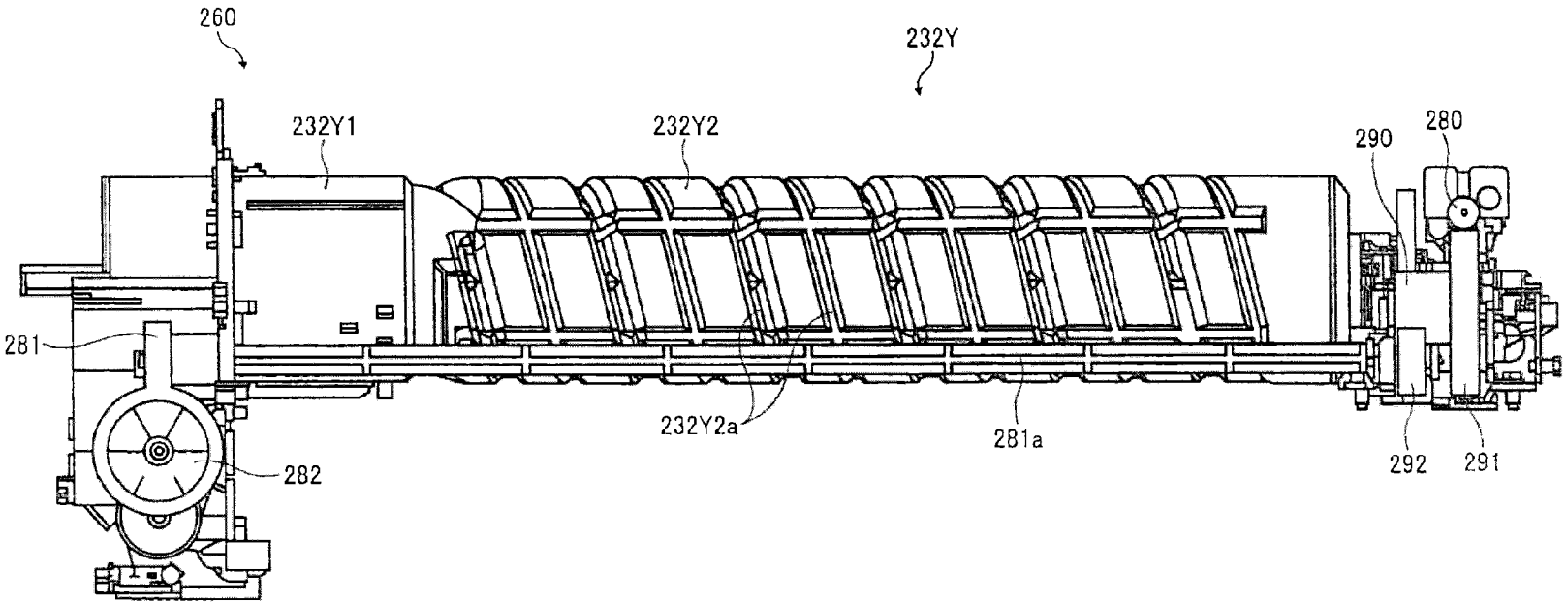
FIG. 18 is a side view of the toner supplying device.

As shown in FIG. 17, the toner container 232Y is formed into a substantially cylindrical shape, and includes a spiral protrusion 232Y2*a* on an inner peripheral surface thereof (i.e., a spiral groove 232Y2*a* when vied from an outer peripheral surface thereof). A spiral protrusion 232Y2*a* is provided for discharging toner from the toner outlet W when a driving unit 271 (including a drive motor 280, a drive coupling 290, a gear 291, and the like as shown in FIG. 18) rotates the toner container 232Y in a direction indicated by an arrow in FIG. 17. In other words, the toner can appropriately be supplied to the toner tank unit 261Y along with appropriate rotation of the container body 232Y2 of the toner container 232Y by the driving unit 271. Each of the toner containers 232Y, 232M, 232C, and 232K is replaced with new one at the end of each lifetime (i.e., when each of the toner containers 232Y, 232M, 232C, and 232K becomes empty as a result of consumption of all toner contained therein).

The toner tank unit 261Y is located below the toner outlet W of the cap portion 232Y1 of the toner container 232Y so that toner discharged from the toner outlet W of the toner container 232Y can be collected therein. A bottom portion of the toner tank unit 261Y is connected to an upstream portion of a toner conveying unit 262Y.

A toner end sensor 266Y for detecting that an amount of toner collected in the toner tank unit 261Y becomes equal to or smaller than a predetermined amount is mounted on a wall surface of the toner tank unit 261Y (at a position in a predetermined height from the bottom portion of the toner tank unit 261Y). The toner end sensor 266Y can be a piezoelectric sensor or the like. As shown in FIG. 17, when a control unit 270 detects that the toner end sensor 266Y has detected that the amount of toner collected in the toner tank unit 261Y becomes equal to or smaller than the predetermined amount (i.e., toner end detection), the control unit 270 controls the driving unit 271 to rotate the toner container 232Y for a predetermined time to supply toner to the toner tank unit 261Y. When the toner end detection by the toner end sensor 266Y is not relieved even after the above control is repeated, the control unit 270 determines that no toner is contained in the toner container 232Y and displays an instruction to replace the toner container 232Y with a new one on a display unit (not shown) of the image forming apparatus body 100.

A stirring member 265Y that prevents aggregation of toner collected in the toner tank unit 261Y is arranged in the center of the toner tank unit 261Y (near the toner end sensor 266Y). The stirring member 265Y is formed by mounting a flexible member on a shaft portion thereof. The stirring member 265Y stirs the toner in the toner tank unit 261Y when rotated clockwise in FIG. 17.

The toner collected in the toner tank unit 261Y is conveyed by the toner conveying unit 262Y so that the toner can eventually be supplied to the developing device 5Y.

As shown in FIG. 18, the drive coupling 290 that is to be engaged with an engaging portion (not shown) formed on a rear portion of the toner container 232Y is mounted on a rear side of each of the toner supplying devices 260Y, 260M, 260C, and 260K (i.e., a rear side in a direction for mounting and removing the toner container 232Y). Driving force of the drive motor 280 is transmitted to the drive coupling 290 via the two-stage gear 291, so that the drive coupling 290 drives the container body 232Y2 of the toner container 232Y to rotate in a predetermined direction.

A gear 292 that is engaged with the gear 291 transmits the driving force to a helical gear 281 that is mounted on a front side of the toner supplying device 260Y (i.e., a front side in a direction for mounting and removing the toner container 232Y) via a driving-force transmission shaft 281*a*. The toner conveying unit 262Y and the stirring member 265Y are rotated by the driving force transmitted to the helical gear 281 mounted on the front side via a gear 282.

Figure 19:
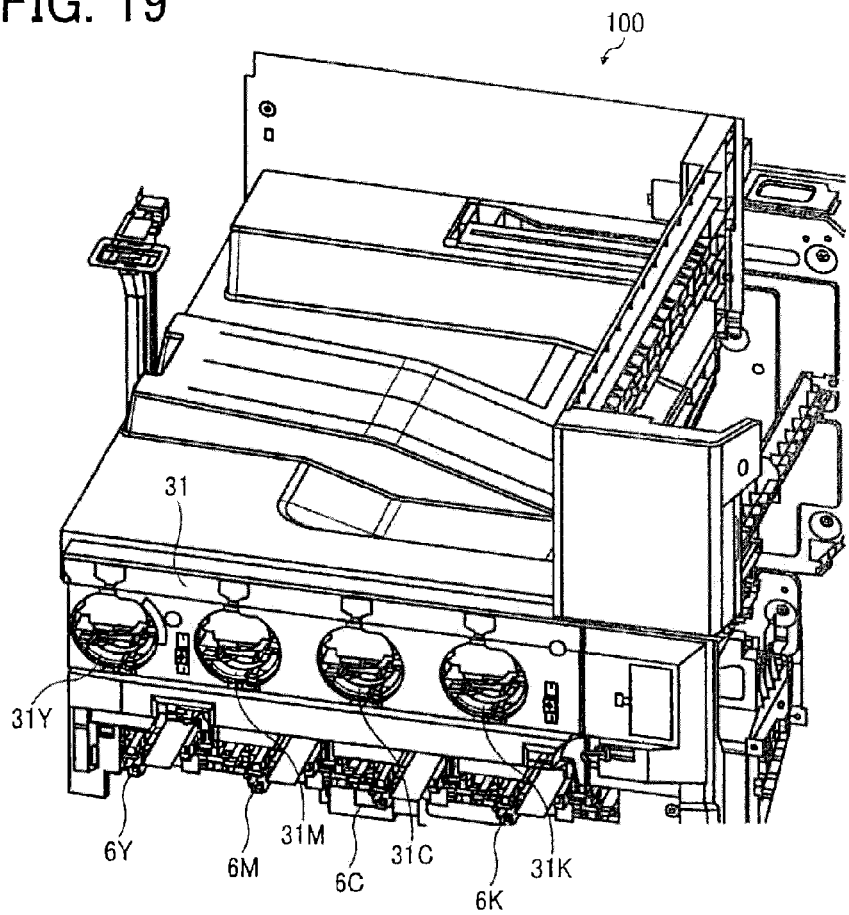
FIG. 19 is a perspective view of components located near a toner-container housing unit of a copier body.
Figure 20:
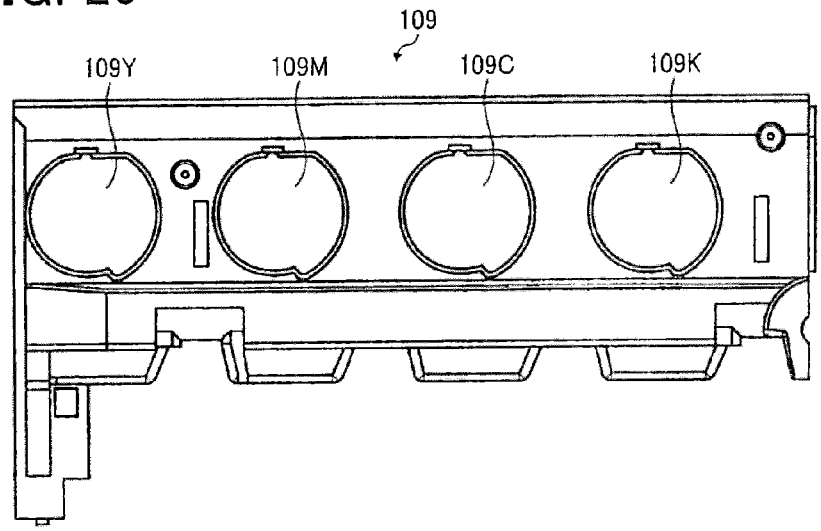
FIG. 20 is an elevational view of a cover that covers the toner-container housing unit.

As shown in FIG. 19, when a body cover (not shown) mounted on the front side of the image forming apparatus body 100 is opened, toner-container housing units 31Y, 31M, 31C, and 31K (i.e., the toner-container housing unit 31) are exposed. More specifically, as shown in FIG. 20, when the body cover of the image forming apparatus body 100 is opened, an inner cover 109 equipped with four insertion openings 109Y, 109M, 109C, and 109K is exposed. In this state, operation for mounting or removing each of the toner containers 232Y, 232M, 232C, and 232K is performed from the front side of the image forming apparatus body 100 (mounting-removal operation is performed in the same direction as the longitudinal direction of the toner container).

The cap portion 232Y1 is fixedly mounted on the toner supplying device 260Y (i.e., the image forming apparatus body 100) when mounted on the toner supplying device 260Y (i.e., the image forming apparatus body 100). In other words, after completely mounted on the toner supplying device 260Y, the cap portion 232Y1 does not rotate, so that only the container body 232Y2 that is rotatably mounted with respect to the cap portion 232Y1 is rotatable.

Salient features of the present embodiment will be described in detail below.

Figure 21:
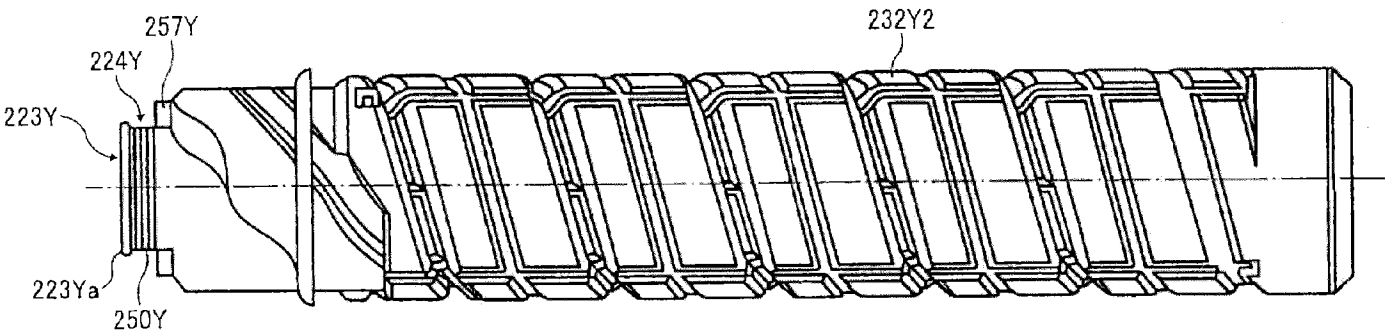
FIG. 21 is a schematic diagram of a container body equipped with an RFID tag.

In the present embodiment, as shown in FIG. 21, an RFID tag 250Y in a tubular shape and formed of a flexible electronic substrate is attached so as to surround an outer peripheral surface of a collar 224Y of the container body 232Y2 of the toner container 232Y. The RFID tag 250Y stores therein information related to toner, such as color of the toner, an amount of the toner, a manufacturing number of the toner (i.e., a manufacturing lot), and a manufacturing date of the toner, and information related to recycling of the toner container 232, such as recycling frequency, date of recycling, and recycling manufacturer.

A configuration of the RFID tag 250Y of the present embodiment can be the same as that of the RFID tag 90 of the first embodiment, and therefore, explanation thereof is omitted.

The RFID tag 250Y attached to the outer peripheral surface of the collar 224Y is controlled not to move in a longitudinal direction of the toner container by a flange portion 223Ya that forms an edge of an opening 223Y and a rib 257Y that is arranged at a position where the flange portion 223Ya and the rib 257Y can sandwich the RFID tag 250Y in the longitudinal direction of the toner container (i.e., a position separated from the flange portion 223Ya at an interval substantially the same as a width of the RFID tag 250Y in the longitudinal direction of the toner container). In other words, both edges of the RFID tag 250Y in the longitudinal direction of the toner container are brought into contact with respective end walls of the flange portion 223Ya and the rib 257Y, so that movement of the RFID tag 250Y in the longitudinal direction of the toner container can be restricted. Accordingly, a relative position of the RFID tag 250Y with respect to the container body 232Y2 in the longitudinal direction of the toner container is fixed.

Regarding a relation between a size of each of the flange portion 223Ya and the rib 257Y in a height direction (i.e., an outward direction from the outer peripheral surface of the collar 224Y of the container body 232Y2) and a thickness of the RFID tag 250Y, the size of each of the flange portion 223Ya and the rib 257Y in the height direction can be either larger or smaller than the thickness of the RFID tag 250Y as long as the flange portion 223Ya and the rib 257Y can restrict the movement of the RFID tag 250Y in the longitudinal direction of the toner container. However, it is preferable to set the size of each of the flange portion 223Ya and the rib 257Y in the height direction to be larger than the thickness of the RFID tag 250Y because the flange portion 223Ya and the rib 257Y in such sizes can more effectively prevent a situation in which the RFID tag 250Y moves in the longitudinal direction of the toner container over the flange portion 223Ya and the rib 257Y.

Furthermore, the RFID tag in the tubular shape is attached to the outer peripheral surface of the collar 224Y that is in a cylindrical shape, so that the inner surface of the RFID tag 250Y and the outer peripheral surface of the collar 224Y are brought into contact with each other. Therefore, movement of the RFID tag 250Y in a direction perpendicular to the longitudinal direction of the toner container can be restricted over the entire circumference of the collar 224Y. Accordingly, a relative position of the RFID tag 250Y with respect to the container body 232Y2 in the direction perpendicular to the longitudinal direction of the toner container is fixed.

In this manner, the RFID tag 250Y can be attached to the container body 232Y2 at a fixed position without being attached to the outer peripheral surface of the container body 232Y2 with an adhesive or the like. Furthermore, it is possible to prevent removal of the RFID tag 250Y from the container body 232Y2.

Moreover, as can be seen from FIGS. 16 and 17, when the RFID tag 250Y is attached to the collar 224Y of the container body 232Y2 and then the cap portion 232Y1 is put on the container body 232Y2, the cap member 232Y1 covers the RFID tag 250Y. Therefore, it is possible to prevent a situation in which the RFID tag 250Y is cut off or broken because of impact or scratch externally applied thereto.

Figure 22:
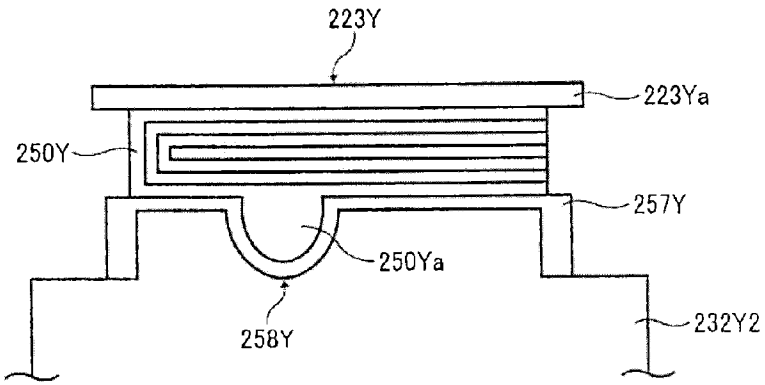
FIG. 22 is a schematic diagram for explaining a configuration to restrict rotational movement of the RFID tag in a circumferential direction with respect to the container body.

In a sixth configuration example, as shown in FIG. 22, a convex portion 250Ya that is formed on one side end portion of the RFID tag 250Y and a concave portion 258Y that is formed on the outer peripheral surface of the container body 232Y2 are configured to be engaged with each other when the RFID tag 250Y is attached to the outer peripheral surface of the container body 232Y2, so that rotational movement of the RFID tag 250Y in a circumferential direction with respect to the container body 232Y2 can be restricted.

For example, if the RFID tag 250Y is rotated in the circumferential direction with respect to the container body 232Y2 along with rotation of the container body 232Y2 while the toner supplying device 260 supplies toner contained in the container body 232Y2 to the developing device, the inner surface of the RFID tag 250Y and the outer peripheral surface of the container body 232Y2 may rub against each other along with the rotation of the RFID tag 250Y in the circumferential direction with respect to the container body 232Y2. As a result, the inner surface of the RFID tag 250Y may be damaged. If the inner surface of the RFID tag 250Y is damaged, the degradation of the RFID tag 250Y may be accelerated, resulting in disabling the RFID tag 250Y before the end of lifetime of the container body 232Y2.

In the present configuration example, the convex portion 250Ya of the RFID tag 250Y and the concave portion 258Y of the container body 232Y2 are engaged with each other to restrict the rotation of the RFID tag 250Y in the circumferential direction with respect to the container body 232Y2. Therefore, it is possible to prevent a situation in which the inner surface of the RFID tag 250Y is damaged by rubbing of the inner surface of the RFID tag 250Y and the outer peripheral surface of the container body 232Y2 along with the rotation of the RFID tag 250Y in the circumferential direction with respect to the container body 232Y2.

Accordingly, when the container body 232Y2 is repeatedly recycled, acceleration of degradation of the RFID tag 250Y can be prevented to the extent that the damage of the inner surface of the RFID tag 250Y can be prevented. Therefore, it is possible to prevent a situation in which the RFID tag 250Y is disabled before the end of lifetime of the container body 232Y2.

There can be another configuration for restricting the rotation of the RFID tag 250Y in the circumferential direction with respect to the container body 232Y2 as described below. That is, a hole portion that is concaved from an outer side of the side wall (i.e., an outer side of the container body 232Y2) to an inner side of the side wall (i.e., an inner side of the container body 232Y2) is formed on a side wall mounted with the collar 224Y, and a protruded portion that is to be fitted in the hole portion is formed on an inner wall of the RFID tag 250Y in the tubular shape, so that when the RFID tag 250Y is attached to the collar 224Y of the container body 232Y2, the hole portion and the protruded portion can be engaged with each other to thereby restrict the rotation of the RFID tag 250Y in the circumferential direction with respect to the container body 232Y2. With this configuration, the movement of the RFID tag 250Y in the longitudinal direction of the toner container can also be restricted due to the engagement of the hole portion and the protruded portion without formation of the flange portion 223Ya and the rib 257Y on the container body 232Y2.

Figure 23:
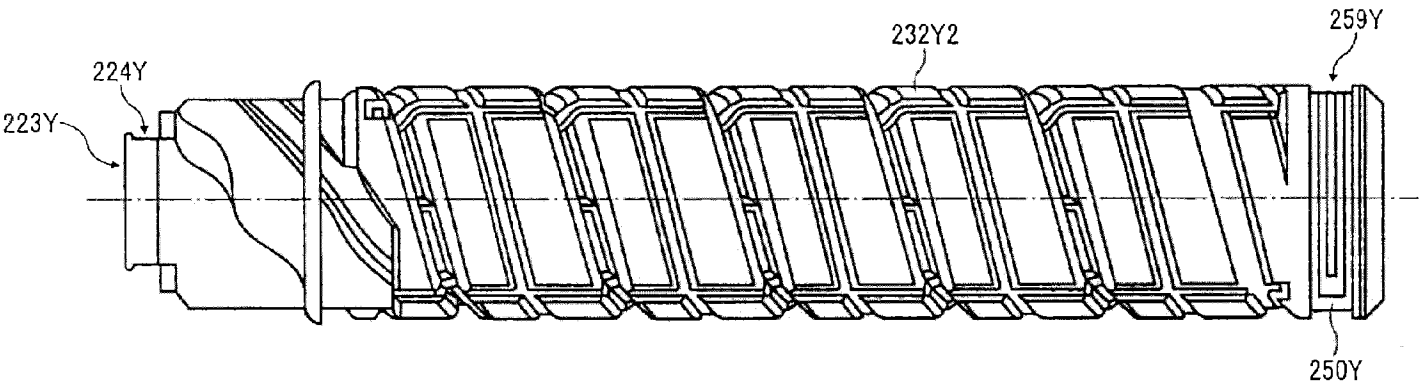
FIG. 23 is a schematic diagram of the toner container equipped with an RFID tag on a rear portion thereof.

In a seventh configuration example, as shown in FIG. 23, the RFID tag 250Y in the tubular shape is attached to a circumferential surface of the container body 232Y2 near the rear portion of the container body 232Y2.

A groove 259Y for mounting the RFID tag 250Y in the tabular shape is formed on the entire circumference of a side wall of the container body 232Y2 near the rear portion of the container body 232Y2 in the circumferential direction, and a width of the groove 259Y is substantially the same as the width of the RFID tag 250Y. Similarly to the fifth configuration example, the RFID tag 250Y in the rectangular shape is wound around a bottom surface of the groove 259Y and then a front surface of one end portion of the RFID tag 250Y and a back surface of the other end portion of the RFID tag 250Y are stuck to each other with an adhesive member such as a double-sided tape, so that eventually the RFID tag 250Y in the tubular shape is attached to the container body 232Y2.

Both edges of the RFID tag 250Y, which is in the tubular shape and attached to the groove 259Y, in the longitudinal direction of the toner container are respectively brought into contact with inner walls of the groove 259Y, which face each other in the longitudinal direction of the toner container across the RFID tag 250Y, so that movement of the RFID tag 250Y in the longitudinal direction of the toner container can be restricted. As a result, a relative position of the RFID tag 250Y with respect to the container body 232Y2 in the longitudinal direction of the toner container is fixed. Furthermore, because the RFID tag 250Y in the tubular shape is attached to the entire circumference of the bottom surface of the groove 259Y that is formed on the side wall of the container body 232Y2 in the circumferential direction, the inner surface of the RFID tag 250Y and the bottom surface of the groove 259Y are brought into contact with each other. Therefore, movement of the RFID tag 250Y in a direction perpendicular to the longitudinal direction of the toner container can be restricted over the entire circumference of the groove 259Y. Accordingly, a relative position of the RFID tag 250Y with respect to the container body 232Y2 in the direction perpendicular to the longitudinal direction of the toner container is fixed.

In this manner, by attaching the RFID tag 250Y in the tubular shape to the groove 259Y that is formed on the side wall of the container body 232Y2 near the rear portion of the container body 232Y2, the RFID tag 250Y can be attached to the container body 232Y2 at a fixed position without being attached to the outer peripheral surface of the container body 232Y2 with an adhesive or the like. Furthermore, it is possible to prevent removal of the RFID tag 250Y from the container body 232Y2.

Figure 24:
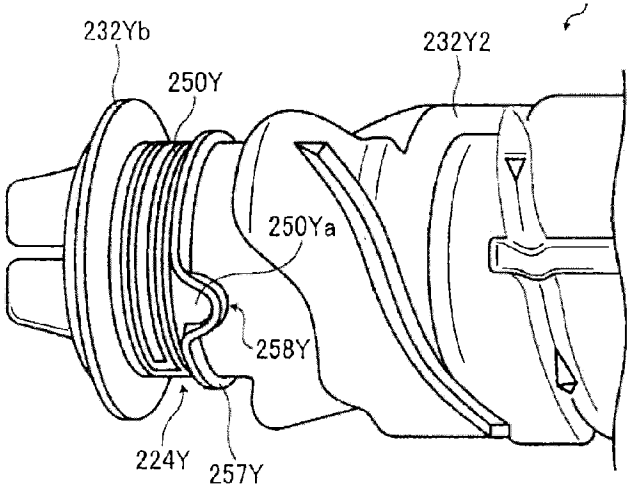
FIG. 24 is a schematic diagram of the container body equipped with the RFID tag.

In an eighth configuration example, as shown in FIG. 24 and similarly to the fifth configuration example, the RFID tag 250Y in the tubular shape and formed of a flexible electronic substrate is attached so as to surround the outer peripheral surface of the collar 224Y of the container body 232Y2 of the toner container 232Y.

The RFID tag 250Y attached to the outer peripheral surface of the collar 224Y is controlled not to move in the longitudinal direction of the toner container by the flange portion 223Yb that forms an edge of the opening 223Y and the rib 257Y that is arranged at a position where the flange portion 223Yb and the rib 257Y can sandwich the RFID tag 250Y in the longitudinal direction of the toner container (i.e., a position separated from the flange portion 223Yb at an interval substantially the same as a width of the RFID tag 250Y in the longitudinal direction of the toner container). In other words, both ends of the RFID tag 250Y in the longitudinal direction of the toner container are brought into contact with respective end walls of the flange portion 223Yb and the rib 257Y, so that movement of the RFID tag 250Y in the longitudinal direction of the toner container can be restricted. Accordingly, a relative position of the RFID tag 250Y with respect to the container body 232Y2 in the longitudinal direction of the toner container is fixed.

Furthermore, the RFID tag 250Y in the tubular shape is attached to the outer peripheral surface of the collar 224Y that is in a cylindrical shape, so that the inner surface of the RFID tag 250Y and the outer peripheral surface of the collar 224Y are brought into contact with each other. Therefore, movement of the RFID tag 250Y in a direction perpendicular to the longitudinal direction of the toner container can be restricted over the entire circumference of the collar 224Y. Accordingly, a relative position of the RFID tag 250Y with respect to the container body 232Y2 in the direction perpendicular to the longitudinal direction of the toner container is fixed.

In this manner, the RFID tag 250Y can be attached to the container body 232Y2 at a fixed position without being attached to the outer peripheral surface of the container body 232Y2 with an adhesive or the like. Furthermore, it is possible to prevent removal of the RFID tag 250Y from the container body 232Y2.

Furthermore, in the present configuration example, as shown in FIG. 24, the convex portion 250Ya that is formed on one side end portion of the RFID tag 250Y and the concave portion 258Y that is formed on the outer peripheral surface of the container body 232Y2 and configured to be engaged with the convex portion 250Ya are engaged with each other when the RFID tag 250Y is attached to the outer peripheral surface of the container body 232Y2, so that rotational movement of the RFID tag 250Y in a circumferential direction with respect to the container body 232Y2 can be restricted. Therefore, it is possible to prevent a situation in which the inner surface of the RFID tag 250Y is damaged by rubbing of the inner surface of the RFID tag 250Y and the outer peripheral surface of the container body 232Y2 along with the rotation of the RFID tag 250Y in the circumferential direction with respect to the container body 232Y2.

Accordingly, when the container body 232Y2 is repeatedly recycled, acceleration of degradation of the RFID tag 250Y can be prevented to the extent that the damage of the inner surface of the RFID tag 250Y can be prevented. Therefore, it is possible to prevent a situation in which the RFID tag 250Y is disabled before the end of lifetime of the container body 232Y2.

Figure 25:
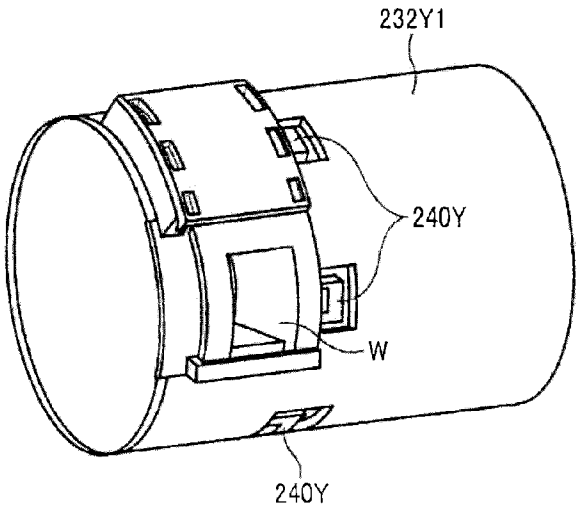
FIG. 25 is a perspective view of a cap member.
Figure 26:
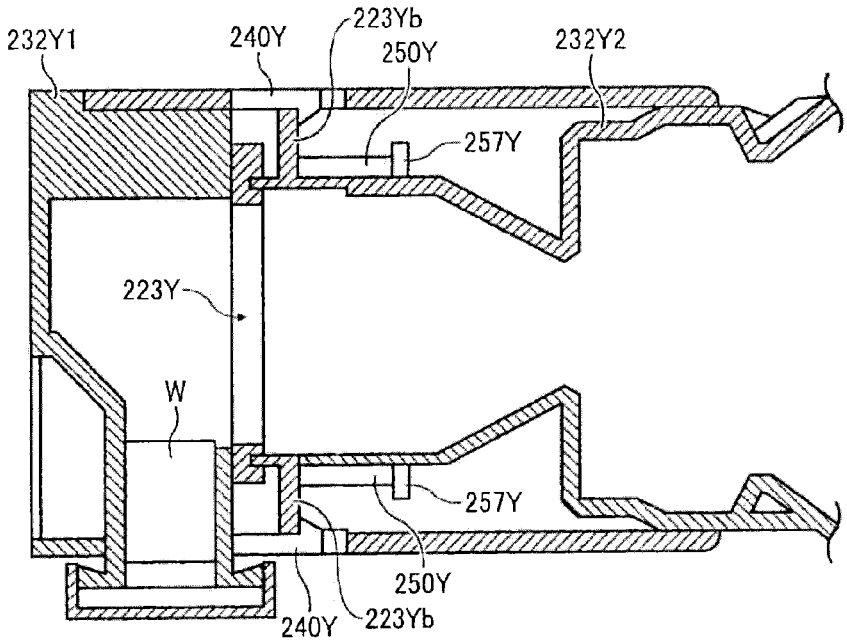
FIG. 26 is a cross-sectional view of the toner container.

In the eighth configuration example, when the cap portion 232Y1 is put on the container body 232Y2, engaging portions 240Y formed on the cap portion 232Y1 as shown in FIG. 25 are engaged with a flange portion 223Yb formed on the container body 232Y2 as shown in FIG. 24 in such a manner that the engaging portions 240Y are hooked on an end wall of the flange portion 223Yb on a rear side of the flange portion 223Yb in the longitudinal direction of the container body as shown in FIG. 26. Furthermore, the container body 232Y2 is rotatably supported by the cap member 232Y1 in a state where the engaging portions 240Y are engaged with the flange portion 223Yb with respect to the cap member 232Y1.

When the cap portion 232Y1 is put on the container body 232Y2 and the engaging portions 240Y are engaged with the flange portion 223Yb, an amount of engagement between the engaging portions 240Y and the flange portion 223Yb becomes sufficiently large. Therefore, even when a user attempts to remove the cap portion 232Y1 from the container body 232Y2 by pulling the container body 232Y2 or the cap portion 232Y1 in the longitudinal direction of the toner container, the cap portion 232Y1 cannot be easily removed from the container body 232Y2. Therefore, it is possible to prevent a situation in which the cap portion 232Y1 is removed from the container body 232Y2 and toner contained in the container body 232Y2 is dispersed on a floor because of user's careless operation or the like.

Furthermore, as shown in FIG. 26, when the cap portion 232Y1 is put on the container body 232Y2, the cap member 232Y1 covers the RFID tag 250Y attached to the container body 232Y2. Therefore, it is possible to prevent a situation in which the RFID tag 250Y is cut off or broken because of impact or scratch externally applied thereto.

In recent years, in view of environmental preservation, the toner container 232Y that has become empty because of use over time is collected from a user, and then subjected to predetermined recycling processing, such as cleaning or supplying of toner, so that the toner container 232Y can be reused as a recycled product. When the cap portion 232Y1 is being put on the container body 232Y2 while the predetermined recycling processing is performed on the toner container 232Y, cleaning of insides of the container body 232Y2 and the cap portion 232Y1 may not be performed in a desired manner or toner may not be supplied to the container body 232Y2 in a desired manner, resulting in degradation of performance of the predetermined recycling processing.

In the toner container 232Y of the present configuration example, the cap portion 232Y1 can be removed from the container body 232Y2 by relieving the engagement between the container body 232Y2 and the cap portion 232Y1 in such a manner that the engaging portions 240Y are elastically deformed in an outward direction of the cap portion 232Y1 to the extent that the engaging portions 240Y are not broken by using a tool such as a small slotted screwdriver. Accordingly, when the predetermined recycling processing is performed on the toner container 232Y, the cap portion 232Y1 can be removed from the toner container 232Y by relieving the engagement between the engaging portions 240Y and the flange portion 223Yb. Therefore, cleaning of the insides of the container body 232Y2 and the cap portion 232Y1 can be performed easily, and toner can be easily supplied to the container body 232Y2, resulting in improvement of performance of the predetermined recycling processing.

Furthermore, in the present configuration example, as shown in FIG. 26, the RFID tag 250Y and the opening 223Y face each other across the flange portion 223Yb. With this configuration, the flange portion 223Yb functions as a wall to prevent dispersion of toner toward the RFID tag 250Y when the toner is discharged from the opening 223Y. As a result, it is possible to prevent a situation in which communication sensitivity of the RFID tag 250Y is degraded because of the toner attached to the RFID tag 250Y.

Figure 27:
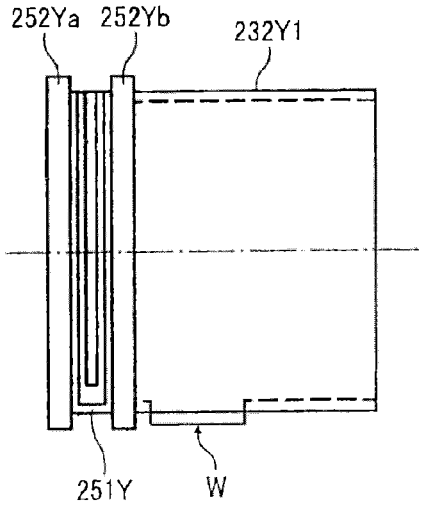
FIG. 27 is a schematic diagram of a cap portion equipped with an RFID tag.

In a ninth configuration example, as shown in FIG. 27, an RFID tag 251Y that prestores therein various information related to the cap portion 232Y1, such as recycling frequency of the cap portion 232Y1 and information related to the container body 232Y2 paired with the cap portion 232Y1, is attached to the cap portion 232Y1 of the toner container 232Y. A configuration of the RFID tag 251Y can be the same as the RFID tag 250Y attached to the container body 232Y2 in the fifth configuration example, and therefore, explanation thereof is omitted.

The cap portion 232Y1 is recycled along with recycling of the container body 232Y2. However, if the repeatedly-recycled cap portion 232Y1 is continuously used over time, the cap portion 232Y1 may be deformed or damaged. Therefore, it is preferable to perform quality control of a recycled product of the cap portion 232Y1 by, for example, checking whether the cap portion 232Y1 has been recycled a preset predetermined maximum number of times in a recycling factory or the like for the cap portion 232Y1 that has been collected together with the used container body 232Y2 from a user. However, if the RFID tag 251Y is attached to the cap portion 232Y1 with an adhesive or the like, the RFID tag 251Y may be removed from the cap portion 232Y1 during various processing in the recycling factory, such as cleaning of the cap portion 232Y1 for recycling, so that the various information related to the cap portion 232Y1, such as recycling frequency of the cap portion 232Y1, may be lost.

In the present configuration example, the RFID tag 251Y in a tubular shape and formed of a flexible electronic substrate is attached so as to surround the outer peripheral surface of the cap portion 232Y1. In the present configuration example, a front surface of one end portion of the RFID tag 251Y in a rectangular shape and a back surface of the other end portion of the RFID tag 251Y are stuck to each other with an adhesive member such as a double-sided tape, so that the RFID tag 251Y is eventually formed into the tubular shape. When the RFID tag 251Y is to be attached to the cap portion 232Y1, the RFID tag 251Y in the rectangular shape is wound around the outer peripheral surface of the cap portion 232Y1, and then the front surface of one end portion of the RFID tag 251Y and the back surface of the other end portion of the RFID tag 251Y are stuck to each other with the adhesive member, so that eventually the RFID tag 251Y in the tubular shape is attached to the cap portion 232Y1.

The RFID tag 251Y attached to the cap portion 232Y1 in the above-mentioned manner is controlled not to move in an axial direction of the cap portion (i.e., the same direction as the longitudinal direction of the toner container when the cap portion 232Y1 is put on the container body 232Y2) by ribs 252Ya and 252Yb that are arranged at positions where the ribs 252Ya and 252Yb can sandwich the RFID tag 251Y in the axial direction of the cap portion 232Y1. In other words, both edges of the RFID tag 251Y in the axial direction of the cap portion are brought into contact with respective end walls of the ribs 252Ya and 252Yb, so that movement of the RFID tag 251Y in the axial direction of the cap portion can be restricted. Accordingly, a relative position of the RFID tag 251Y with respect to the cap portion in the axial direction of the cap portion is fixed.

Furthermore, the RFID tag 251Y in the tubular shape is attached to the entire circumference of the outer peripheral surface of the cap portion 232Y1 in the circumferential direction, so that the inner surface of the RFID tag 251Y and the outer peripheral surface of the cap portion 232Y1 are brought into contact with each other. Therefore, movement of the RFID tag 251Y in a direction perpendicular to the axial direction of the cap portion can be restricted over the entire circumference of the outer peripheral surface of the cap portion 232Y1 in the circumferential direction. Accordingly, a relative position of the RFID tag 251Y with respect to the cap portion 232Y1 in the direction perpendicular to the axial direction of the cap portion is fixed.

In this manner, the RFID tag 251Y can be attached to the cap portion 232Y1 at a fixed position without being attached to the outer peripheral surface of the cap portion 232Y1 with an adhesive or the like. Furthermore, it is possible to prevent removal of the RFID tag 251Y from the cap portion 232Y1.

According to the present configuration example, it is possible to prevent removal of the RFID tag 251Y from the cap portion 232Y1, so that removal of the RFID tag 251Y from the cap portion 232Y1 during various processing such as cleaning of the cap portion 232Y1 for recycling can be prevented, resulting in preventing missing of the various information related to the cap portion 232Y1, such as recycling frequency of the cap portion 232Y1. Thus, the quality control of the recycled product of the cap portion 232Y1 can be performed in a preferable manner.

A third embodiment of a copier as the image forming apparatus according to the present invention is described below. A configuration of the copier of the present embodiment is basically the same as the copiers of the first and the second embodiments except for the toner supplying devices 60, 260 and the toner containers 32, 232 of the first and the second embodiments (in the third embodiment, a toner supplying device 360 and a toner container 332 are employed as will be described later), and therefore, explanation about the same configuration as the copiers of the first and the second embodiments will be omitted.

The toner supplying device 360 that guides toner contained in a toner container 332Y to the developing device 5Y is described below with reference to FIG. 28.

Figure 28:
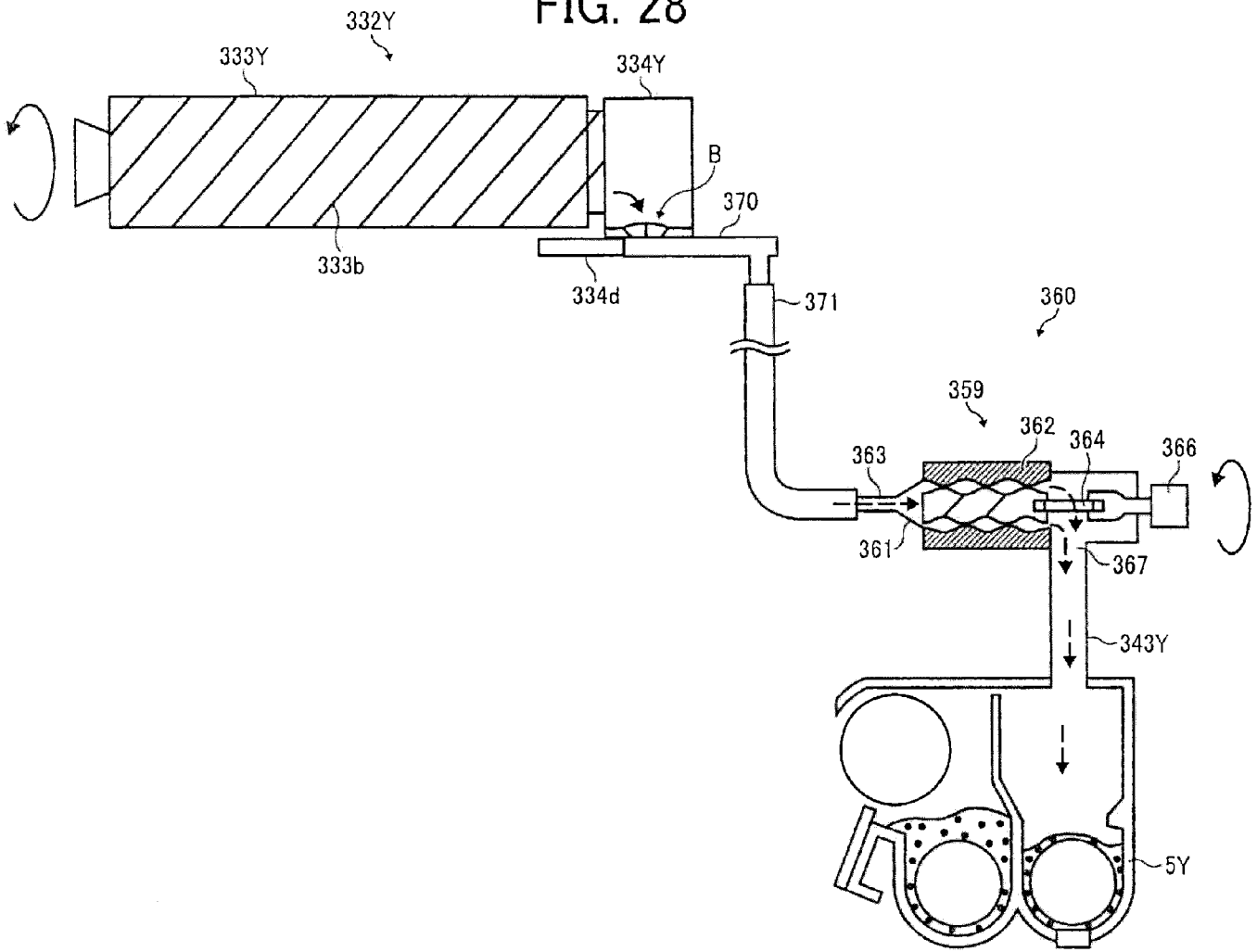
FIG. 28 is a schematic diagram of a toner supply path.

In FIG. 28, positions and orientations of the toner container 332Y, toner conveying pipes 343Y, 359, 370, and 371 that function as toner supply paths and the developing device 5Y are modified from actual ones as a help for simple understanding of the configuration. In the actual configuration, in FIG. 28, a longitudinal side of the toner container 332Y and a part of the toner supply paths are arranged in a direction normal to a plane of FIG. 28.

Figure 29:
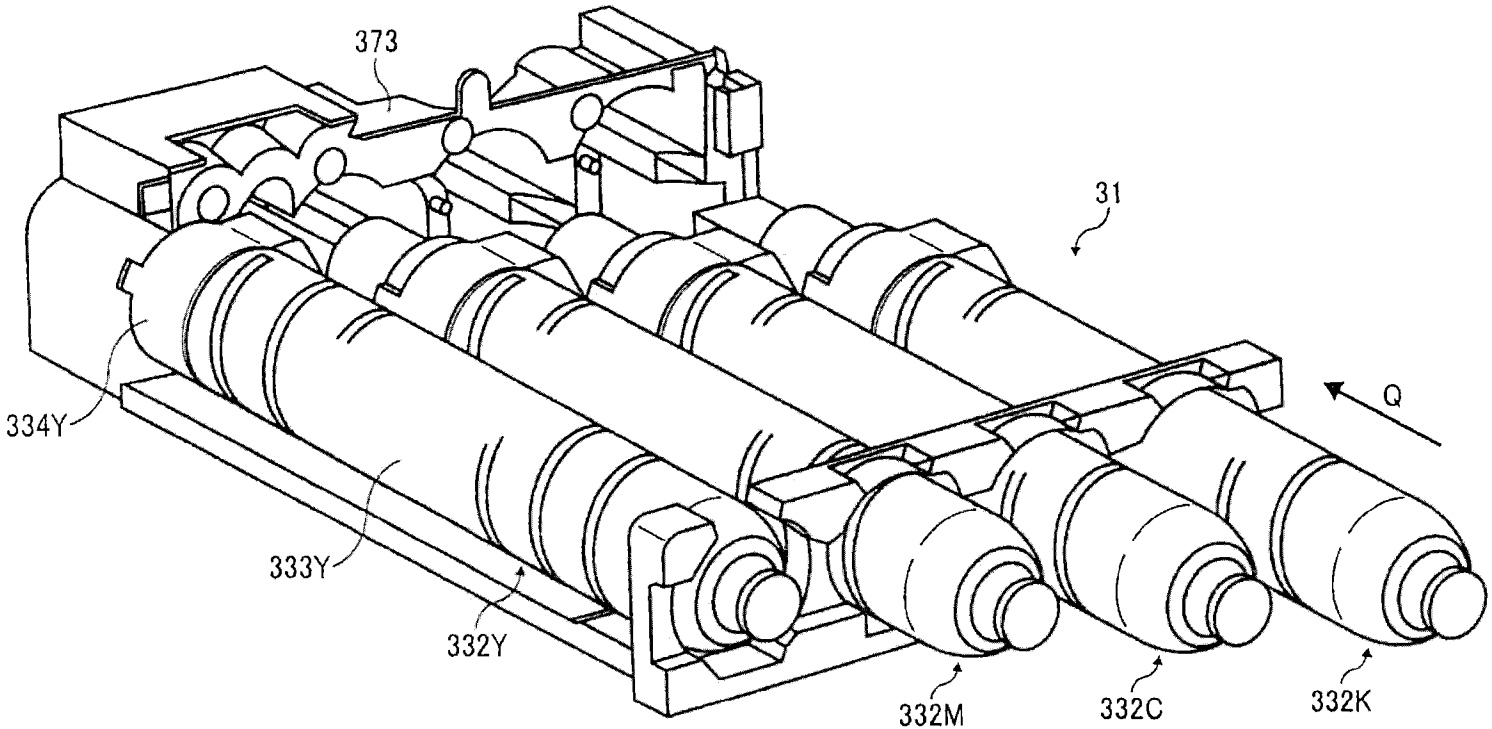
FIG. 29 is a perspective view of a toner-container housing unit mounted with toner containers.

As shown in FIG. 29, toner contained in each of the toner containers 332Y, 332M, 332C, and 332K housed in the toner-container housing unit 31 of the image forming apparatus body 100 is appropriately supplied to corresponding one of the developing devices 5 via a toner supply path arranged for each toner color, based on consumption of toner in corresponding one of the developing devices 5 for corresponding color. Configurations of the four toner supply paths are substantially the same with each other except for color of toner to be used in an image forming process.

More specifically, when the toner container 332Y is mounted on the toner-container housing unit 31 of the image forming apparatus body 100, a nozzle 370 of the toner-container housing unit 31 is connected to a cap portion 334Y (a supported portion) of the toner container 332Y. At this time, a plug member 334*d* (an opening and closing member) of the toner container 332Y opens a toner outlet B of the cap portion 334Y. Then, a driving unit (not shown) mounted on the toner-container housing unit 31 rotates a container body 333Y of the toner container 332Y in a direction indicated by an arrow in FIG. 28. A spiral protrusion 333*b* (i.e., a spiral groove 333*b* when viewed from an outer peripheral surface of the container body 333Y) is formed on an inner peripheral surface of the container body 333Y. Therefore, the toner contained in the container body 333Y is guided toward an opening 323 by the spiral protrusion 333*b* and then discharged from the opening 323 by rotating the container body 333Y in the direction indicated by the arrow in FIG. 28. The toner discharged from the opening 323 is conveyed to the nozzle 370 via the toner outlet B. The cap portion 334Y is fixedly supported by a holding unit 373 of the toner-container housing unit 31 so that the cap portion 334Y does not rotate along with the rotation of the container body 333Y.

Another end of the nozzle 370 is connected to one end of a tube 371 that functions as a conveying tube. The tube 371 is made of highly toner-resistant flexible material. The other end of the tube 371 is connected to a screw pump 359 (i.e., a mohno pump) of the toner supplying device.

The tube 371 as the conveying tube is formed such that an inner diameter thereof is in a range from 4 millimeters to 10 millimeters. The tube 371 can be made of rubber material such as polyurethane, nitrile, ethylene propylene diene monomer (EPDM), and silicon, or resin material such as polyethylene and nylon. With use of the tube 371 made of such flexible material, possibilities of layout design of the toner supply paths can be enhanced, resulting in reduction in size of the image forming apparatus.

The screw pump 359 is a suction-type eccentric screw pump, and includes a rotor 361, a stator 362, a suction port 363, a universal joint 364, a motor 366, and the like. The rotor 361, the stator 362, and the universal joint 364 are housed in a case (not shown). The stator 362 is an internal thread member made of elastic material such as rubber. A double-pitched spiral groove is formed inside the stator 362. The rotor 361 is an external thread member that is formed by twisting a shaft that is made of rigid material such as metal in a spiral manner. The rotor 361 is rotatably fitted in the stator 362. One end of the rotor 361 is rotatably connected to the motor 366 via the universal joint 364.

The screw pump 359 having the above configuration causes the motor 366 to drive the rotor 361 that is arranged in the stator 362 to rotate in a predetermined direction (i.e., a counterclockwise direction when viewed from an upstream side of a toner conveying direction), so that suction force is generated at the suction port 363 (i.e., negative pressure is generated within the tube 371 by discharging air from the tube 371). Accordingly, the toner in the toner container 332 is sucked into the suction port 363 via the tube 371 with air. The toner sucked into the suction port 363 is further conveyed to a space between the stator 362 and the rotor 361, and then output to an opposite end along with rotation of the rotor 361. The toner that has been output is discharged from an outlet 367 of the screw pump 359, and then supplied to the developing device 5Y via the toner conveying pipe 343Y.

In the present embodiment, the rotor 361 of the screw pump 359 is rotated counterclockwise when viewed from the upstream side of the toner conveying direction. Furthermore, spiral (i.e., a direction of twist) of the rotor 361 is formed in a rightward direction. Therefore, swirling airflow in the rightward direction is generated within the screw pump 359 along with the rotation of the rotor 361.

A method for recycling the toner container 332Y is described below. The toner container 332Y of the present embodiment can be reused after performing recycling processing on the used toner container (i.e., the toner container that has become empty as a result of consumption of all contained toner by the image forming apparatus).

A first exemplary method for recycling the toner container 332Y is described below. In the first exemplary recycling method, a removal process for removing the cap portion 334Y from the container body 333Y of the toner container 332 that has been collected is performed. Then, a supplying process for cleaning the container body 333Y and the cap portion 334Y and then supplying toner (or two-component developer) to the container body 333Y is performed. A putting process for putting the cap portion 334Y on the container body 333Y is performed as the last process. By recycling the toner container 332Y in the above-mentioned manner, environmental resources can be efficiently used.

In the present embodiment, only toner is contained in a container body 333 of each of the toner containers 332Y, 332M, 332C, and 332K. However, it is possible to supply two-component developer to the container body 333 of each of the toner containers 332Y, 332M, 332C, and 332K when the container body 333 is to be mounted on an image forming apparatus that appropriately supplies the two-component developer formed of toner and carrier to a developing device. Even in this case, the same effect as the present embodiment can be obtained.

Furthermore, in the present embodiment, the suction-type screw pump 359 that discharges air from the tube 371 is mounted on the toner supplying device 360. However, it is possible to mount a discharge-type screw pump that introduces air into the tube 371 on the toner supplying device 360. Even in this case, the same effect as the present embodiment can be obtained.

Salient features of the present embodiment will be described in detail below.

Figure 30:
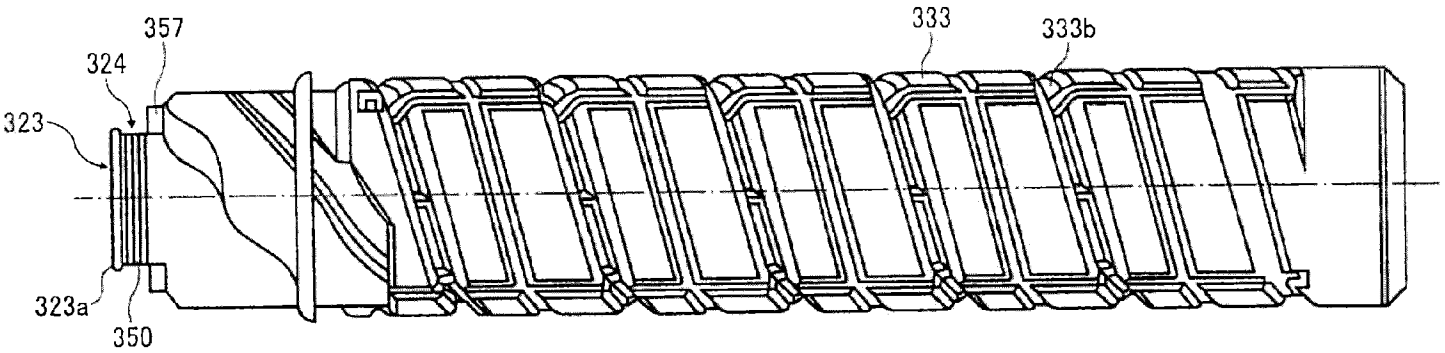
FIG. 30 is a schematic diagram of a container body equipped with an RFID tag.

In the present embodiment, as shown in FIG. 30, an RFID tag 350 in a tubular shape and formed of a flexible electronic substrate is attached so as to surround an outer peripheral surface of a collar 324 of the container body 333. The RFID tag 350 stores therein information related to toner, such as color of the toner, an amount of the toner, a manufacturing number of the toner (i.e., a manufacturing lot), and a manufacturing date of the toner, and information related to recycling of the container body 333, such as recycling frequency, date of recycling, and recycling manufacturer.

A configuration of the RFID tag 350 of the present embodiment is the same as that of the RFID tag 90 of the first embodiment, and therefore, explanation thereof is omitted.

The RFID tag 350 attached to the outer peripheral surface of the collar 324 is controlled not to move in a longitudinal direction of the toner container by a flange portion 323*a* that forms an edge of the opening 323 and a rib 357 that is arranged at a position where the flange portion 323*a* and the rib 357 can sandwich the RFID tag 350 in the longitudinal direction of the toner container (i.e., a position separated from the flange portion 323*a* at an interval substantially the same as a width of the RFID tag 350 in the longitudinal direction of the toner container). In other words, both edges of the RFID tag 350 in the longitudinal direction of the toner container are brought into contact with respective end walls of the flange portion 323*a* and the rib 357, so that movement of the RFID tag 350 in the longitudinal direction of the toner container can be restricted. Accordingly, a relative position of the RFID tag 350 with respect to the container body 333 in the longitudinal direction of the toner container is fixed.

Regarding a relation between a size of each of the flange portion 323*a* and the rib 357 in a height direction (i.e., an outward direction from the outer peripheral surface of the collar 324 of the container body 333) and a thickness of the RFID tag 350, the size of each of the flange portion 323*a* and the rib 357 in the height direction can be either larger or smaller than the thickness of the RFID tag 350 as long as the flange portion 323*a* and the rib 357 can restrict the movement of the RFID tag 350 in the longitudinal direction of the toner container. However, it is preferable to set the size of each of the flange portion 323*a* and the rib 357 in the height direction to be larger than the thickness of the RFID tag 350 because the flange portion 323*a* and the rib 357 in such sizes can more effectively prevent a situation in which the RFID tag 350 moves in the longitudinal direction of the toner container over the flange portion 323*a* and the rib 357.

Furthermore, the RFID tag 350 in the tubular shape is attached to the outer peripheral surface of the collar 324 that is in a cylindrical shape, so that the inner surface of the RFID tag 350 and the outer peripheral surface of the collar 324 are brought into contact with each other. Therefore, movement of the RFID tag 350 in a direction perpendicular to the longitudinal direction of the toner container can be restricted over the entire circumference of the collar 324. Accordingly, a relative position of the RFID tag 350 with respect to the container body 333 in the direction perpendicular to the longitudinal direction of the toner container is fixed.

In this manner, the RFID tag 350 can be attached to the container body 333 at a fixed position without being attached to the outer peripheral surface of the container body 333 with an adhesive or the like. Furthermore, it is possible to prevent removal of the RFID tag 350 from the container body 333.

Figure 31:
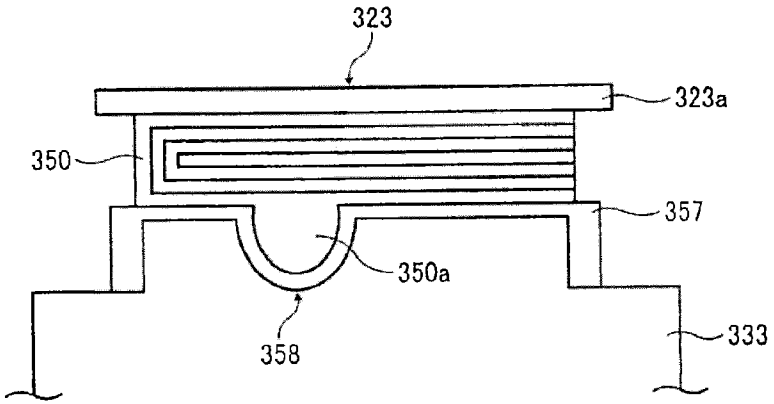
FIG. 31 is a schematic diagram for explaining a configuration to restrict rotational movement of the RFID tag in a circumferential direction with respect to the container body.

In an eleventh configuration example, as shown in FIG. 31, a convex portion 350*a* that is formed on one side end portion of the RFID tag 350 and a concave portion 358 that is formed on the outer peripheral surface of the container body 333 and configured to be engaged with the convex portion 350*a* are engaged with each other when the RFID tag 350 is attached to the outer peripheral surface of the container body 333, so that rotational movement of the RFID tag 350 in a circumferential direction with respect to the container body 333 can be restricted.

For example, if the RFID tag 350 is rotated in the circumferential direction with respect to the container body 333 along with rotation of the container body 333 while a toner supplying device supplies toner contained in the container body 333 to the developing device, the inner surface of the RFID tag 350 and the outer peripheral surface of the container body 333 may rub against each other along with the rotation of the RFID tag 350 in the circumferential direction with respect to the container body 333. As a result, the inner surface of the RFID tag 350 may be damaged. If the inner surface of the RFID tag 350 is damaged, the degradation of the RFID tag 350 may be accelerated, resulting in disabling the RFID tag 350 before the end of lifetime of the container body 333.

In the present configuration example, the convex portion 350*a* of the RFID tag 350 and the concave portion 358 of the container body 333 are engaged with each other to restrict the rotation of the RFID tag 350 in the circumferential direction with respect to the container body 333. Therefore, it is possible to prevent a situation in which the inner surface of the RFID tag 350 is damaged by rubbing of the inner surface of the RFID tag 350 and the outer peripheral surface of the container body 333 along with the rotation of the RFID tag 350 in the circumferential direction with respect to the container body 333.

Accordingly, when the container body 333 is repeatedly recycled, acceleration of degradation of the RFID tag 350 can be prevented to the extent that the damage of the inner surface of the RFID tag 350 can be prevented. Therefore, it is possible to prevent a situation in which the RFID tag 350 is disabled before the end of lifetime of the container body 333.

There can be another configuration for restricting the rotation of the RFID tag 350 in the circumferential direction with respect to the container body 333 as described below. That is, a hole portion that is concaved from an outer side of the side wall (i.e., an outer side of the container body 333) to an inner side of the side wall (i.e., an inner side of the container body 333) is formed on a side wall mounted with the collar 324, and a protruded portion that is to be fitted in the hole portion is formed on an inner wall of the RFID tag 350 in the tubular shape, so that when the RFID tag 350 is attached to the collar 324 of the container body 333, the hole portion and the protruded portion can be engaged with each other to thereby restrict the rotation of the RFID tag 350 in the circumferential direction with respect to the container body 333. With this configuration, the movement of the RFID tag 350 in the longitudinal direction of the toner container can also be restricted due to the engagement of the hole portion and the protruded portion without formation of the flange portion 323*a* and a rib 327 on the container body 333.

Figure 32:
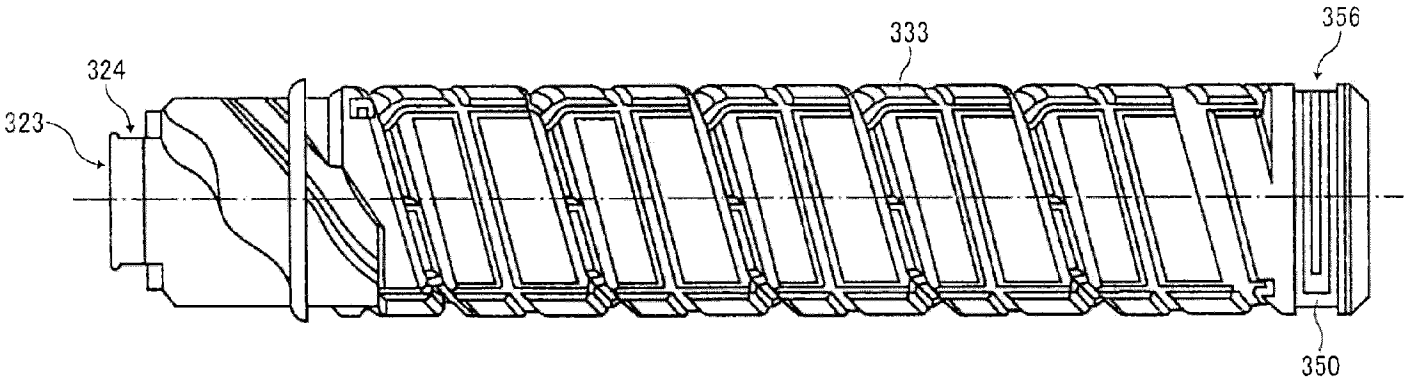
FIG. 32 is a schematic diagram of the container body equipped with an RFID tag on a rear portion thereof.

In a twelfth configuration example, as shown in FIG. 32, the RFID tag 350 in the tubular shape is attached to a circumferential surface of the container body 333 near a rear portion of the container body 333.

A groove 356 for mounting the RFID tag 350 in the tabular shape is formed on the entire circumference of a side wall of the container body 333 near the rear portion of the container body 333 in the circumferential direction, and a width of the groove 356 is substantially the same as the width of the RFID tag 350. Similarly to the ninth configuration example, the RFID tag 350 in the rectangular shape is wound around a bottom surface of the groove 356 and then a front surface of one end portion of the RFID tag 350 and a back surface of the other end portion of the RFID tag 350 are stuck to each other with an adhesive member such as a double-sided tape, so that the RFID tag 350 in the tubular shape is attached to the container body 333.

Both ends of the RFID tag 350, which is in the tubular shape and attached to the groove 356, in the longitudinal direction of the toner container are respectively brought into contact with inner walls of the groove 356, which face each other in the longitudinal direction of the toner container across the RFID tag 350, so that movement of the RFID tag 350 in the longitudinal direction of the toner container can be restricted. As a result, a relative position of the RFID tag 350 with respect to the container body 333 in the longitudinal direction of the toner container is fixed. Furthermore, because the RFID tag 350 in the tubular shape is attached to the bottom surface of the groove 356 that is formed on the entire circumference of the side wall of the container body 333 in the circumferential direction, the inner surface of the RFID tag 350 and the bottom surface of the groove 356 are brought into contact with each other. Therefore, movement of the RFID tag 350 in a direction perpendicular to the longitudinal direction of the toner container can be restricted over the entire circumference of the groove 356. Accordingly, a relative position of the RFID tag 350 with respect to the container body 333 in the direction perpendicular to the longitudinal direction of the toner container is fixed.

In this manner, by attaching the RFID tag 350 in the tubular shape to the groove 356 that is formed on the side wall of the container body 333 near the rear portion of the container body 333, the RFID tag 350 can be attached to the container body 333 at a fixed position without being attached to the outer peripheral surface of the container body 333 with an adhesive or the like. Furthermore, it is possible to prevent removal of the RFID tag 350 from the container body 333.

Figure 33:
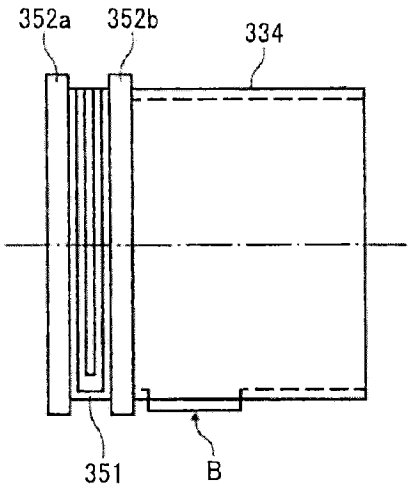
FIG. 33 is a schematic diagram of a cap portion equipped with an RFID tag.

In a thirteenth configuration example, as shown in FIG. 33, an RFID tag 351 that prestores therein various information related to a cap portion 334, such as recycling frequency of the cap portion 334 and information related to the container body 333 paired with the cap portion 334, is attached to the cap portion 334 of the container body 333. A configuration of the RFID tag 351 is the same as the RFID tag 251Y attached to the cap portion 232Y1 in the second embodiment, and therefore, explanation thereof is omitted.

The cap portion 334 is recycled along with recycling of the container body 333. However, if the repeatedly-recycled cap portion 334 is continuously used over time, the cap portion 334 may be deformed or damaged. Therefore, it is preferable to perform quality control of a recycled product of the cap portion 334 by, for example, checking whether the cap portion 334 has been recycled a preset predetermined maximum number of times in a recycling factory or the like for the cap portion 334 that has been collected together with the used container body 333 from a user. However, if the RFID tag 351 is attached to the cap portion 334 with an adhesive or the like, the RFID tag 351 may be removed from the cap portion 334 during various processing in the recycling factory, such as cleaning of the cap portion 334 for recycling, so that the various information related to the cap portion 334, such as recycling frequency of the cap portion 334, may be lost.

In the present configuration example, the RFID tag 351 in a tubular shape and formed of a flexible electronic substrate is attached so as to surround the outer peripheral surface of the cap portion 334. The RFID tag 351 is controlled not to move in an axial direction of the cap portion 334 (i.e., the same direction as the longitudinal direction of the toner container when the cap portion 334 is attached to the container body 333) by ribs 352*a* and 352*b* that are arranged at positions where the ribs 352*a* and 352*b* can sandwich the RFID tag 351 in the axial direction of the cap portion 334. In other words, both edges of the RFID tag 351 in the axial direction of the cap portion are brought into contact with respective end walls of the ribs 352*a* and 352*b*, so that movement of the RFID tag 351 in the axial direction of the cap portion 334 can be restricted. Accordingly, a relative position of the RFID tag 351 with respect to the cap portion 334 in the axial direction of the cap portion is fixed.

Furthermore, the RFID tag 351 in the tubular shape is attached to the entire circumference of the outer peripheral surface of the cap portion 334 in the circumferential direction, so that the inner surface of the RFID tag 351 and the outer peripheral surface of the cap portion 334 are brought into contact with each other. Therefore, movement of the RFID tag 351 in a direction perpendicular to the axial direction of the cap portion can be restricted over the entire circumference of the outer peripheral surface of the cap portion 334 in the circumferential direction. Accordingly, a relative position of the RFID tag 351 with respect to the cap portion 334 in the direction perpendicular to the axial direction of the cap portion is fixed.

In this manner, the RFID tag 351 can be attached to the cap portion 334 at a fixed position without being attached to the outer peripheral surface of the cap portion 334 with an adhesive or the like. Furthermore, it is possible to prevent removal of the RFID tag 351 from the cap portion 334.

According to the present configuration example, it is possible to prevent removal of the RFID tag 351 from the cap portion 334, so that removal of the RFID tag 351 from the cap portion 334 during various processing such as cleaning of the cap portion 334 for recycling can be prevented, resulting in preventing missing of the various information related to the cap portion 334, such as recycling frequency of the cap portion 334. Thus, the quality control of the recycled product of the cap portion 334 can be performed in a preferable manner.

According to one embodiment of the present invention, a powder container that has a hollow interior for containing powder includes a tubular member that is equipped with an information storage unit that stores therein at least information related to a container body, and attached to the container body such that the container body is located within an inner hole of the tubular member; and a movement restricting unit that restricts movement of the tubular member in an axial direction of the tubular member. Thus, the tubular member is attached to the container body such that the container body is located within the inner hole of the tubular member equipped with the information storage unit. Therefore, movement of the tubular member in a direction perpendicular to an axial direction of the tubular member can be restricted. Furthermore, movement of the tubular member, which is attached to the container body, in the axial direction of the tubular member can be restricted. Thus, because the movement of the tubular member attached to the container body can be restricted both in the axial direction and the direction perpendicular to the axial direction with respect to the container body, so that removal of the tubular member equipped with the information storage unit from the container body can be prevented. As a result, the information storage unit can be continuously carried by the powder container over time.

Furthermore, according to another embodiment of the present invention, the powder container further includes an information transmitting-receiving unit that is electrically connected to the information storage unit and configured to transmit and receive the information to and from an external communicating unit, wherein the tubular member is an electronic substrate, and the information transmitting-receiving unit is arranged on the entire circumferential of the electronic substrate. Therefore, as described above, a distance between the information transmitting-receiving unit and the communicating unit can always be maintained at a desired distance when the rotation of the toner container for the toner supply operation performed by the toner supplying device is stopped. As a result, the information transmitting-receiving unit and the communicating unit can perform good communication.

Moreover, according to still another embodiment of the present invention, the powder container further includes an information transmitting-receiving unit that is electrically connected to the information storage unit and configured to transmit and receive the information to and from an external communicating unit, and an electronic substrate that is equipped with the information storage unit and the information transmitting-receiving unit, and attached to the tubular member. Therefore, as described above, a commonly-available RFID tag can be used, resulting in reduced costs.

Furthermore, according to still another embodiment of the present invention, the powder container further includes a rotation restricting unit that restricts rotational movement of the tubular member in a circumferential direction with respect to the container body. Therefore, as described above, it is possible to prevent a situation in which the inner surface of the tubular member is damaged by rubbing of the inner surface of the tubular member and the outer peripheral surface of the container body along with the rotation of the tubular member in the circumferential direction with respect to the container body.

Moreover, according to still another embodiment of the present invention, the tubular member is formed such that a rectangular member is wound around an outer peripheral surface of the container body and then both end portions of the rectangular member in a longitudinal direction thereof are stuck to each other. Therefore, the tubular member can easily be attached to the container body.

Moreover, according to the first embodiment, the followings are provided: an opening that discharges contained powder to an outside and is formed on one end surface in a axial direction of a container body; the plug 25 that is attachable to and detachable from the container body to open or close the opening 23; a second tubular member that is equipped with a second information storage unit that stores therein at least information about the plug 25 and attached to the cap member such that the cap member is located within an inner hole of the second tubular member; and a second movement restricting unit that restricts movement of the second tubular member in an axial direction of the cap member. Therefore, it is possible to prevent a situation in which the second tubular member equipped with the second information storage unit is removed from the plug 25 during various recycling processing for the plug 25, such as cleaning of the plug 25 and various information about the plug 25, such as recycling frequency of the plug 25, is lost. Thus, the quality control of the recycled product of the plug 25 can be performed in a desired manner.

Furthermore, according to the second and the third embodiments, the followings are provided: an opening that discharges contained powder to an outside and is formed on one end surface of the container body in a axial direction; a cap member that is attached to the container body to seal the opening, detachable from the container body, and equipped with a second opening that is communicated with the opening; a second tubular member that is equipped with a second information storage unit that stores therein at least information about the cap member, and attached to the cap member such that the cap member is located within an inner hole of the second tubular member; and a second movement restricting unit that restricts movement of the second tubular member in an axial direction of the cap member. Therefore, it is possible to prevent a situation in which the second tubular member equipped with the second information storage unit is removed from the cap member during various recycling processing for the cap member, such as cleaning of the cap member and in which various information about the cap member, such as recycling frequency of the cap member, is lost. Thus, the quality control of the recycled product of the cap member can be performed in a desired manner.

Moreover, according to the second embodiment, the container body includes an opening that discharges contained powder to an outside, and a cap member that is attached to the container body to seal the opening and equipped with a second opening that is communicated with the opening, wherein the cap member attached to the container body covers the information storage unit. Therefore, it is possible to prevent the information storage unit from being covered with dispersed toner. It is also possible to prevent a situation in which the tubular member is cut off or the information storage unit is broken because of impact or scratch externally applied thereto.

Furthermore, according to the second embodiment, the movement restricting unit is a flange portion that is to be engaged with an engaging portion formed on the cap member, and the information storage unit and the opening are located so as to sandwich the flange portion. Therefore, the flange portion functions as a wall for preventing dispersion of the powder that has been discharged from the opening towards the information storage unit. As a result, it is possible to prevent a situation in which the toner is attached to the information storage unit and communication sensitivity of the information storage unit is thereby degraded.

Moreover, according to the second embodiment, the container body can be supported by the cap member so as to be rotatable with respect to the cap member.

Furthermore, according to still another embodiment of the present invention, in the powder supplying device that supplies powder contained in a powder container that is removable with respect to a body of the powder supplying device to a powder receiving unit, it is preferable to use the toner container according to the present invention as the powder container.

Moreover, according to still another embodiment of the present invention, in an image forming apparatus that includes an image carrier that carries a latent image; a developing unit that develops the latent image carried on the image carrier with powder developer; a powder supplying unit that is equipped with a powder container in a removable manner, the powder container containing the developer, and supplies the developer contained in a container body of the powder container to the developing unit; an information storage unit that is attached to the container body and stores therein information about the container body; and a communicating unit that is attached to a body of the image forming apparatus and reads information stored in the information storage unit, it is preferable to use the toner supplying device that carries the toner container according to the present invention as the powder supplying unit.

Figure 34:
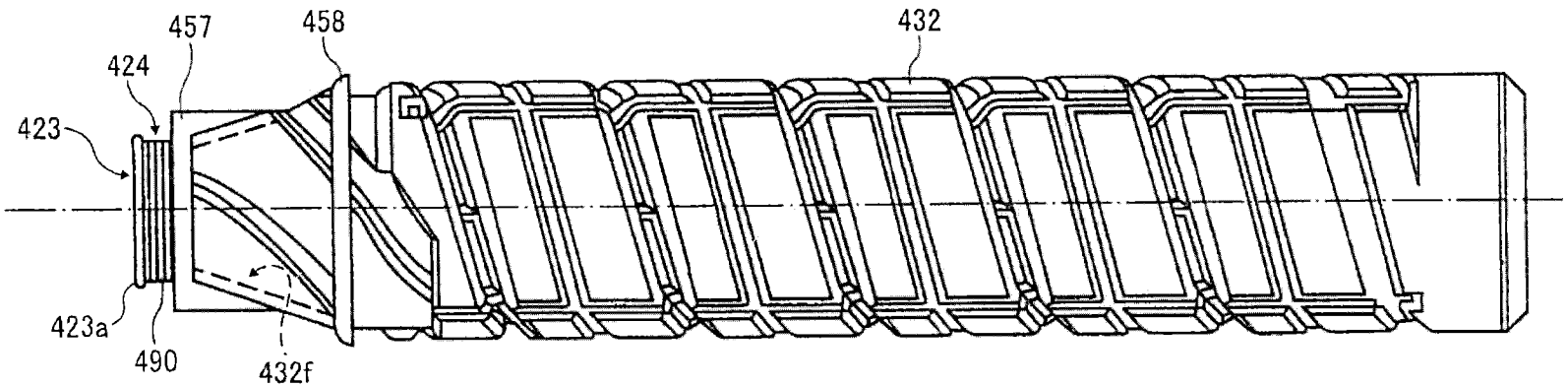
FIG. 34 illustrates a modified example of the toner container.

The shape of the container body of the toner container is not limited to that as shown in FIG. 1. For example, a container body 432 in a shape as shown in FIG. 34 can be used. More specifically, an outer peripheral wall and an inner peripheral wall of the container body in a space between a collar 424 and a rib 458 are formed such that respective diameters are gradually decreased from a rear portion of the container body to an opening so that the inner peripheral wall can form a slope 432*f*. The slope 432*f* has a function to gradually convey toner contained in the container body 432 toward an opening 423 when the toner contained in the container body 432 is conveyed to the opening 423 along with rotation of the container body 432 around a shaft. Accordingly, it is possible to prevent discharge of a large amount of toner from the opening 423 at one time. Furthermore, in the container body 432, an RFID tag 490 in a tubular shape can be attached to the collar 424 such that movement of the RFID tag 490 in an axial direction of the container body is restricted by a flange portion 423*a* and a rib 457. Accordingly, removal of the RFID tag 490 from the container body 432 can be prevented.

A fourth embodiment of the present invention will be described in detail below to describe exemplary solution for the second problem mentioned earlier. In the following embodiment, an example is described in which the present invention is applied to an electrophotographic copier (hereinafter, referred to as "copier") that functions as an image forming apparatus.

The image forming apparatus in the following embodiment is the same as that described in the above embodiments with reference to FIGS. 2 and 3, and therefore, detailed explanation about a configuration and operation thereof will be omitted.

Figure 36A:
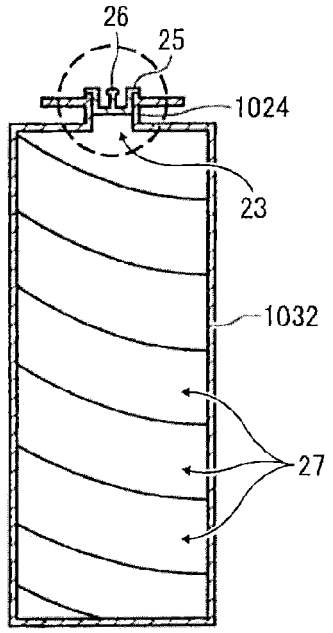
FIG. 36A is a longitudinal sectional view of the toner container.
Figure 36B:
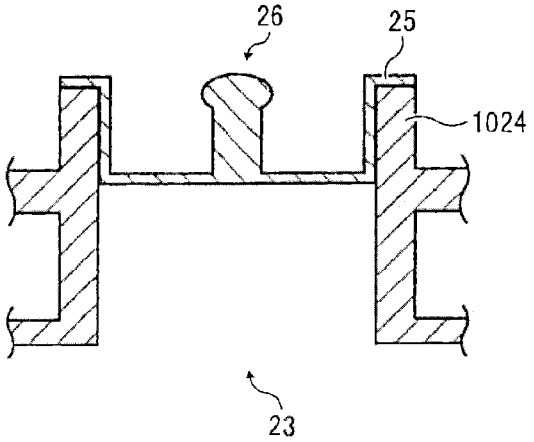
FIG. 36B is an enlarged view of an opening of the toner container.

FIG. 36A is a longitudinal sectional view of a toner container 1030 that is made of synthetic resin such as polyethylene, polypropylene, polyethylene terephthalate, or polyethylene-polycarbonate blend. FIG. 36B is an enlarged view of the opening 23 of the toner container 1030.

The toner container 1030 of the present embodiment includes the same components as those of the first embodiment. These components are denoted with the same reference numerals as of the first embodiment, and therefore, the explanation in the first embodiment should be referred to as appropriate. The present embodiment is different from the first embodiment in that a flange 1031 is formed on an outer circumference of the opening 23, which will be described in detail later.

Figure 37:
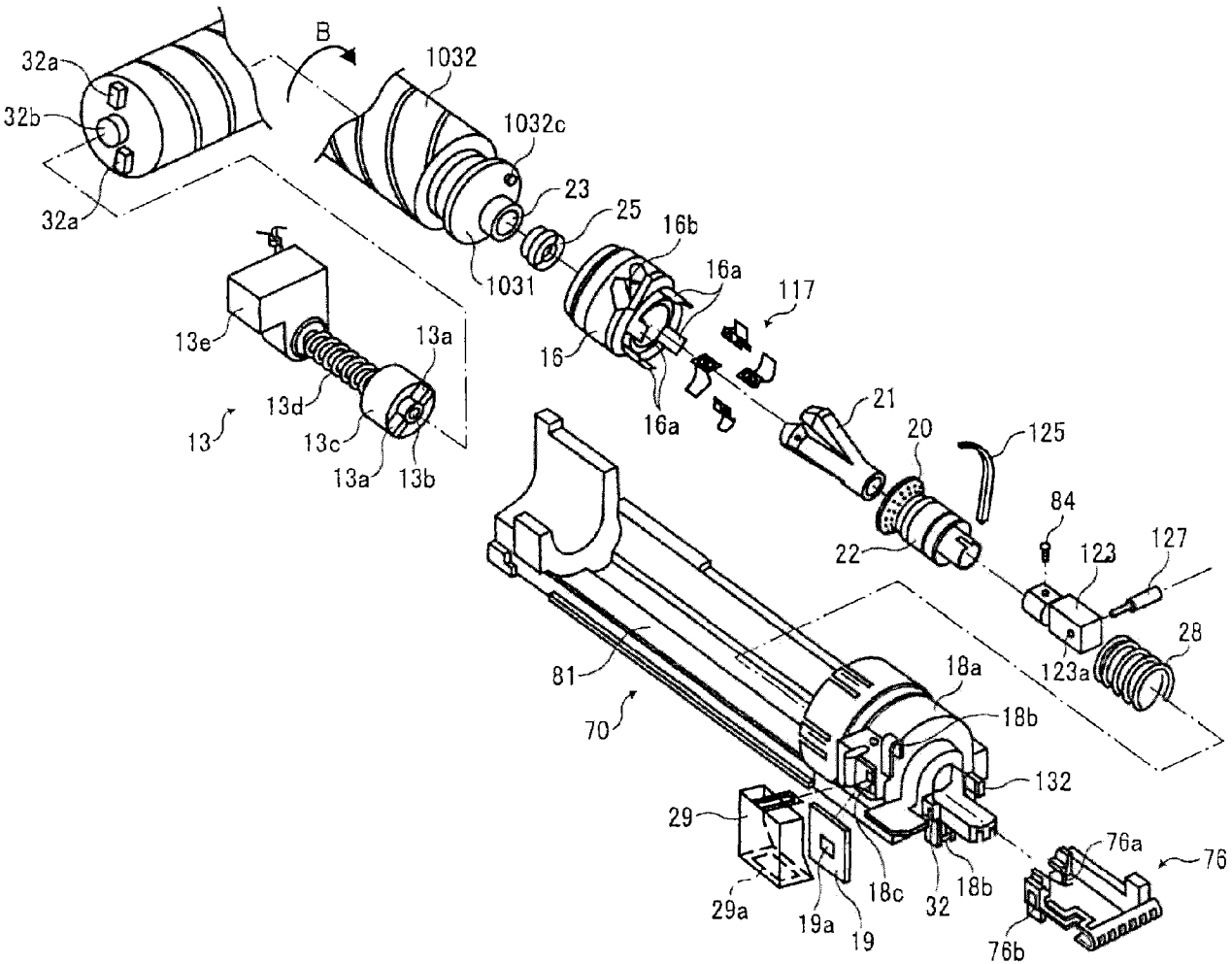
FIG. 37 is an exploded perspective view of components of a toner supplying device.

A toner supplying device 70 is described below. The toner supplying device of the present embodiment shown in FIG. 37 includes the same components as those of the first embodiment shown in FIG. 5. These components are denoted with the same reference numerals as of the first embodiment, and therefore, the explanation in the first embodiment should be referred to as appropriate. The present embodiment is different from the first embodiment in that the opening of the toner container 1030 has a different shape (i.e., the flange 1031 is formed) and a driving-force transmitting protrusion 1032*c* is formed on a surface of the flange 1031.

Figure 38:
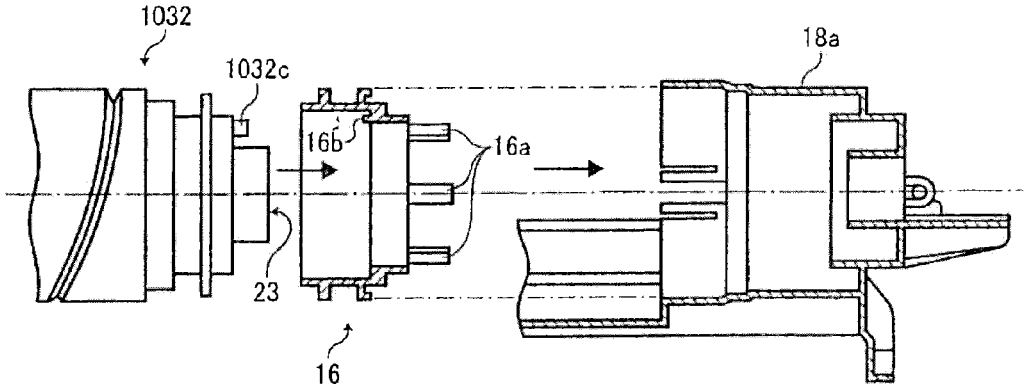
FIG. 38 is an exploded cross-sectional view of components located near a container holding member.

As shown in FIG. 38, the drive rib 16*b* formed on the inner peripheral surface of the container holding member 16 is engaged with the driving-force transmitting protrusion 1032*c* that is formed on the flange 1031 of the toner container 1030 such that the container holding member 16 and the toner container 1030 can rotate in a normal rotation direction in an integrated manner.

Figure 39:
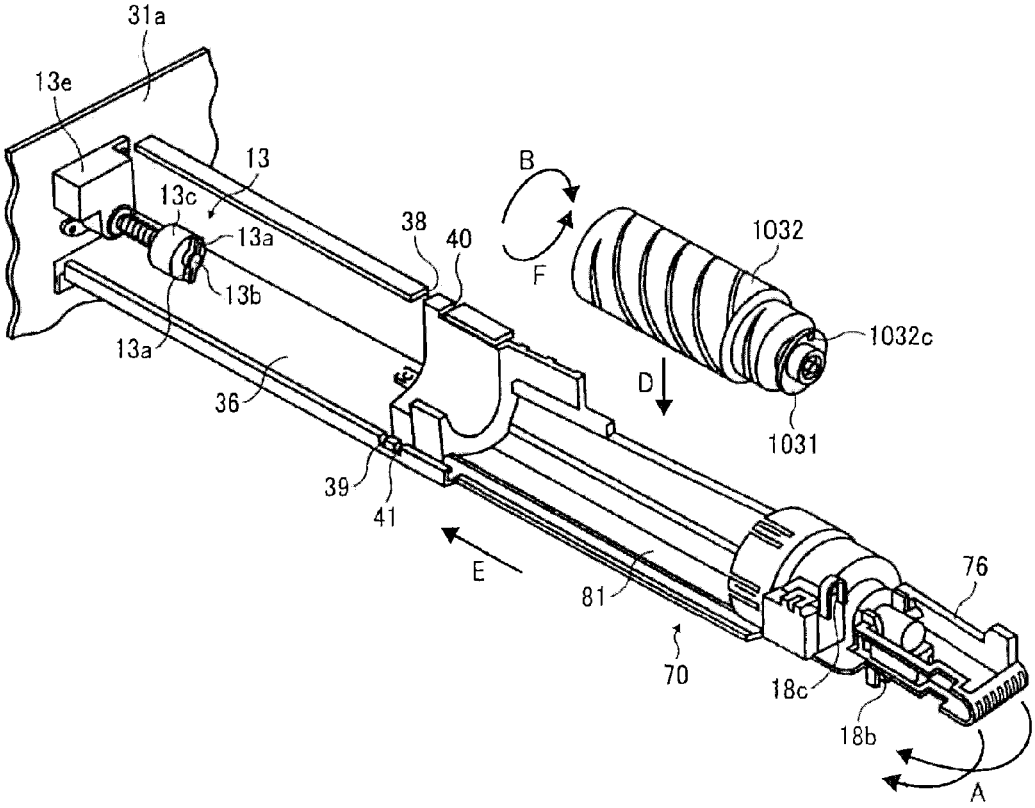
FIG. 39 is a perspective view of a container holder that is pulled out from a guide plate.

Operation for setting the toner supplying device 70 in the above configuration is described below. As shown in FIG. 39, when the container holder 81 is pulled out from a guide plate 136 and the stepped portions 40 and 41 of the container holder 81 are respectively hooked on notch portions 138 and 139 of the guide plate 136, the toner container 1030 filled with toner is placed to be mounted on the container holder 81 in a direction indicated by an arrow D in FIG. 39. Then, the toner supplying device 70 on which the toner container 1030 is mounted is slid on the guide plate 136 in a direction indicated by an arrow E in FIG. 7 so as to be set at a designated position. Accordingly, the protrusion 32*b* (see FIG. 37) on a rear portion of the toner container 1030 is inserted into the concave portion 13*b* (positioning concave portion) of the joint 13*c* to thereby fix the position of the toner container 1030, and the head portion of the toner container 1030 is engaged with the container holding member 16. At this time, the stopper presses a front surface of the container holder 81 to complete setting of the toner supplying device 70.

Figure 40:
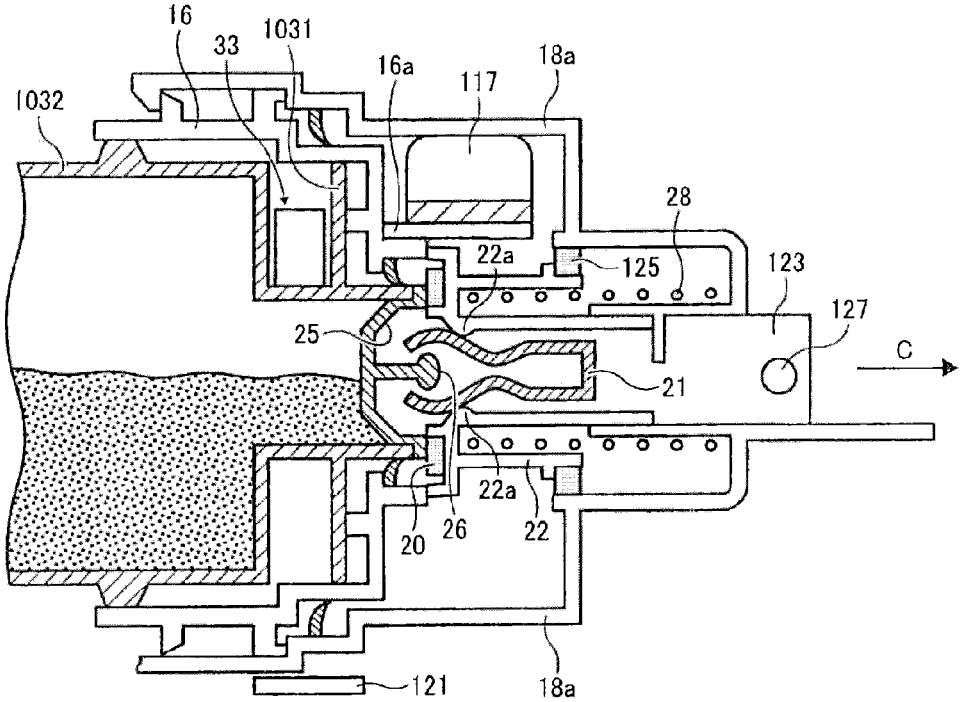
FIG. 40 is a cross-sectional view of the toner container mounted on the toner supplying device.
Figure 41:
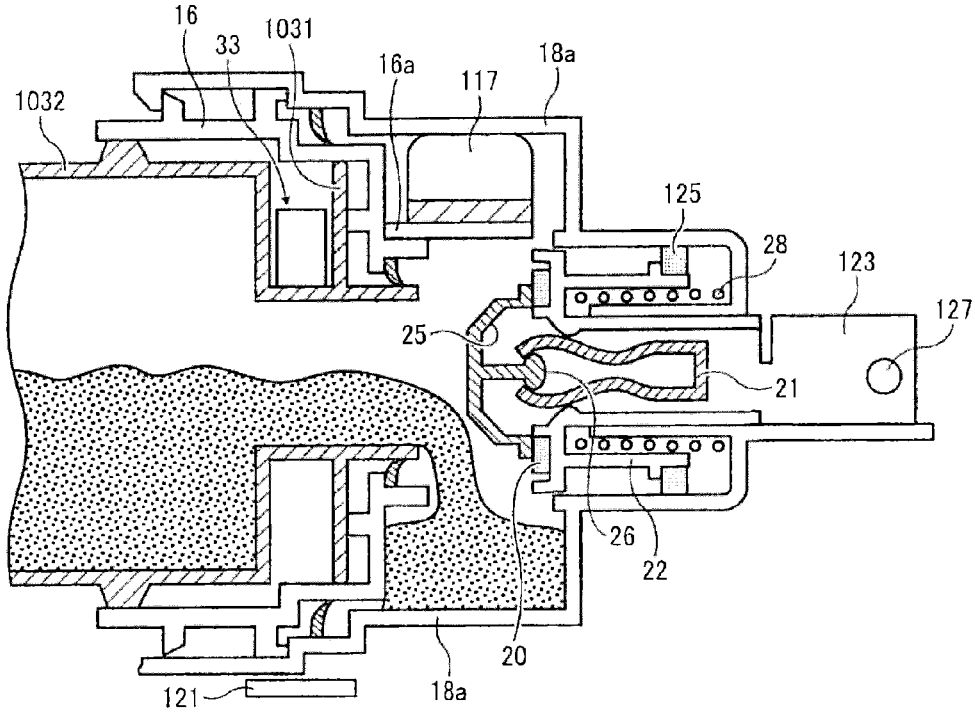
FIG. 41 is a cross-sectional view of the toner container from which toner is being discharged to a contained holding member.

When the handle 76 is rotated in a direction indicated by an arrow A (in a downward direction) as shown in FIG. 39, the cam member 76*a* (see FIG. 37) pulls the slide shaft 127 in a direction indicated by an arrow C as shown in FIG. 40, so that the shaft member 123 starts to move in the direction of the arrow C, resulting in causing the collet chuck 21 to come into contact with the protrusion 22*a* of the cylindrical case 22. Accordingly, the collet chuck 21 starts closing to pinch the knob portion 26 of the plug 25. In this situation, when movement in the direction of the arrow C is continued, the collet chuck 21 removes the plug 25 from the toner container 1030 as shown in FIG. 41, so that the toner contained in the toner container 1030 flows out to the case 18*a* (if an amount of the toner contained in the toner container 1030 is small, the toner does not flow out at this time). This state means that the setting of the toner supplying device 70 is completed.

Operation for supplying toner is described below. Regarding toner supply, when the density detection sensor 56 located inside the developing device 5 detects absence of toner, the driving unit 13 shown in FIGS. 37 and 39 operates to drive the joint 13*c* to rotate in a direction indicated by an arrow B. Accordingly, the joint 13*c* is engaged with the protrusion 32*a* formed on the rear portion of the toner container 1030, so that the toner container 1030 rotates. With rotation of the toner container 1030, the toner is discharged from the opening 23 and collected in the case 18*a*. At the same time, the rotation of the toner container 1030 is transmitted to the container holding member 16 via the drive rib 16*b* that is integrated with the container holding member 16, so that the toner supply wings 117 rotate while sliding on the inner wall surface of the case 18*a*. As a result, the toner collected in the case 18*a* is stirred. When each of the toner supply wings 117 passes through the slit hole 19*a* of the elastic member 19, the toner is pushed out of the slit hole 19*a*. More specifically, when each of the toner supply wings 117 is pushed out of the slit hole 19*a*, the toner collected around an edge portion of the slit hole 19*a* or an edge portion of the opening 18*c* is pushed out. The toner that has been pushed out falls within the cover 29 so that the toner is supplied from a toner fall path 71 to the developing device 5 via the opening 29*a* that is formed on the bottom side of the cover 29.

In other words, only while the toner container 1030 is rotating, the toner is pushed out from the elastic member 19 to the toner fall path 71 so that the toner is supplied to the developing device 5. Accordingly, the toner density in the developing device 5 is maintained constant.

By mounting a removing mechanism that removes the plug 25 on the toner supplying device 70, the toner container 1030 can be mounted on the container holder 81 while the opening 23 is sealed by the plug 25. Therefore, even when the toner container 1030 is mounted on the container holder 81 in a substantially horizontal position, it is possible to prevent leakage of toner from the opening 23.

When the plug 25 is put on the opening 23 of the toner container 1030, the above-mentioned operation for removing the plug 25 from the opening 23 is performed in a reverse order. In this manner, when the plug 25 is put on the opening 23 of the toner container 1030 to seal the opening 23 by the plug 25 at the time of removal of the toner container 1030 from the container holder 81, it is possible to prevent a situation in which the toner that is adhered to a wall surface of the toner container 1030 near the opening 23 of the toner container 1030 is leaked and dispersed from the opening 23 to the inside of the image forming apparatus.

As described above, the toner supplying device 70 according to the present embodiment enables replacement of the toner container 1030 without causing leakage of toner from the opening 23 of the toner container 1030.

Figure 42:
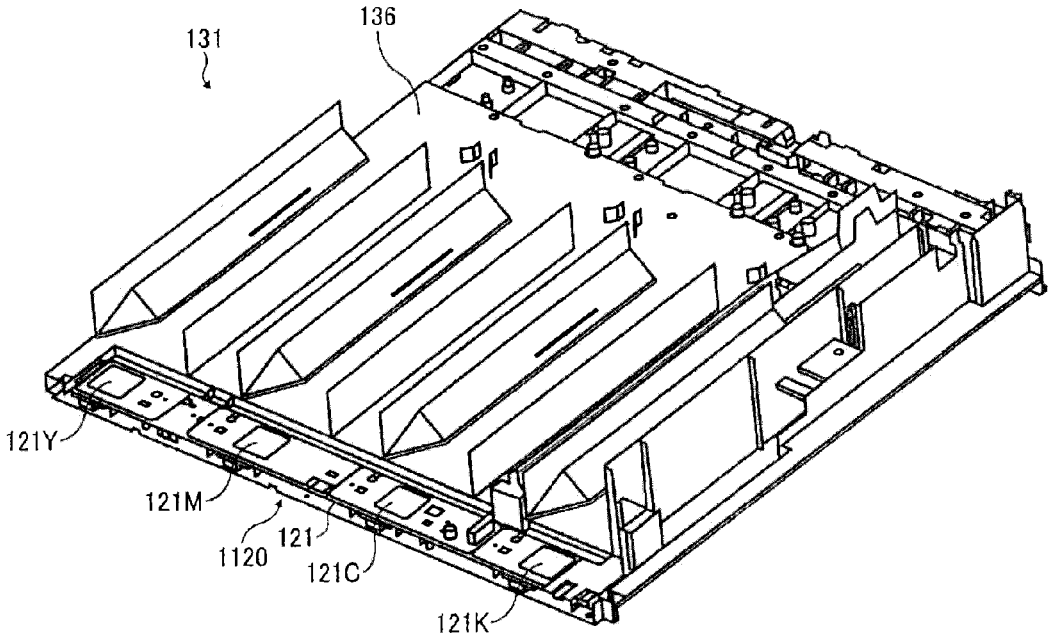
FIG. 42 is a perspective view of a holding unit of a toner-container housing unit.

In the present embodiment, similar to the configuration shown in FIG. 10, the single antenna substrate 120 is mounted on the guide plate 136 of a toner-container housing unit 131 (i.e., toner supplying devices 70Y, 70M, 70C, and 70K) on which the toner containers 1030 are removably mounted in parallel to each other. The toner-container housing unit 131 of the present embodiment shown in FIG. 42 includes the same components as those shown in FIG. 10. These components are denoted with the same reference numerals as of the first embodiment, and therefore, the explanation in the first embodiment should be referred to as appropriate.

In a state where the toner container 1030 is mounted on the toner-container housing unit 131, the RFID tag on the toner container 1030 and the image forming apparatus body 100 mounted with an RFID reader 1120 exchange necessary information with each other. In other words, information stored in the RFID tag is transmitted to the control unit (not shown) of the image forming apparatus body 100 via the RFID reader 1120, and information about the image forming apparatus body 100, which is acquired by the control unit, is transmitted to and stored in the RFID tag via the RFID reader 1120. The image forming apparatus body 100 is optimally controlled based on the above information. For example, when it is detected from the above information that the toner container 1030 filled with toner of color different from designated color is mounted on the toner-container housing unit 131, the control unit stops operation of the toner supplying device 70.

Salient features of the present embodiment will be described in detail below.

Figure 35:
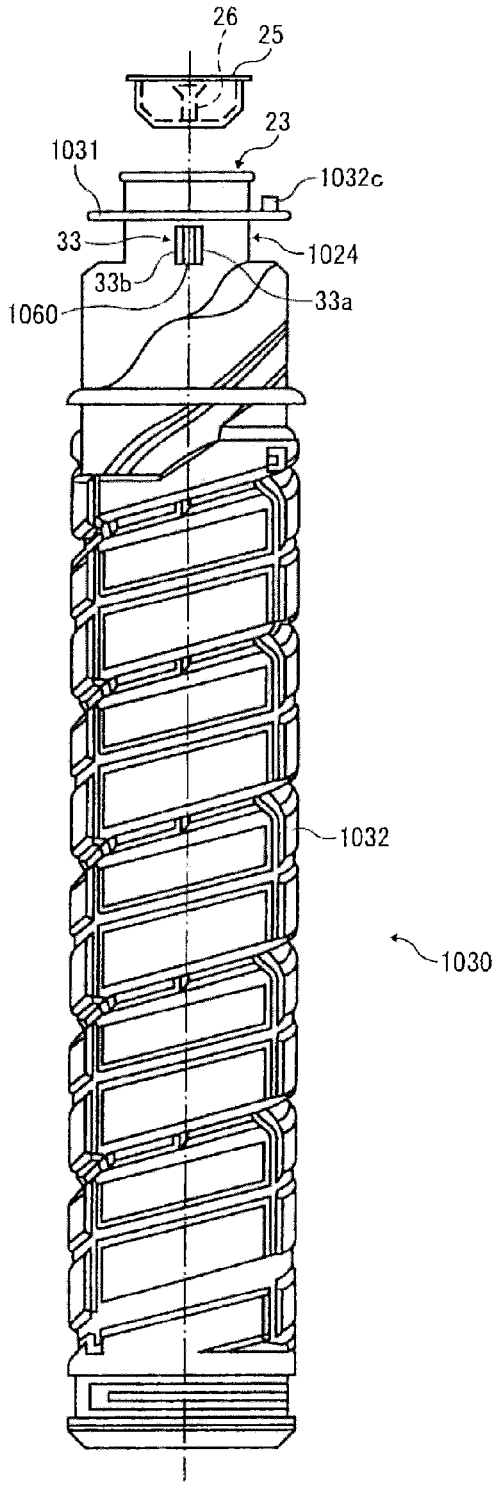
FIG. 35 is a schematic diagram of a toner container equipped with an RFID tag on an outer peripheral surface of a container body at an end portion of the container body where an opening is formed.

In the present embodiment, as shown in FIG. 35, an RFID tag 1060 is attached to an outer peripheral surface of a port 1024 that is formed on one end portion of the toner container 1030 on the side where the opening is formed.

Figure 43A:
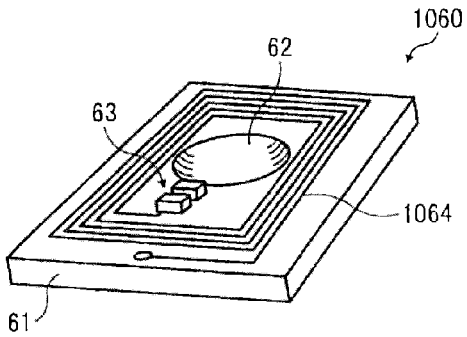
FIG. 43A is a perspective view of a back surface of an RFID tag.
Figure 43B:
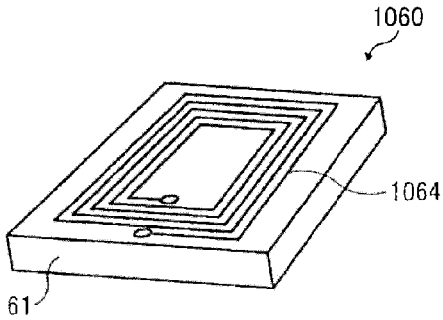
FIG. 43B is a perspective view of a front surface of the RFID tag.

FIGS. 43A and 43B illustrate an example of the RFID tag 1060. More specifically, FIG. 43A is a perspective view of a back surface of the RFID tag, and FIG. 43B is a perspective view of a front surface of the RFID tag. A memory unit 62 that is in a convex spherical shape and formed on a substrate 61 on the back surface of the RFID tag stores therein data listed in (1), (2), and (3) as follows. The data listed in (1) and (2) are initial data stored at the time of manufacturing the toner container.

(1) A type of toner to be contained, characteristics of the toner, a contained amount, a manufacturing number of the toner, a manufacturing date, a manufacturing factory, and a near-end timing (timing just before toner is run out) according to the contained amount (the number of pixels to be printed just before the toner is run out, and the number of containers).

(2) A type of a container, a manufacturing number, a manufacturing date, and a type of a mountable body.

(3) Updated data: a manufacturing number of a machine body for actual mounting, a mounting date (history), the total number of pixels of a formed image, a latest contained amount (i.e., a remaining amount) calculated from an amount of consumption based on the total number of pixels, and a toner end date (history).

A capacitor 63 mounted on the back surface of the RFID tag is a rectifier capacitor for cutting noise. In the present embodiment, both a low-pass capacitor and a high-pass capacitor are mounted.

An antenna 1064 is printed on each of the front surface and the back surface of the RFID tag 1060. The antenna 1064 has a directivity of an electromagnetic wave to each of the front surface and the back surface of the RFID tag 1060 (i.e., in a direction vertically outward from each of the front surface and the back surface of the RFID tag 1060). The antenna 1064 can be configured to have directivity to either the front surface or the back surface of the RFID tag 1060 as long as communication with the RFID reader 1120 mounted on the image forming apparatus body can be established.

The substrate 61 of the RFID tag 1060 is supported by a rib pair 33 that is formed of a rib 33*a* and a rib 33*b* that are protruded from an outer peripheral surface of the port 1024 of a container body 1032 (i.e., an outer peripheral surface of the container body 1032 near the opening 23). When the RFID tag 1060 is to be supported by the rib pair 33, adhesive or thermal deposition is not necessary because an operator can fix the RFID tag 1060 to the container body 1032 by inserting the substrate 61 of the RFID tag 1060 into a space between the rib pair 33 by hand or by using a tool. Therefore, even when the surface of the container body 1032 has adhesive-resistant property, the RFID tag 1060 can be easily supported by the container body 1032.

At the time of assembly, the RFID tag 1060 is not just mounted on the outer peripheral surface of the container body 1032 but inserted into the space between the rib pair 33 in a vertical direction. Therefore, the space between the rib pair 33 as a mounting portion of the RFID tag 1060 with respect to the container body 1032 can be assuredly viewed, resulting in reducing an occurrence of assembly failure.

Figure 44:
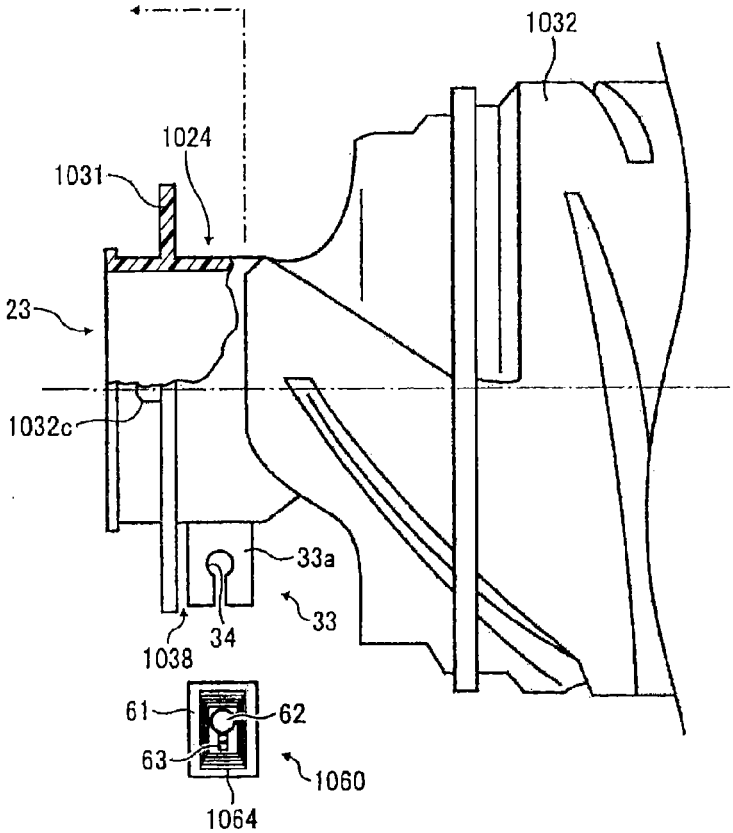
FIG. 44 is an enlarged view of components located near an opening of the toner container.

In the present embodiment, as shown in FIG. 44, the rib pair 33 is not integrated with the flange 1031 and is provided with a slit (space) 1038 between the rib pair 33 and the flange 1031 so that the RFID tag 1060 can be easily inserted by pushing the rib pair 33 open.

A groove 34 through which the memory unit 62 of the RFID tag 1060 and some integrated components on the substrate 61 (e.g., the capacitor 63) can pass is formed on the rib 33*a* of the rib pair 33. When the RFID tag 1060 is set by being inserted into the space between the rib pair 33, the memory unit 62 and the capacitor 63 of the RFID tag 1060 are fitted in the groove 34 such that the RFID tag 1060 is brought into slight contact with the surface of the memory unit 62 by pressure on the surface of the toner container 32 or slight backlash is remained so that removal of the RFID tag 1060 from the space of the rib pair 33 can be prevented.

If a frequency band of an electromagnetic wave emitted from the motor 13*e* of the driving unit 13 is near to a frequency band of a radio signal used for communication between the RFID tag 1060 and the RFID reader 1120, the electromagnetic wave emitted from the motor 13*e* may be applied to the radio signal. Therefore, a communication failure may occur in the communication between the RFID tag 1060 and the RFID reader 1120 because of the electromagnetic wave emitted from the motor.

In the present embodiment, the RFID tag 1060 is attached to the outer peripheral surface of the container body near the opening 23, so that the RFID tag 1060 is located at a position more distant from the driving unit 13 than the RFID tag that is attached to the outer peripheral surface of the container body near a rear portion of the container body 1032 where the protrusion 32*a* and the protrusion 32*b* that are engaged with the driving unit 13 are formed. Therefore, compared to the situation where the RFID tag is attached to the outer peripheral surface of the container body near the rear portion, the electromagnetic wave emitted from the motor 13*e* of the driving unit 13 is less applied as a noise to the communication between the RFID tag 1060 and the RFID reader 1120. As a result, occurrence of the communication failure due to the electromagnetic wave emitted from the motor 13*e* in the communication between the RFID tag 1060 and the RFID reader 1120 can be more prevented.

While it may depend on a power size of the motor 13*e* of the driving unit 13, assuming that a direct-current (DC) motor with rated input power of 2.4 volt and 1.4 ampere level is used, application of noise to the communication between the RFID tag 1060 and the RFID reader 1120 can be prevented if such a positional relation that the RFID tag 1060 and the RFID reader 1120 are located at an interval of 50 millimeters.

When the toner container 1030 is mounted on the toner supplying device 70, the RFID reader 1120 is located below the case 18*a* that is a body-side mechanism located relatively close to the opening 23. On the other hand, the joint 13*c* of the driving unit 13 that is a body-side mechanism for rotating the container body 1032 is located at an interval of about a length of an upstream side in the longitudinal direction of the container body 1032 from a position where a pumping unit is formed (i.e., a position where an angle of a spiral groove just upstream of the opening 23 becomes low, and, a stepped projecting portion is formed inside the container body such that the projecting portion guides the toner at around the inner wall of the container body toward a center portion where the opening 23 is formed). The motor 13*e* that is directly connected to the joint 13*c* is located outside of the joint 13*c*.

The toner is a conductor with middle resistance, so that when the toner adheres to the RFID tag 1060, an undesignated portion on the substrate 61 of the RFID tag 1060 may be conducted, resulting in damaging a circuit of the substrate.

In the present embodiment, as shown in FIG. 41, a space where the RFID tag 1060 is located is separated from the opening 23 by the flange 1031. The flange 1031 functions as a wall that prevents dispersion of the toner discharged from the opening 23 toward the RFID tag 1060 along with air flow. Therefore, it is possible to prevent the RFID tag 1060 from being covered with toner powder or fog when the toner is discharged from the opening 23. As a result, it is possible to prevent a situation in which an undesignated portion of the substrate 61 of the RFID tag 1060 is conducted because of adhesion of toner to the RFID tag 1060 and the circuit of the substrate is damaged.

A diameter of the flange 1031 that functions as a wall for preventing the dispersion of the toner discharged from the opening 23 toward the RFID tag 1060 along with air flow is set such that the inner wall surface of the container holding member 16 on the toner-supplying device body comes into contact with an end surface of the flange 1031 to the extent that the toner container 1030 can rotate, or a small space is formed between the inner wall surface of the container holding member 16 and the end surface of the flange 1031.

Figure 45:
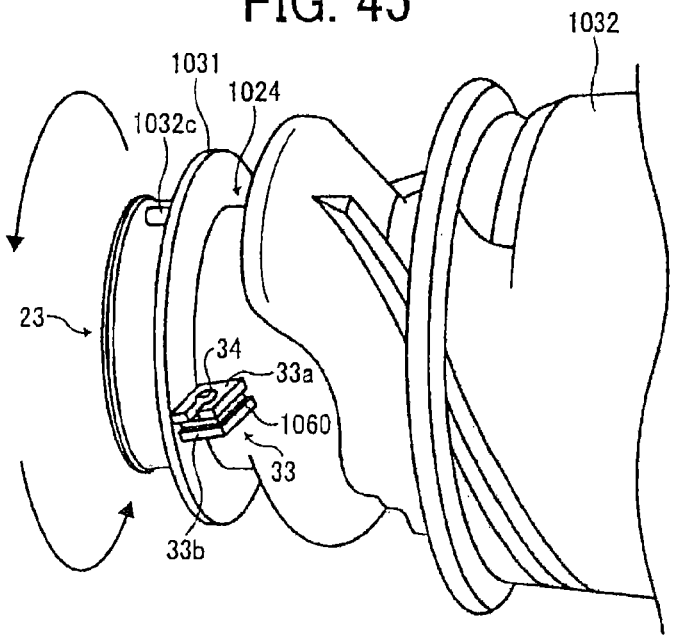
FIG. 45 is an enlarged perspective view of the components located near the opening of the toner container.

As shown in FIG. 45, on the flange 1031 is formed the driving-force transmitting protrusion 1032*c* that is to be engaged with the drive rib 16*b* formed on the inner peripheral surface of the container holding member 16 of the toner supplying device 70. A position of the driving-force transmitting protrusion 1032*c* formed on the flange 1031 is changed along with rotation of the toner container 1030, so that rotation driving force is conveyed to the toner supply wings 117 via the container holding member 16. In this manner, the flange 1031 is configured to function as a part of a drive conveying unit that conveys rotation driving force to the toner supply wings 117 together with the driving-force transmitting protrusion 1032*c*. Thus, the flange 1031 can serve a plurality of functions, i.e., a function of an air-flow shielding member as a wall for preventing the dispersion of the toner discharged from the opening 23 toward the RFID tag 1060 along with air flow, and a function of the drive conveying unit that conveys the rotation driving force to the toner supply wings 117. Therefore, compared to a configuration in which a member that serves one of the above functions is separately provided, the toner supplying device 70 can be downsized. In other words, a plurality of the functions (a drive conveying function and an air-flow shielding function) can be achieved simultaneously with a compact layout.

When impact is directly applied to the RFID tag 1060 because of collision of the RFID tag 1060 with the floor due to dropping of the toner container 1030 to a floor, the RFID tag 1060 may be removed from the container body 1032. Furthermore, even if the RFID tag 1060 is not removed from the RFID tag 1060, the RFID tag 1060 may be damaged, resulting in disabling communication of information to the RFID reader 1120.

Figure 46:
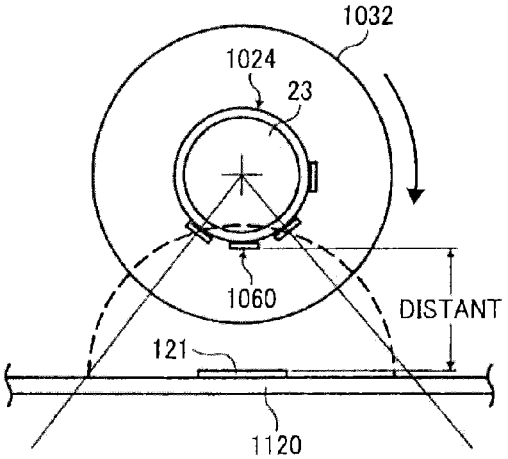
FIG. 46 is a schematic diagram of a toner container viewed from an opening side in a direction of a rotational axis of the toner container, when an RFID tag is placed in a lateral position on an outer peripheral surface of a container body on the opening side.

As shown in FIG. 46, the container body 1032 has a maximum projected area when viewed in a rotational axis direction of the toner container (i.e., a rotational axis direction of the spiral groove), and a projected area of the RFID tag 1060 viewed in the rotational direction of the toner container is within the projected area of the container body 1032. Therefore, even when the toner container 1030 is dropped and an outer wall surface of the container body 1032 collides with a floor, it is possible to prevent a situation in which impact is directly applied to the RFID tag 1060 because the RFID tag 1060 is located inside the outer wall surface of the toner container.

The RFID tag 1060 to be attached to the container body 1032 should preferably be a passive tag that is compact, cheap, and operable with use of the electromagnetic wave from the RFID reader 1120 as drive energy. When such a passive tag is used, a communication distance to the RFID reader 1120 is limited to several tens of millimeters because the tag is equipped with a built-in antenna. However, in the present embodiment, the RFID tag 1060 and the RFID reader 1120 are located close to each other, so that communication can be established without any difficulty. The RFID tag 1060 and the RFID reader 1120 exchange the drive energy, a data signal, and the like with each other by using an electromagnetic induction method in which the drive energy and the data signal are sent through magnetic flux linkage of the antenna 121 of the RFID reader 1120 and the antenna 1064 of the RFID tag 1060 located close to the antenna 121. A frequency of the electromagnetic wave can be 13.56 megahertz as employed by a non-contact IC that is typically used as a cash card and the like, or can be others. The electromagnetic induction method enables more effective transmission of energy than a radio wave method, and it is widely used in a mainstream product of a current non-contact IC tag, leading to cost reduction.

Figure 47:
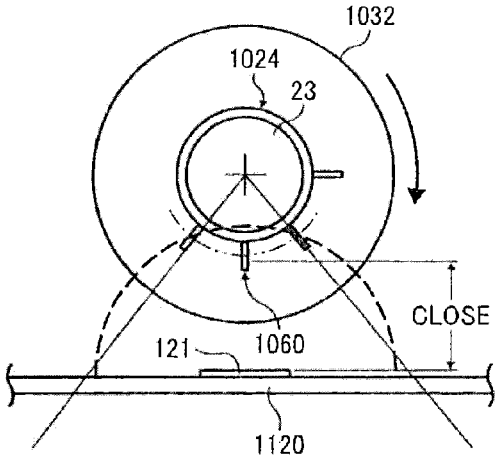
FIG. 47 is a schematic diagram of the toner container viewed from the opening side in the direction of the rotational axis of the toner container, when the RFID tag is placed in an upright position on the outer peripheral surface of the container body on the opening side.

As shown in FIG. 47, the RFID tag 1060 is attached to the outer peripheral surface of the port 1024 of the container body 1032 in an upright position so that a distance between the RFID reader 1120 and the RFID tag 1060 can be made shorter. Accordingly, even the RFID tag 1060 that is capable of only a short-distance communication can establish communication with the RFID reader 1120. When the spiral groove is formed in the inner wall of the container body, the toner in the container body 1032 is conveyed toward the opening 23 by rotating the toner container 1030, so that the RFID tag 1060 is rotated around a rotational axis of the toner container along with the rotation of the container body 1032. Therefore, a distance from the RFID tag 1060 to the RFID reader 1120 and a communication direction are variable. However, a communicable range in a rotational range of the container can be increased compared to the configuration in which the RFID tag 1060 is attached to the outer peripheral surface of the container body 1032 not in an upright position but in a lateral position.

Comparing a communication distance (i.e., a distance between the antenna 121 of the RFID reader 1120 and a center of the antenna 1064 of the RFID tag 1060 within a communication available range (within a semicircle represented by a dashed line in the figure) of the RFID reader 1120) in a situation where the RFID tag 1060 is attached to the port 1024 not in the upright position but in the lateral position as shown in FIG. 46 with the communication distance in a situation where the RFID tag 1060 is attached to the port 1024 in the upright position as shown in FIG. 47, the communication distance in the situation where the RFID tag 1060 is attached to the outer peripheral surface of the port 1024 in the upright position is always shorter than the communication distance in the situation where the RFID tag 1060 is attached to the outer peripheral surface of the port 1024 in the lateral position. Therefore, more stable communication operation can be performed in the situation where the RFID tag 1060 is attached to the port 1024 in the upright position than in the situation where the RFID tag 1060 is attached to the outer peripheral surface of the port 1024 in the lateral position.

As can be seen from FIG. 46, when the RFID tag 1060 is attached to the outer peripheral surface of the port 1024 of the RFID tag 1060 in the lateral position, even when the antenna 1064 is mounted on each of the front surface and the back surface of the RFID tag 1060, the RFID tag 1060 has to be located outside of the communication range of the RFID reader 1120 at a position where the back surface of the RFID tag 1060 faces the RFID reader 1120, though this situation is not preferable. On the other hand, as can be seen from FIG. 47, when the RFID tag 1060 is attached to the outer peripheral surface of the port 1024 in the upright position and the antenna 1064 is mounted on each of the front surface and the back surface of the RFID tag 1060 with directivity of transmission and reception to each of the front surface and the back surface of the RFID tag 1060, the RFID tag 1060 can maintain the same performance for transmission and reception before and after the RFID tag 1060 passes above the antenna 121 of the RFID reader 1120.

Figure 48:
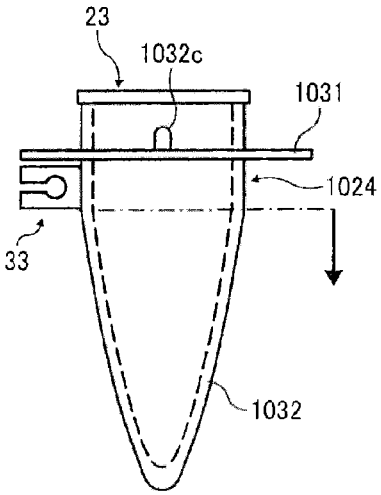
FIG. 48 is a schematic diagram of an intermediate molded product of the toner container, which is obtained after completion of primary processing through injection molding.

In the toner container 1030 of the present embodiment, regarding a shape of a portion on the opening 23 side from a chain line shown in FIG. 44, a shape that has been obtained through injection molding as primary processing is remained as a final shape. A portion on the rear portion side of the container body 1032 from the chain line shown in FIG. 44 is formed through blow molding as secondary processing. More specifically, the container body 1032 having the spiral groove on the inner wall thereof is formed by using material such as polypropylene (PP) or polyethylene terephthalate (PET) in such a manner that an intermediate molded product as shown in FIG. 48, which is obtained after completion of the primary processing (the injection molding), is put into a mold for the blow molding and then air is blown from an upper side of the mold.

In this manner, at least the outer peripheral surface of the container body 1032 on the opening 23 side on which the RFID tag 1060 is to be mounted is made of resin and formed through the injection molding. Polypropylene (PP) or polyethylene terephthalate (PET) that are suitable for the blow molding are so-called adhesive-resistant material, so that the RFID tag 1060 can hardly be fixed to such material with a double-sided tape. The RFID tag 1060 may be attached to even PP by using a special adhesive or a special double-sided tape for the adhesive-resistant material. However, in the blow molding, it is difficult to improve an accuracy of dimension, so that it is resultantly difficult to make an attachment surface flat and obtain a desired accuracy of plane. Even when the RFID tag 1060 is fixed to the container body 1032 by using a rib and the like without using an adhesive, it may be difficult to obtain a desired dimension of engagement for fixing the substrate 61 of the RFID tag 1060 by shrink fit or the like, or it may be difficult to form a protrusion for fixing (i.e., a small rib or the like can hardly be formed by the blow molding).

As described above, according to the present embodiment, at least the outer peripheral surface of the toner container 1030 on the opening 23 side on which the RFID tag 1060 is to be mounted is made of resin and formed through the injection molding, so that material other than PP and PET can be used. Furthermore, even when the container body 1032 is integrally molded by using PP and PET, if a portion around the opening 23 is formed first through the injection molding, a desired accuracy of the attachment surface for the double-sided tape and the like can be obtained. Moreover, the desired accuracy of the dimension can be easily obtained, so that each structured portion (i.e., a rib, a concave portion, and the like) can be easily formed on the container body 1032.

To fix the RFID tag 1060 to the container body 1032, the accuracy of the dimension of a fixation portion of the container body 1032 where the RFID tag 1060 is to be fixed needs to be assured. The blow molding is employed for molding a plastic bottle of drink and enables integrated molding of a container. Therefore, when the container body 1032 is molded only through the blow molding, holes from which toner may be leaked can hardly be formed on the container body 1032; however, a dimension of molding is less assured than in the injection molding. While the accuracy of the dimension needs to be assured for a portion of the container body 1032 where the RFID tag 1060 is to be fixed so that a margin for attachment of the RFID tag 1060 can be assured, if the container body 1032 is molded only through the blow molding, it is usually difficult to form the portion for fixing the RFID tag 1060 on the container body 1032.

Therefore, as described in the present embodiment, if at least the outer peripheral surface of the toner container 1030 on the opening 23 side on which the RFID tag 1060 is to be mounted is formed through the injection molding, the accuracy of the dimension of the above-mentioned portion for fixing the RFID tag 1060 to the container body 1032 can be assured.

Furthermore, the container body 1032 is formed through the blow molding after the injection molding is completed, so that the container body 1032 can be integrally molded. Therefore, while a container molded by assembling a plurality of parts may include a hole from which toner may be leaked because of mismatching of attachment portion of each parts, problem with formation of such a leakage hole can be prevented by employing the blow molding.

Figure 49:
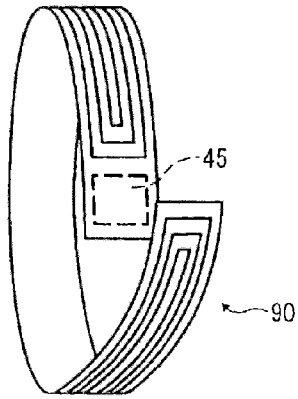
FIG. 49 is a schematic diagram for explaining how an RFID tag in a rectangular shape is formed into a tubular shape.

In a fifteenth configuration example, as shown in FIG. 49, the RFID tag 90 (i.e., electronic substrate) in a rectangular shape is formed into a tubular shape by attaching a front surface of one end portion of the RFID tag 90 and a back surface of the other end portion of the RFID tag 90. When the RFID tag 90 is attached to the container body 1032, the RFID tag 90 in the rectangular shape is wound around the outer peripheral surface of the port 1024 and then the front surface of one end portion and the back surface of the other end portion are stuck to each other by the adhesive member 45 as shown in FIG. 18, instead of being attached to the rib pair 33 that is formed on the outer peripheral surface of the port 1024 in the upright position. As a result, the RFID tag 90 in the tubular shape can be attached to the container body 1032.

Figure 51B:
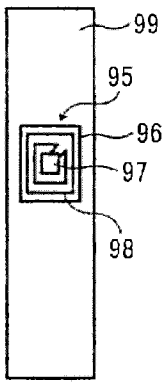
FIG. 51B illustrates another example of an RFID tag.
Figure 51A:
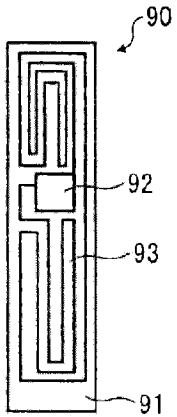
FIG. 51A illustrates an example of an RFID tag.

As shown in FIG. 51A, the RFID tag 90 of the present configuration example includes the flexible and heat-shrinkable electronic substrate 91, the IC chip 92 that is mounted on the electronic substrate 91 and stores therein the above-mentioned information, the antenna unit 93 that is electrically connected to the IC chip 92 and arranged on the entire circumference of the electronic substrate 91, and the like.

An RFID tag configured as shown in FIG. 51B is also applicable. That is, the RFID tag includes the RFID tag 95, which is formed of the electronic substrate 96 on which the IC chip 97 that stores therein information and the antenna unit 98 that is electrically connected to the IC chip 97 are mounted, and the flexible and heat-shrinkable holding member 99 that is in a tubular shape and holds the electronic substrate 96 of the RFID tag 95. With use of this RFID tag, a commonly-available IC chip can be used, resulting in reduction in costs for the RFID tag.

However, when the RFID tag as shown in FIG. 51B is used, a communication distance between the RFID tag 95 and the antenna 121 of the RFID reader 1120 may become long when rotation of the toner container 1030 for the toner supply operation is stopped, depending on an attachment position of the RFID tag to the container body 1032. If the communication distance becomes long, the RFID tag 95 and the RFID reader 1120 may not perform good communication.

In contrast, with use of the RFID tag 90 equipped with the antenna unit 93 that is arranged on the entire circumference of the electronic substrate 91, a distance between the antenna unit 93 of the RFID tag 90 attached to the toner container 32 and the antenna 121 of the RFID reader 1120 that is mounted on the image forming apparatus body 100 can always be maintained at a desired distance when the rotation of the toner container 32 for the toner supply operation performed by the toner supplying device 70 is stopped. Therefore, the above-mentioned problem can be prevented.

Figure 50:
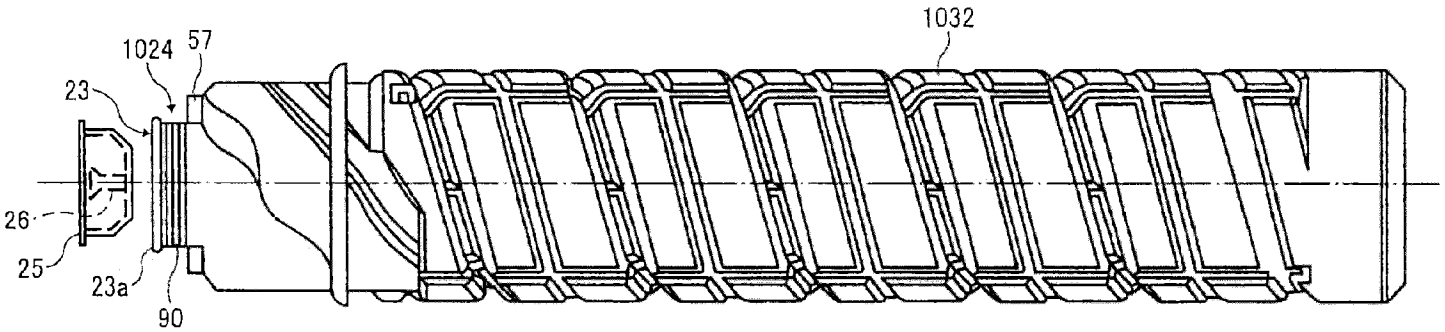
FIG. 50 is a schematic diagram of the toner container equipped with an RFID tag in a tubular shape on an outer peripheral surface of the container body at an end portion of the container body where the opening is formed.

As shown in FIG. 50, the RFID tag 90 attached to the outer peripheral surface of the port 1024 is controlled not to move in a longitudinal direction of the toner container (i.e., an axial direction of the RFID tag 90 in the tubular shape) by the flange portion 23*a* that forms an edge of the opening 23 and the rib 57 that is arranged at a position where the flange portion 23*a* and the rib 57 can sandwich the RFID tag 90 in the longitudinal direction of the toner container (i.e., a position separated from the flange portion 23*a* at an interval substantially the same as a width of the RFID tag 90 in the longitudinal direction of the toner container). In other words, both edges of the RFID tag 90 in the longitudinal direction of the toner container are brought into contact with respective end walls of the flange portion 23*a* and the rib 57 so that movement of the RFID tag 90 in the longitudinal direction of the toner container can be restricted. Accordingly, a relative position of the RFID tag 90 in the longitudinal direction of the toner container with respect to the container body 1032 is fixed.

Regarding a relation between a size of each of the flange portion 23*a* and the rib 57 in a height direction (i.e., an outward direction from the outer peripheral surface of the port 1024 of the container body 1032) and a thickness of the RFID tag 90, the size of each of the flange portion 23*a* and the rib 57 in the height direction can be either larger or smaller than the thickness of the RFID tag 90 as long as the flange portion 23*a* and the rib 57 can restrict the movement of the RFID tag 90 in the longitudinal direction of the toner container. However, it is preferable to set the size of each of the flange portion 23*a* and the rib 57 in the height direction to be larger than the thickness of the RFID tag 90 because the flange portion 23*a* and the rib 57 in such sizes can more effectively prevent a situation in which the RFID tag 90 moves in the longitudinal direction of the toner container over the flange portion 23*a* and the rib 57.

Furthermore, the RFID tag in the tubular shape is attached to the outer peripheral surface of the cylindrical port 1024, so that the inner surface of the RFID tag 90 and the outer peripheral surface of the port 1024 are brought into contact with each other. Therefore, movement of the RFID tag 90 in a direction perpendicular to the longitudinal direction of the toner container (i.e., a direction perpendicular to the axial direction of the RFID tag 90 in the tubular shape) can be restricted over the entire circumference of the port 1024. Accordingly, a relative position of the RFID tag 90 with respect to the container body 1032 in the direction perpendicular to the longitudinal direction of the toner container is fixed.

In this manner, the RFID tag 90 can be attached to the container body 1032 at a fixed position without being attached to the outer peripheral surface of the container body 1032 with an adhesive or the like. Furthermore, it is possible to prevent removal of the RFID tag 90 from the container body 1032.

In the present configuration example, the RFID tag 90 is attached to the outer peripheral surface of the container body near the opening 23, so that the RFID tag 90 is located at a position more distant from the driving unit 13 than the RFID tag 90 that is attached to the outer peripheral surface of the container body near the rear portion of the container body 1032 equipped with the protrusion 32*a* and the protrusion 32*b* that are to be engaged with the driving unit 13. Therefore, compared to a situation in which the RFID tag 90 is attached to the outer peripheral surface of the container body near the rear portion, the electromagnetic wave emitted from the motor 13*e* of the driving unit 13 is less applied to the communication between the RFID tag 90 and the RFID reader 1120. As a result, occurrence of a communication failure due to the electromagnetic wave emitted from the motor 13*e* in the communication between the RFID tag 90 and the RFID reader 1120 can be more prevented.

Furthermore, while the RFID tag is attached to the container body 1032 of the toner container 1030 of the present configuration example in a manner different from that for the toner container 1030 of the fourteenth configuration example, various configurations and methods for molding the toner container 1030 described in the fourteenth configuration example can also be applied to the toner container 1030 of the present configuration example, and therefore, the same effects as described in the fourteenth configuration example can be obtained.

According to an embodiment of the present invention, a toner container as a powder container includes the container body 1032 that contains powder used for image formation; a drive transmitting unit that is arranged on one end of the container body 1032 and is engaged with the driving unit 13 of the image forming apparatus so as to receive rotation driving force from the driving unit 13; the opening 23 that is arranged on other end of the container body 1032 and configured to discharge powder contained in the container body 1032 out of the container body 1032; a conveying unit that conveys powder contained in the container body 1032 to the opening 23 along with rotation of the container body 1032; and the RFID tag 1060 as an information storage unit that is arranged on an outer peripheral surface of the container body 1032 near the opening 23, and is configured to store therein at least information related to powder contained in the container body 1032 and exchange the information with the RFID reader 1120 as an information transmitting-receiving unit of the image forming apparatus in a non-contact manner. In the present embodiment, the RFID tag 1060 is attached to the outer peripheral surface of the container body near the opening 23, so that the RFID tag 1060 is located at a position more distant from the driving unit 13 than the RFID tag 1060 that is attached to the outer peripheral surface of the container body near the drive transmitting unit. Therefore, compared to a situation where the RFID tag 1060 is attached to the outer peripheral surface of the container body near the drive transmitting unit, the electromagnetic wave emitted from the driving unit 13 is less applied as a noise to the communication between the RFID tag 1060 and the RFID reader 1120. As a result, occurrence of the communication failure due to the electromagnetic wave emitted from the driving unit 13 in the communication between the RFID tag 1060 and the RFID reader 1120 can be more prevented.

Furthermore, according to another embodiment of the present invention, the container body 1032 has a maximum projected area when viewed from a direction of a rotational axis of the conveying unit, and a projected area of the RFID tag 1060 is within the projected area of the container body 1032. Therefore, it is possible to prevent direct application of impact on the RFID tag 1060 when the toner container is dropped, so that it is possible to prevent a situation in which the RFID tag 1060 is removed from the container body 1032 or the RFID tag 1060 is damaged and information transmission and reception capability thereof is disabled.

Moreover, according to still another embodiment of the present invention, the RFID tag 1060 includes at least the antenna 1064 for exchanging the information with the RFID reader 1120, and the substrate 61 mounted with the antenna 1064; and the substrate 61 is fixedly mounted on an outer peripheral surface of the container body near the opening 23 in an upright position. Therefore, communication can be established even with an RFID tag that is capable of only a short-distance communication. More specifically, when a spiral groove is formed on the inner wall of the container body 1032, the RFID tag 1060 is caused to rotate, so that a distance from the RFID tag 1060 to the RFID reader 1120 and a communication direction are variable. However, a communicable range in a rotational range of the container can be increased compared to the configuration in which the RFID tag 1060 is attached not in an upright position to the outer peripheral surface of the container body 1032 that is configured to rotate.

Furthermore, according to still another embodiment of the present invention, the substrate is supported by the rib pair 33 that is protruded from the outer peripheral surface of the container body near the opening 23. Therefore, the RFID tag 1060 can be fixed only by inserting the substrate 61 into a space between the rib pair 33 by an operator by hand or using a tool, without adhesive or thermal deposition. Furthermore, the RFID tag 1060 is not just mounted on the outer peripheral surface of the container but inserted into the space between the rib pair 33 in a vertical direction. Therefore, the space between the rib pair 33 as a mounting portion of the RFID tag 1060 with respect to the container body 1032 can be assuredly viewed, resulting in reducing an occurrence of assembly failure.

Moreover, according to still another embodiment of the present invention, a convex portion is formed on a surface of the substrate 61 of the RFID tag 1060 facing the rib pair 33, and either a hole or a concave portion to be engaged with the convex portion is formed on the rib pair 33. Therefore, when the RFID tag 1060 is set by being inserted into a space between the rib pair 33, the convex portion of the RFID tag 1060 is engaged with the concave portion of the rib pair 33. As a result, removal of the RFID tag 1060 from the container body 1032 can be prevented.

Furthermore, according to still another embodiment of the present invention, an air-flow shielding member is arranged between the RFID tag 1060 and the opening 23. Therefore, it is possible to prevent the RFID tag 1060 from being covered with powder of fog discharged from the opening 23.

Moreover, according to still another embodiment of the present invention, a second drive transmitting unit is arranged between the RFID tag 1060 and the opening 23 such that second drive transmitting unit is engaged with a powder conveying mechanism of the image forming apparatus so as to transmit rotation driving force that has been transmitted to the container body 1032 from the driving unit 13 toward the powder conveying mechanism, wherein the air-flow shielding member is formed of a part of the second drive transmitting unit. Therefore, a plurality of the functions (a drive conveying function and an air-flow shielding function) can be achieved simultaneously with a compact layout.

Furthermore, according to still another embodiment of the present invention, at least an outer peripheral surface of the container body near the opening 23 on which the RFID tag 1060 is to be mounted is made of resin and formed after injection molding. Therefore, material other than PP and PET can be used. Furthermore, even when the container body 1032 is integrally molded by using PP and PET, if a portion around the opening 23 is formed first through the injection molding, a desired accuracy of the attachment surface for the double-sided tape and the like can be obtained. Moreover, the desired accuracy of the dimension can be easily obtained, so that each structured portion (i.e., a rib, a concave portion, and the like) can be easily formed on the container body 1032. Furthermore, a fixation position of the RFID tag 1060 is set between the opening 23 and the container body 1032, so that when a portion from the opening 23 and the fixation position is formed through the injection molding, the accuracy of the dimension for the fixation can be assured.

Moreover, according to still another embodiment of the present invention, the container body 1032 is formed by performing blow molding on an intermediate product obtained through injection molding. Therefore, the shape of the container can be formed in an integrated manner. While a container formed of assembled parts may include a hole, from which toner may be leaked, because of mismatching of attachment portion of each parts, use of the blow molding can prevent formation of such a leakage hole.

Furthermore, according to still another embodiment of the present invention, the RFID tag is fixed to the container body with a heat-shrinkable ring member. Therefore, the RFID tag can be easily supported by the toner container even when the surface of the toner container 1030 is made of adhesive-resistant material.

Moreover, according to still another embodiment of the present invention, the conveying unit is a spiral protrusion formed on an inner wall surface of the container body 1032. Therefore, toner contained in the toner container 1030 can be conveyed toward the opening 23 with simple configuration.

Furthermore, according to still another embodiment of the present invention, in an image forming apparatus that includes an image carrier that carries a latent image; a developing unit that develops the latent image carried on the image carrier with powder developer; a powder supplying unit that is detachably equipped with a powder container containing the developer, and supplies the developer contained in the container body 1032 of the powder container to the developing unit; an RFID tag as an information storage unit that is attached to the container body 1032 and stores therein information related to the container body 1032; and an RFID reader as a communicating unit that is attached to a body of the image forming apparatus and reads information stored in the information storage unit, which is preferable to use the toner container 1030 of the present embodiment as a powder container.

According to one aspect of the present invention, the tubular member equipped with the information storage unit is attached to the container body such that the container body is located within an inner hole of the tubular member. Therefore, movement of the tubular member in a direction perpendicular to an axial direction of the tubular member can be restricted by the container body. Furthermore, movement of the tubular member, which is attached to the container body, in the axial direction of the tubular member can also be restricted. Thus, the movement of the tubular member attached to the container body can be restricted both in the axial direction and the direction perpendicular to the axial direction with respect to the container body. As a result, removal of the tubular member equipped with the information storage unit from the container body can be prevented.

Thus, according to the present invention, the information storage unit can be continuously attached to the powder container over time.

Furthermore, according to another aspect of the present invention, the information storage unit is attached to an outer peripheral surface of the container body near the opening, so that the information storage unit can be located more distant from the driving unit than an information storage unit attached to the outer peripheral surface of the container body near the drive transmitting unit. Therefore, compared to a situation in which the information storage unit is attached to the outer peripheral surface of the container body near the drive transmitting unit, an electromagnetic wave emitted from the driving unit is less applied to the communication between the information storage unit and the information transmitting-receiving unit. Therefore, occurrence of communication failure because of the electro magnetic wave emitted from the driving unit in the communication between the information storage unit and the information transmitting-receiving unit can be more prevented.

Thus, according to the present invention, occurrence of communication failure because of the electro magnetic wave emitted from the driving unit in the communication between the information storage unit and the information transmitting-receiving unit can be more prevented.

A powder container shown above has features as described in the following notes 1 to 12.

(Note 1)

A powder container including:

a container body that contains powder used for image formation;

a drive transmitting unit that is arranged on one end of the container body and is engaged with a driving unit of an image forming apparatus so as to receive rotation driving force from the driving unit;

an opening that is arranged on other end of the container body and configured to discharge powder contained in the container body out of the container body;

a conveying unit that conveys powder contained in the container body to the opening along with rotation of the container body; and an information storage unit that is arranged on an outer peripheral surface of the container body near the opening, and is configured to store therein at least information related to powder contained in the container body and exchange the information with an information transmitting-receiving unit of the image forming apparatus in a non-contact manner.

(Note 2)

The powder container according to note 1, wherein the container body has a maximum projected area when viewed from a direction of a rotational axis of the conveying unit, and a projected area of the information storage unit is within the projected area of the container body.

(Note 3)

The powder container according to note 1 or 2, wherein the information storage unit includes at least an antenna for exchanging the information with the information transmitting-receiving unit, and a substrate mounted with the antenna, and the substrate is fixedly mounted on an outer peripheral surface of the container body near the opening in an upright position.

(Note 4)

The powder containing unit according to note 3, wherein the substrate is supported by a rib that is protruded from the outer peripheral surface of the container body near the opening.

(Note 5)

The powder container according to note 4, wherein a convex portion is formed on a surface of the substrate, the surface facing the rib, and at least one of a hole and a concave portion to be engaged with the convex portion is formed on the rib.

(Note 6)

The powder container according to any one of notes 1 to 5, further comprising an air-flow shielding member that is arranged between the information storage unit and the opening.

(Note 7)

The powder container according to note 6, further comprising:

a second drive transmitting unit that is arranged between the information storage unit and the opening, and is engaged with a powder conveying mechanism of the image forming apparatus so as to transmit rotation driving force that has been transmitted to the container body from the driving unit toward the powder conveying mechanism, wherein the air-flow shielding member is formed of a part of the second drive transmitting unit.

(Note 8)

The powder container according to any one of notes 1 to 7, wherein at least an outer peripheral surface of the container body near the opening on which the information storage unit is to be mounted is made of resin and formed through injection molding.

(Note 9)

The powder container according to note 8, wherein the container body is formed by performing blow molding on an intermediate product obtained through injection molding.

(Note 10)

The powder container according to any one of notes 1 to 9, wherein the information storage unit is fixed to the container body with a heat-shrinkable ring member.

(Note 11)

The powder container according to any one of notes 1 to 10, wherein the conveying unit is a spiral protrusion formed on an inner wall surface of the container body.

(Note 12)

An image forming apparatus comprising:

an image carrier that carries a latent image;

a developing unit that develops the latent image carried on the image carrier with powder developer;

a powder supplying unit that is equipped with a powder container in a removable manner, the powder container containing the developer, and supplies the developer contained in a container body of the powder container to the developing unit;

an information storage unit that is attached to the container body and stores therein information related to the container body; and a communicating unit that is attached to a body of the image forming apparatus and reads information stored in the information storage unit, wherein the powder container is any one of notes 1 to 11.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder container, comprising:

a container body for containing powder used for image formation, the container body having a length along a longitudinal direction;

a drive transmitting unit to engage with a driving unit of an image forming apparatus so as to receive rotation driving force from the driving unit;

an opening that is arranged on an end of the container body and configured to discharge powder out of the container body, the opening facing the longitudinal direction;

a conveying unit that conveys powder contained in the container body to the opening due to rotation of the container body; and an information storage unit on an outer peripheral surface of the container body near the opening where the outer peripheral surface is not facing the longitudinal direction, storing therein at least information related to powder contained in the container body, and configured to exchange the information with an information transmitting-receiving unit of the image forming apparatus in a non-contact manner.

2. The powder container according to claim 1, wherein the container body has a maximum projected area when viewed from a direction of a rotational axis of the conveying unit, and a projected area of the information storage unit is within the projected area of the container body.

3. The powder container according to claim 1, wherein the information storage unit includes an antenna for exchanging the information with the information transmitting-receiving unit, and a substrate mounted with the antenna, and the substrate is fixedly mounted on the outer peripheral surface of the container body near the opening in an upright position.

4. The powder container according to claim 3, wherein the substrate is supported by a rib protruding from the outer peripheral surface of the container body near the opening.

5. The powder container according to claim 4, wherein a surface of the substrate includes a convex portion facing the rib, and the rib includes at least one of a hole and a concave portion to be engaged with the convex portion.

6. The powder container according to claim 1, further comprising an air-flow shielding member that is arranged between the information storage unit and the opening.

7. The powder container according to claim 6, further comprising:

a second drive transmitting unit between the information storage unit and the opening, for engaging with a powder conveying mechanism of the image forming apparatus so as to transmit rotation driving force that has been transmitted to the container body from the driving unit toward the powder conveying mechanism, wherein the air-flow shielding member is a part of the second drive transmitting unit.

8. The powder container according to claim 1, wherein the container body is formed by blow molding on an intermediate product obtained through injection molding.

9. The powder container according to claim 1, wherein the information storage unit is fixed to the container body with a heat-shrinkable ring member.

10. The powder container according to claim 1, wherein the conveying unit is a spiral protrusion formed on an inner wall surface of the container body.

11. An image forming apparatus comprising:

an image carrier that carries a latent image;

a developing unit that develops the latent image carried on the image carrier with powder developer;

a powder supplying unit including a removable powder container according to claim 1, the powder container containing the developer, and supplies the developer contained in a container body of the powder container to the developing unit;

an information storage unit that is attached to the container body and stores therein information related to the container body; and a communicating unit that is attached to a body of the image forming apparatus and reads information stored in the information storage unit.

12. The powder container according to claim 1, wherein at least the outer peripheral surface of the container body near the opening on which the information storage unit is to be mounted comprises resin and is formed by injection molding.

13. A toner container, comprising:

a container body for containing toner, the container body having a length along a longitudinal direction;

a member configured to receive rotation driving force from a driving unit of an image forming apparatus;

an opening that is arranged on a first end of the container body, the opening facing the longitudinal direction;

a conveyor disposed at an inner surface of the container body, for conveying the toner from a second end side, opposite to the first end, toward the first end; and an information storage device on an outer peripheral surface of the container body near the opening where the outer peripheral surface is not facing the longitudinal direction, storing therein at least information related to toner container, and configured to exchange the information with an information transmitting-receiving unit of the image forming apparatus, wherein:

the other peripheral surface of the container body includes a supporting portion which supports the information storage device, and at least the outer peripheral surface of the container body comprises resin and is formed by injection molding.

14. The toner container according to claim 13, where the information storage device has an almost rectangular shape.

15. The toner container according to claim 13, wherein the container body has a maximum projected area when viewed from a direction of a rotational axis of the conveyor, and a projected area of the information storage device is within the projected area of the container body.

16. The toner container according to claim 13, wherein the information storage device includes an antenna for exchanging the information with the information transmitting-receiving unit, and a substrate mounted with the antenna, and the substrate is fixedly mounted on the outer peripheral surface of the container body near the opening in an upright position.

17. The toner container according to claim 13, wherein the supporting portion comprises a rib which supports a substrate of the information storage device.

18. The toner container according to claim 17, wherein a surface of the substrate includes a convex portion facing the rib, and the rib includes at least one of a hole and a concave portion to be engaged with the convex portion.

19. The toner container according to claim 13, further comprising:

an air-flow shielding member that is arranged between the information storage device and the opening.

20. The toner container according to claim 19, further comprising:

a first drive transmitting unit to engage with a driving unit of an image forming apparatus so as to receive rotation driving force from the driving unit; and a second drive transmitting unit between the information storage device and the opening, for engaging with a toner conveying mechanism of the image forming apparatus so as to transmit rotation driving force that has been transmitted to the container body from the driving unit toward a toner conveying mechanism of the image forming apparatus, wherein the air-flow shielding member is a part of the second drive transmitting unit.

21. The toner container according to claim 13, wherein the container body is formed by blow molding on an intermediate product obtained through injection molding.

22. The toner container according to claim 13, wherein at least the outer peripheral surface of the container body near the opening on which the information storage unit is to be mounted comprises resin and is formed by injection molding.

* * * * *